US012329337B2

(12) United States Patent
Xie et al.

(10) Patent No.: US 12,329,337 B2
(45) Date of Patent: Jun. 17, 2025

(54) ROBOT CLEANING SYSTEM, BASE STATION, AND CONTROL METHOD

(71) Applicant: Positec Power Tools (Suzhou) Co., Ltd, Jiangsu (CN)

(72) Inventors: Mingjian Xie, Jiangsu (CN); Shisong Zhang, Jiangsu (CN); Hongbing Wu, Jiangsu (CN); Jianqiang Xu, Jiangsu (CN); Hongfeng Zhong, Jiangsu (CN); Ji Li, Jiangsu (CN); Yue Zhen, Jiangsu (CN); Biao Wang, Jiangsu (CN); Yuanzhong Ran, Jiangsu (CN)

(73) Assignee: Positec Power Tools (Suzhou) Co., LTD., Suzhou (CN)

( * ) Notice: Subject to any disclaimer, the term of this patent is extended or adjusted under 35 U.S.C. 154(b) by 425 days.

(21) Appl. No.: 17/417,086

(22) PCT Filed: Dec. 20, 2019

(86) PCT No.: PCT/CN2019/127143
§ 371 (c)(1),
(2) Date: Jun. 21, 2021

(87) PCT Pub. No.: WO2020/125774
PCT Pub. Date: Jun. 25, 2020

(65) Prior Publication Data

US 2022/0142444 A1 May 12, 2022

(30) Foreign Application Priority Data

Dec. 21, 2018 (CN) ..... 201811572153.8
Mar. 29, 2019 (CN) ..... 201910251091.9
(Continued)

(51) Int. Cl.
*A47L 11/40* (2006.01)
*A47L 11/28* (2006.01)

(52) U.S. Cl.
CPC ..... *A47L 11/4091* (2013.01); *A47L 11/28* (2013.01); *A47L 11/4011* (2013.01);
(Continued)

(58) Field of Classification Search
CPC ..... A47L 2201/02; A47L 2201/028; A47L 2201/04; A47L 11/4091; A47L 11/28;
(Continued)

(56) References Cited

U.S. PATENT DOCUMENTS 5,815,880 A 10/1998 Nakanishi
5,959,423 A 9/1999 Nakanishi et al.
(Continued)

FOREIGN PATENT DOCUMENTS

CN 1927549 A 3/2007
CN 203280338 U 11/2013
(Continued)

OTHER PUBLICATIONS

First Office Action in application No. 201911327611.6, dated May 11, 2023.
(Continued)

*Primary Examiner* — Eric J Rosen
*Assistant Examiner* — Sharonda T Felton
(74) *Attorney, Agent, or Firm* — Lee & Hayes, P.C.

(57) ABSTRACT

A robot cleaning system, including: a cleaning robot connectable to a mopping module of the cleaning robot, and a base station provided for the cleaning robot to dock, the cleaning robot includes: a main body; a mobile module; and a connection assembly, configured to detachably dispose the mopping module on the body of the robot; the base station includes: a storage module, configured to store at least one mopping module; an operating position, for the cleaning robot to dock to replace the mopping module; and a transfer module, configured to transfer the mopping module between
(Continued)

the storage module and the operating position; and the robot cleaning system further includes a control unit. Beneficial effects of the present disclosure are: the cleaning robot is more intelligent, and the corresponding base station is compact in structure and small in occupied area.

16 Claims, 51 Drawing Sheets

(30) Foreign Application Priority Data

| | | |
|---|---|---|
| Sep. 26, 2019 | (CN) | 201910916134.0 |
| Sep. 26, 2019 | (CN) | 201921620374.8 |
| Oct. 14, 2019 | (CN) | 201910971595.8 |
| Oct. 14, 2019 | (CN) | 201921712972.8 |

(52) U.S. Cl.
CPC ..... *A47L 11/4036* (2013.01); *A47L 2201/028* (2013.01); *A47L 2201/04* (2013.01)

(58) Field of Classification Search
CPC ..... A47L 11/4011; A47L 11/4036; B25J 11/0085
See application file for complete search history.

(56) References Cited

U.S. PATENT DOCUMENTS

| | | | | |
|---|---|---|---|---|
| 9,717,388 | B2 | 8/2017 | Jeong et al. | |
| 2009/0281661 | A1* | 11/2009 | Dooley | B60L 15/2036 901/1 |
| 2011/0160903 | A1* | 6/2011 | Romanov | A47L 9/2873 901/30 |
| 2013/0305481 | A1 | 11/2013 | Jung et al. | |
| 2015/0182089 | A1* | 7/2015 | Jeong | A47L 11/4038 15/98 |
| 2020/0353822 | A1 | 11/2020 | Romanov et al. | |
| 2022/0386834 | A1 | 12/2022 | Doughty et al. | |

FOREIGN PATENT DOCUMENTS

| | | | |
|---|---|---|---|
| CN | 205433581 | U | 8/2016 |
| CN | 106859512 | A | 6/2017 |
| CN | 107212818 | A | 9/2017 |
| CN | 101049218 | A | 10/2017 |
| CN | 107951448 | A | 4/2018 |
| CN | 207755219 | U | 8/2018 |
| CN | 108742350 | A | 11/2018 |
| CN | 109602356 | A | 4/2019 |
| CN | 109875465 | B | 6/2019 |
| CN | 110123216 | B | 8/2019 |
| CN | 110584547 | A | 12/2019 |
| CN | 110811448 | A | 2/2020 |
| CN | 210520909 | U | 5/2020 |
| CN | 210697500 | U | 6/2020 |
| CN | 211749313 | U | 10/2020 |
| CN | 211749322 | U | 10/2020 |
| CN | 211933914 | U | 11/2020 |
| CN | 112043206 | A | 12/2020 |
| CN | 112188857 | A | 1/2021 |
| CN | 212816148 | U | 3/2021 |
| CN | 112996422 | A | 6/2021 |
| CN | 114532905 | A | 5/2022 |
| DE | 102010017211 | A1 | 12/2011 |
| DE | 102016108460 | A1 | 11/2017 |
| EP | 3 311 722 | A2 | 4/2018 |
| EP | 311 722 | A3 | 7/2018 |
| EP | 840 625 | A1 | 6/2021 |
| JP | S63-93972 | A | 4/1988 |
| JP | H08335112 | A | 12/1996 |
| JP | H10-163290 | A | 6/1998 |
| JP | 2017117353 | | 6/2017 |
| JP | 2017-171434 | A | 9/2017 |
| JP | 2018097865 | | 6/2018 |
| KR | 100635643 | B1 | 10/2006 |
| KR | 10-2015-0078093 | | 7/2015 |
| WO | 2020/096246 | A1 | 5/2020 |

OTHER PUBLICATIONS

First Search Report in application No. CN201911327611.6, dated May 11, 2023.
Supplementary European search report in EP application No. EP19899794.2, dated Aug. 3, 2022.
Reasons for Refusal in application No. JP2021-536293, dated Mar. 14, 2023.
Reasons for Refusal in application No. JP2021-536293, dated Jul. 26, 2022.
Request_for the Submission of an Opinion in application No. KR10-2021-7019220, dated Mar. 28, 2023.
Request_for the Submission of an Opinion in application No. KR10-2021-7019220, dated Sep. 26, 2023.
Written opinion in PCT application No. PCT/CN2019/127143 , dated Mar. 19, 2020.

* cited by examiner

ROBOT CLEANING SYSTEM, BASE STATION, AND CONTROL METHOD

This application is a National Stage Application of International Application No. PCT/CN2019/127143, filed on Dec. 20, 2019, which claims benefit of and priority to Chinese Patent Application No. 201811572153.8, filed on Dec. 21, 2018, Chinese Patent Application No. 201910251091.9, filed on Mar. 29, 2019, Chinese Patent Application No. 201910916134.0, filed on Sep. 26, 2019, Chinese Patent Application No. 201921620374.8, filed on Sep. 26, 2019, Chinese Patent Application No. 201910971595.8, filed on Oct. 14, 2019 and Chinese Patent Application No. 201921712972.8, filed on Oct. 14, 2019, all of which are hereby incorporated by reference in their entirety for all purposes as if fully set forth herein.

BACKGROUND

Technical Field

The present disclosure relates to a robot cleaning system, a base station, and a control method, and in particular, to a robot cleaning system capable of automatically replacing a mopping module, and a corresponding base station and control method.

Related Art

With the development of sciences and technologies, robots are playing an increasingly important role in people's life, and in particular, domestic robots help emancipate people from burdensome housework, where cleaning robots are widely favored by users because of relatively wide applicability.

Existing cleaning robots can move autonomously and work without manual direct control and operating, and further have functions such as path planning, automatic obstacle avoidance, man-machine interaction, and returning for charging. Although the existing cleaning robots can meet a daily requirement of people for sweeping trash on the ground, the existing cleaning robots usually has no mopping function. In addition to the requirement of sweeping trash on the ground, many users further intend that the cleaning robots can mop, thereby keeping the ground in a relatively neat state. In terms of the mopping function of the cleaning robots, some corporations home and abroad make attempts one after another. For example, the Irobot corporation in USA submits the patent application No. CN108378786A which discloses a cleaning pad dedicated to a mobile robot, and the cleaning pad can absorb and retain a cleaning solution, and is suitably combined with more than one tool; The Ecovacs robot corporation submits the patent application No. CN107788913A, which discloses a ground cleaning robot equipped with a mopping cloth, and the ground cleaning robot detects a ground type during working, thereby avoiding a carpet; and so on. It is very easy for a mopping cloth to become dirty during working. Therefore, if the mopping cloth is not replaced in time, the cleaning effect is greatly degraded, and even the originally clean ground becomes dirtier. For the existing cleaning robots, mopping modules of the cleaning robot cannot be automatically replaced in time, but are usually replaced manually, and the users need to continuously pay attention to the cleaning work process, causing a low degree of robot intelligence. Moreover, if the users do not replace the mopping modules in time, the cleaned ground is further contaminated. This problem is particularly evident to a user with a relatively large indoor area.

Therefore, it is necessary to design a new technical solution to resolve the foregoing technical problem.

SUMMARY

A technical problem resolved by the present disclosure is to provide a robot cleaning system capable of automatically replacing a mopping module.

To resolve the foregoing problem, a technical solution of the present disclosure is: a robot cleaning system, including: a cleaning robot capable of being detachably connected to a mopping module of the cleaning robot, and a base station provided for the cleaning robot to dock, where the cleaning robot includes: a main body; a mobile module, disposed on the main body, configured to drive the cleaning robot to move on a working surface; and a connection assembly, configured to detachably dispose the mopping module on the body of the robot; the base station includes: a storage module, configured to store at least one mopping module; an operating position, formed in the base station, and there being a partition space between the operating position and the storage module, for the cleaning robot to dock to replace the mopping module; and a transfer module, configured to transfer the mopping module between the storage module and the operating position; and the robot cleaning system further includes a control unit, where the control unit is configured to control the connection assembly to mount and/or unload a corresponding mopping module at the operating position, for the robot to replace the mopping module.

In an embodiment, the storage module is located above the operating position.

In an embodiment, the storage module includes a first storage unit and a second storage unit, where the first storage unit is configured to store a mopping module separated from the cleaning robot, and the second storage unit is configured to store a mopping module provided to the cleaning robot for mounting.

In an embodiment, the operating position includes a first operating position at which the robot is separated from a mopping module, and a second operating position at which the robot mounts a mopping module.

In an embodiment, the first storage unit is located above the first operating position, and the second storage unit is located above the second operating position.

In an embodiment, the base station includes a base plate, the operating position is formed on the base plate, and the base plate has a thickness less than 20 mm.

In an embodiment, the transfer module causes the mopping module to at least partially move in a vertical direction.

In an embodiment, the transfer module includes a driving member and a loading member; and the loading member is connected to the mopping module and drives the mopping module to move under the action of the driving member.

In an embodiment, the loading member includes a supporting assembly, configured to support the mopping module in storage module to prevent the mopping module from falling.

In an embodiment, the loading member includes a mopping module collection unit and a mopping module providing unit, where the mopping module collection unit is configured to move the mopping module at the first operating position separated from the cleaning robot to the first storage unit; and the mopping module providing unit is configured to obtain the mopping module from the second storage unit and move the mopping module to the second operating position, for the cleaning robot to mount.

In an embodiment, the supporting assembly includes a first supporting assembly configured to support the mopping module in the first storage unit and a second supporting assembly configured to support the mopping module in the second storage unit.

In an embodiment, the mopping module collection unit includes a lifting mechanism configured to move in the vertical direction, the lifting mechanism includes a pickup assembly, and the lifting mechanism picks up the mopping module at the first operating position through the pickup assembly and moves the mopping module to the first storage unit.

In an embodiment, the mopping module collection unit includes a pivoting structure configured to at least partially rotate in a vertical plane, and the pivoting structure is capable of causing the mopping module to at least partially rotate in the vertical plane to move the mopping module at the first operating position to the first storage unit.

In an embodiment, the transfer module causes a movement direction of the mopping module to be approximately perpendicular to a pull-in direction of the robot.

In an embodiment, the mopping module collection unit transfers the mopping module to the first storage unit by lifting the mopping module.

In an embodiment, the lifting mechanism includes a telescopic two-stage motion structure.

In an embodiment, the pickup assembly includes an adsorption module, configured to adsorb the mopping module.

In an embodiment, the adsorption module includes a magnetic element.

In an embodiment, the mopping module collection unit includes a first mopping module lifting frame, and the first mopping module lifting frame is capable of being driven by the driving member to ascend, to bear and drive the mopping module to move from the first operating position to the first storage unit.

In an embodiment, when the first mopping module lifting frame ascends, the mopping module borne by the first mopping module lifting frame is capable of passing through the first supporting assembly; and when the first mopping module lifting frame descends, the first supporting assembly is capable of supporting the mopping module to cause the mopping module to not descend as the first mopping module lifting frame descends.

In an embodiment, the first supporting assembly includes a rotatable limit member; and a reset member configured to drive the limit member to be reset, where the limit member has at least two states, the mopping module passes through the first supporting assembly when the limit member is in a first state, and the mopping module is supported when the limit member is in a second state.

In an embodiment, the limit member is configured to rotate in a vertical plane.

In an embodiment, the reset member is a torsion spring or a spring.

In an embodiment, the mopping module providing unit includes a second mopping module lifting frame, and the second mopping module lifting frame is capable of being driven by the driving member to descend, to bear and drive the mopping module to move from the second storage unit to the second operating position.

In an embodiment, when descending, the second mopping module lifting frame is capable of driving at least one mopping module in the second storage unit to descend, and the second supporting assembly is capable of supporting the mopping module in the second storage unit and causing the at least one mopping module in the second storage unit to descend onto the second mopping module lifting frame.

In an embodiment, the second supporting assembly includes a clamping member and a pressure biasing member, the clamping member is at a first position when subject to a pressure of the pressure biasing member and at a second position when overcoming the pressure of the pressure biasing member, and when the clamping member is at the first position, the descending second mopping module lifting frame is capable of causing the at least one mopping module in the second storage unit to descend onto the second mopping module lifting frame; and when the clamping member is at the second position, the clamping member is capable of supporting the mopping module in the second storage unit.

In an embodiment, the clamping member is configured to rotate in a horizontal direction.

In an embodiment, the second supporting assembly further includes: a guiding member disposed on the second mopping module lifting frame, where the guiding member has a guiding surface, and when the second mopping module lifting frame moves in the vertical direction, the guiding surface butts the pressure biasing member to cause the clamping member to rotate, to support/release the mopping module in the second storage unit.

In an embodiment, the first mopping module lifting frame and the second mopping module lifting frame synchronously move in the vertical direction.

In an embodiment, when the first mopping module lifting frame and the second mopping module lifting frame move in the vertical direction, there is no relative movement between the first mopping module lifting frame and the second mopping module lifting frame.

In an embodiment, the first mopping module lifting frame and the second mopping module lifting frame synchronously move.

In an embodiment, the transfer module includes at least one guiding rod body, and the first mopping module lifting frame and the second mopping module lifting frame are disposed on the rod body and are slidable along the guiding rod body to ascend or descend.

In an embodiment, the first mopping module lifting frame is provided with a first opening, the second mopping module lifting frame is provided with a second opening, and the driving member includes: a rotatable member, where one end of the rotatable member is inserted into the first opening and is slidable in the first opening, and the other end of the rotatable member is inserted into the second opening and is slidable in the second opening; and a motor, where the motor is configured to drive the rotatable member to cause the rotatable member to rotate around a point between the two ends.

In an embodiment, the driving member includes: a rotational belt extensible along the vertical direction; and a motor configured to drive the rotational belt, where the first mopping module lifting frame and the second mopping module lifting frame are connected to the rotational belt, to enable the rotational belt to drive the first mopping module lifting frame and the second mopping module lifting frame to ascend or descend.

In an embodiment, the rotational belt extensible along the vertical direction is disposed between the first mopping module lifting frame and the second mopping module lifting frame, and the motor is disposed at one end, of the rotational belt extensible along the vertical direction, opposite to a remote end of a base plate of the base station.

In an embodiment, the driving member further includes: a rotational belt extensible along a horizontal direction connected to the rotational belt extensible along the vertical direction, where the motor is disposed at one end, of the rotational belt extensible along the horizontal direction, far away from a remote end of the storage module.

In an embodiment, the mopping module providing unit is operable to be in a first state of fixing the mopping module and a second state of releasing the mopping module, and transfers the at least one mopping module in the second storage unit to the second operating position when the mopping module is released.

In an embodiment, the mopping module providing unit includes a slider, and a transmission mechanism configured to drive the slider to move between a first position of fixing the mopping module and a second position of releasing the mopping module.

In an embodiment, the slider includes a protrusion structure, and the protrusion fixes the mopping module when the slider is at the first position.

In an embodiment, the mopping module providing unit includes at least two sliders.

In an embodiment, the second supporting assembly includes: a first supporting mechanism and a second supporting mechanism, where the first supporting mechanism and the second supporting mechanism are disposed up and down and are configured to alternately support the mopping module in the second storage unit, to cause the at least one mopping module in the second storage unit to move to the second operating position.

In an embodiment, the second supporting mechanism includes a plurality of buffering portions, and the plurality of buffering portions form a stepped buffering structure.

In an embodiment, the second supporting assembly further includes: a guiding member mounted on the second mopping module lifting frame, where the guiding member has a guiding surface, and when the second mopping module lifting frame descends, the guiding surface butts one end of the clamping member to rotate the clamping member, to cause the clamping member to be detached from the second mopping module.

In an embodiment, after the second mopping module lifting frame descends, and one end of the clamping member is detached from the guiding surface, the clamping member rotates under driving of the pressure biasing member, to cause the other end of the clamping member to approach the mopping module in the second storage unit, and then be capable of propping the mopping module in the second storage unit.

In an embodiment, the pressure biasing member is a torsion spring or spring mounted on the clamping member; and the base station for a cleaning robot further includes: a fixing framework, where the clamping member and the pressure biasing member are mounted on the fixing framework.

In an embodiment, there is a preset angle between the guiding surface and the vertical direction, and the preset angle is greater than 0 degrees and less than 90 degrees.

In an embodiment, there are a plurality of clamping members and a plurality of pressure biasing members, and the plurality of clamping members are capable of propping different positions at edges of the mopping module.

A cleaning robot system is provided, including: the foregoing base station for a cleaning robot; and a cleaning robot, where a cleaning element is capable of being mounted on the cleaning robot, the cleaning robot is capable of separating and/or mounting the cleaning element from and/or on the base station for a cleaning robot, and the cleaning element is a mopping module.

In an embodiment, the operating position is provided with a stop structure, configured to stop the mopping module separated from the cleaning robot and/or the mopping module provided for the cleaning robot to mount.

In an embodiment, the stop structure includes a groove for storing the mopping module and/or a stop board.

In an embodiment, the first operating position is provided with a first stop structure and/or the second operating position is provided with a second stop structure, the first stop structure is configured to stop the mopping module separated from the cleaning robot and/or the second stop structure is configured to stop the mopping module provided for the robot to mount.

In an embodiment, the first stop structure includes a first groove, configured to store the mopping module separated from the cleaning robot and/or the second stop structure includes a second groove, configured to store the mopping module provided for the robot to mount.

In an embodiment, an edge of a side wall of the first groove and/or the second groove is provided with a stop board structure, configured to stop the mopping module separated from the cleaning robot and/or stop the mopping module provided for the robot to mount from being separated from the first groove and/or the second groove.

In an embodiment, after detecting a replacement instruction instructing the cleaning robot to return to the base station to replace the mopping module, the cleaning robot returns to the base station.

In an embodiment, the cleaning robot includes a mopping module contamination degree recognition sensor, the replacement instruction is generated when the robot detects that a contamination degree of the currently mounted mopping module reaches a threshold, and/or the replacement instruction is generated when the cleaning robot detects that at least one of a working area, a working time, and a working schedule meets a preset condition.

In an embodiment, respective communication modules are disposed on the base station and the cleaning robot, and when the cleaning robot needs to return to the base station to replace the mopping module, the cleaning robot communicates with the base station through the communication modules to cause, before the cleaning robot enters the base station, the mopping module providing unit to move at least one mopping module to the second operating position.

In an embodiment, the cleaning robot includes a position detection sensor, and when it is detected that the cleaning robot reaches the first operating position, the cleaning robot is controlled to be separated from the mopping module; and when it is detected that the cleaning robot reaches the second operating position, the cleaning robot is controlled to mount the mopping module.

In an embodiment, the storage module is detachably disposed relative to the base station.

In an embodiment, the base station includes a charging module, and the charging module performs charging when the cleaning robot docks to the base station.

In an embodiment, the cleaning robot is a domestic and/or indoor service robot.

A control method for a robot cleaning system, where the robot cleaning system includes: a cleaning robot capable of being detachably connected to a mopping module of the cleaning robot, and a base station provided for the cleaning robot to dock, where the cleaning robot includes: a main body; a mobile module, disposed on the main body, configured to drive the cleaning robot to move on a working surface; and a connection assembly, configured to detachably dispose the mopping module on the body of the robot; the base station includes: a storage module, configured to store at least one mopping module; an operating position, formed in the base station, and there being a partition space between the operating position and the storage module, for the cleaning robot to dock to replace the mopping module, where the operating position includes a first operating position at which the robot is separated from a mopping module, and a second operating position at which the robot mounts a mopping module; and a transfer module, configured to transfer the mopping module between the storage module and the operating position; and the robot cleaning system further includes: a control unit, where the control unit is configured to control the connection assembly to mount and/or unload a corresponding mopping module at the operating position, for the robot to replace the mopping module, where the method includes: controlling, by the control unit when the cleaning robot reaches the first operating position, the connection assembly to separate the mopping module from the body of the cleaning robot, and controlling, by the control unit when the cleaning robot reaches the second operating position, the connection assembly to mount the mopping module.

In an embodiment, before the cleaning robot reaches the second operating position, the method includes: providing, by the transfer module, the mopping module stored in the storage module to the cleaning robot for mounting.

In an embodiment, after being separated from the mopping module, the cleaning robot continues to travel, and reaches the second operating position, the control unit controls the connection assembly to mount the mopping module, and the cleaning robot leaves the base station after the mounting ends; or after being separated from the mopping module, the cleaning robot leaves the base station, and then travels to the second operating position, and the control unit controls the connection assembly to mount the mopping module.

In an embodiment, after the cleaning robot leaves the base station, the method further includes: recycling, by the transfer module, the mopping module separated from the cleaning robot and placing the mopping module into the storage module.

A base station for a cleaning robot, provided for the cleaning robot to dock, where the cleaning robot is capable of being detachably connected to a mopping module of the cleaning robot, where the base station includes: a storage module, configured to store at least one mopping module; an operating position, formed in the base station, and there being a partition space between the operating position and the storage module, for the cleaning robot to dock to replace the mopping module; and a transfer module, configured to transfer the mopping module between the storage module and the operating position.

In an embodiment, the storage module is located above the operating position.

In an embodiment, the storage module includes a first storage unit and a second storage unit, where the first storage unit is configured to store a mopping module separated from the cleaning robot, and the second storage unit is configured to store a mopping module provided to the cleaning robot for mounting.

In an embodiment, the operating position includes a first operating position at which the robot is separated from a mopping module, and a second operating position at which the robot mounts a mopping module.

In an embodiment, the first storage unit is located above the first operating position, and the second storage unit is located above the second operating position.

In an embodiment, the first storage unit and the second storage unit are abreast disposed in a direction parallel to the working surface.

In an embodiment, the bottom of the first storage unit and the bottom of the second storage unit are approximately disposed in the same plane.

In an embodiment, the second storage unit is disposed in front of the first storage unit relative to the pull-in direction of the cleaning robot.

In an embodiment, the second operating position is located in front of the first operating position relative to the pull-in direction of the cleaning robot.

In an embodiment, the base station includes a base plate, the operating position is formed on the base plate, and the base plate has a thickness less than 20 mm.

In an embodiment, the transfer module includes a driving member and a loading member; and the loading member is connected to the mopping module and causes the mopping module to move under the action of the driving member.

In an embodiment, the loading member includes a supporting assembly, configured to support the mopping module in storage module to prevent the mopping module from falling.

In an embodiment, the loading member includes a mopping module collection unit and a mopping module providing unit, where the mopping module collection unit is configured to move the mopping module at the first operating position separated from the cleaning robot to the first storage unit; and the mopping module providing unit is configured to obtain the mopping module from the second storage unit and move the mopping module to the second operating position, for the cleaning robot to mount.

In an embodiment, the base station further includes a charging module, configured to provide energy to the robot when the robot docks to the base station.

In an embodiment, when the cleaning robot reaches the operating position in the base station, a height between the top of the cleaning robot and the bottom of the storage module in the vertical direction is less than or equal to 50 mm.

In an embodiment, each of two sides of the base station along the pull-in direction of the robot is provided with an auxiliary guiding structure, configured to guide the robot to reach the operating position.

In an embodiment, the auxiliary guiding structure is an auxiliary guiding wheel.

In an embodiment, a height of the auxiliary guiding structure is equal to ⅓ to ½ of a height of the cleaning robot.

In an embodiment, the base station includes a base plate for receiving the robot, and the base station includes a supporting portion for connecting the base plate of the base station and the storage module.

In an embodiment, the supporting portion is located on a side the base station, to cause a projection of the body of the cleaning robot during docking and a projection of the storage module in a horizontal plane to approximately coincide.

The foregoing technical solutions of the present disclosure have the following notable beneficial effects:

When the mopping module is used by the cleaning robot to a specific extent or for a specific time and needs to be replaced, the robot travels to the base station for the cleaning robot. In this case, the first mopping module lifting frame is located below, the robot travels to the base station, the robot reaches the operating position, the mopping module of the robot is aligned with the first mopping module lifting frame, then the mopping module on the robot is detached, and the detached mopping module descends onto the first mopping module lifting frame. The driving member drives the first mopping module lifting frame to ascend, the first mopping module lifting frame holds up the mopping module in ascending, and then reaches the first supporting assembly, and the first supporting assembly supports the mopping module, to cause the mopping module to not descend with the first mopping module lifting frame. Then, the first mopping module lifting frame is capable of descending under driving of the driving member, to prepare for next arrival of the robot. A plurality of second mopping modules to be replaced are stacked in advance on the second supporting assembly, and when the second mopping module lifting frame descends, at least one mopping module is caused to descend from the second supporting assembly onto the second mopping module lifting frame. When the second mopping module lifting frame continues to descend, the second mopping module lifting frame and the at least one mopping module descending onto the second mopping module lifting frame descend to the bottom. In this case, the robot may travel to the top of the second mopping module lifting frame to automatically mount the mopping module on the second mopping module lifting frame onto the bottom of the robot. Through the foregoing process, the mopping module used by the cleaning robot is automatically replaced. After a new replacement mopping module is used and dirty, the foregoing steps may be performed, and a plurality of mopping modules may be supported on the first supporting assembly.

In an embodiment, the second supporting assembly includes: a first supporting mechanism, where the first supporting mechanism has a supporting state of supporting the mopping module and a retraction state of not supporting the mopping module; and a second supporting mechanism, where the second supporting mechanism has a holding-up state of supporting the mopping module in the second storage unit and an open state of releasing at least one mopping module to the operating position, where when the second supporting mechanism is in the holding-up state, the first supporting mechanism is in the retraction state; and when the second supporting mechanism is in the open state, the first supporting mechanism is in the supporting state to support the mopping module in the second storage unit.

In an embodiment, the second supporting mechanism and the first supporting mechanism are linked.

In an embodiment, the first supporting mechanism is capable of rotating around a first rotational axis; the first supporting mechanism switches between the supporting state and the retraction state through rotation; the second supporting mechanism is capable of rotating around a second rotational axis; the second supporting mechanism switches between the holding-up state and the open state through rotation; and the first rotational axis and the second rotational axis are parallel to each other.

In an embodiment, when rotating around the second rotational axis, the second supporting mechanism drives the first supporting mechanism to rotate around the first rotational axis.

In an embodiment, at least two second supporting assemblies are respectively mounted on two sides of the storage module along a first direction; and the first direction is perpendicular to the vertical direction.

In an embodiment, second supporting assemblies located on two sides of the storage module are staggered with each other.

In an embodiment, there are at least three second supporting assemblies.

In an embodiment, the second supporting mechanism includes a supporting board; one end of the supporting board is a connection end connected to a pivoting shaft, and the other end is a free end; the pivoting shaft drives the supporting board to rotate around the first rotational axis; the first supporting mechanism includes a rotatable stop board configured to rotate around the second rotational axis; a supporting rod is disposed on the rotatable stop board; and the supporting rod is, when being in the retraction state, located outside the storage module, and stretches, when being in the supporting state, into the storage module.

In an embodiment, in the retraction state, an outer end of the supporting rod is located above a lowest mopping module in the storage module.

In an embodiment, there is a gap between edges of two neighboring stacked mopping modules; and in the holding-up state, an outer end of the supporting rod and the gap are disposed opposite to each other along the first direction.

In an embodiment, a dial rod is further disposed on the rotatable stop board; the rotatable stop board is located on a side of the supporting board along an axial direction of the first rotational axis; a side surface of the supporting board at the connection end is provided with a first limit protrusion and a second limit protrusion; and the dial rod is located between the first limit protrusion and the second limit protrusion, and is limited by the first limit protrusion and the second limit protrusion during rotation.

In an embodiment, the supporting board is further provided with a buffering portion; the buffering portion includes a buffering inclined surface; and a protrusion height of the buffering inclined surface along a direction from the connection end to the free end is gradually increased.

In an embodiment, the buffering portion further has a sliding inclined surface; the sliding inclined surface is closer to the connection end than the buffering inclined surface; and a protrusion height of the buffering inclined surface along a direction from the connection end to the free end is gradually decreased.

In an embodiment, the supporting board has a plurality of buffering portions; and the plurality of buffering portions are arranged along a direction from the connection end to the free end to form a stepped buffering structure.

In an embodiment, the supporting board is further provided with a carrying curved surface on a side of the stepped buffering structure far away from the free end; and when the supporting board rotates from the holding-up state toward the open state by at most 30 degrees, the carrying curved surface continuously bears the mopping module.

In an embodiment, a length of the supporting board in the holding-up state located in the storage module is greater than ½ of a width of the storage module along the first direction.

In an embodiment, a length of the supporting rod in the supporting state located in the storage module is less than a length of the supporting board in the holding-up state located in the storage module.

In an embodiment, when the supporting rod extends toward an outer end of the supporting rod, a width of the supporting rod is gradually decreased; and a width direction of the supporting rod is approximately parallel to a circumferential direction around the second rotational axis.

In an embodiment, a driving motor, a first driving shaft, and a second driving shaft are further disposed on the housing; the first driving shaft and the second driving shaft are distributed on two sides of the storage module along the first direction; the first driving shaft and the second driving shaft are disposed parallel to the first rotational axis, and respectively drive pivoting shafts located on two sides of the storage module to rotate; and the driving motor is configured to drive the first driving shaft and the second driving shaft to rotate.

In an embodiment, the driving motor and the first driving shaft are located on a side of the storage module along the first direction, and the second driving shaft is located on another side of the storage module along the first direction; a side of the storage module along a second direction is provided with a chain; and the driving motor drives the second driving shaft through the chain.

In an embodiment, the operating position has a groove for holding a mopping module; and a minimum distance between the second supporting mechanism and the groove bottom of the groove is greater than a thickness of a single mopping module.

The loading member provided in this solution is provided with the mopping module providing unit, the mopping module collection unit, and the supporting assembly, where the supporting assembly includes the first supporting assembly and the second supporting assembly, the first supporting assembly is configured to support the mopping module in the first storage unit, and the second supporting assembly is configured to support the mopping module in the second storage unit. Specifically, the second supporting assembly is provided with the first supporting mechanism and the second supporting mechanism matching each other, so that when the cleaning robot needs to replace a mopping module, the second supporting mechanism is switched to the open state, at least one mopping module is delivered, and the cleaning robot enters the base station to replace the mopping module. Correspondingly, remaining mopping modules in the storage module are supported by the first supporting mechanism to avoid falling, until the second supporting mechanism is reset to the holding-up state to support the mopping module again until the cleaning robot performs replacement again with a new mopping module. Therefore, when being applied to a scenario of replacing a mopping cloth, a mopping module delivery apparatus provided in this embodiment is capable of automatically delivering a mopping cloth, thereby automatically replacing the mopping cloth, reducing intervention by a user in mopping cloth replacement, and improving user experience. In an embodiment, the second supporting assembly includes a first supporting mechanism and a second supporting mechanism. Specifically, the first supporting mechanism includes a first blocking sheet telescoping mechanism, the second supporting mechanism includes a second blocking sheet telescoping mechanism, the first blocking sheet telescoping mechanism and the second blocking sheet telescoping mechanism located below the first blocking sheet telescoping mechanism, the transfer module further includes a driving member, the driving member drives the first blocking sheet telescoping mechanism to switch between an extension position and a retraction position to fix mopping modules and release the mopping modules, and the driving member drives the second blocking sheet telescoping mechanism to switch between an extension position and a retraction position to fix the mopping modules released from the first blocking sheet telescoping mechanism and release at least one of the mopping modules, to finally gradually release the mopping modules.

In an embodiment, when the driving member drives the first blocking sheet telescoping mechanism to move from the extension position to the retraction position, and the second blocking sheet telescoping mechanism to move from the retraction position to the extension position, first-stage release of a mopping module is implemented; and when the driving member drives the second blocking sheet telescoping mechanism to move from the extension position to the retraction position, and the first blocking sheet telescoping mechanism to move from the retraction position to the extension position, second-stage release of at least one mopping module is implemented.

In an embodiment, when the first blocking sheet telescoping mechanism moves from the retraction position to the extension position, the first blocking sheet telescoping mechanism is enabled to stop a mopping module above the at least one mopping module on which second-stage release is performed.

In an embodiment, the driving member synchronously drives the first blocking sheet telescoping mechanism and the second blocking sheet telescoping mechanism.

In an embodiment, a relationship between a spacing d between the first blocking sheet telescoping mechanism and the second blocking sheet telescoping mechanism in the vertical direction and a thickness n of each mopping module meets $n<d<2n$.

In an embodiment, each of the first blocking sheet telescoping mechanism and the second blocking sheet telescoping mechanism includes a plurality of telescopic blocking sheets disposed on at least two side walls of the second storage unit.

In an embodiment, the at least two side walls include two opposite side walls.

In an embodiment, the at least two side walls include a front wall and a rear wall of the cleaning robot.

In an embodiment, the transmission mechanism includes a gear and rack structure.

In an embodiment, when the cleaning robot replaces a mopping module, the control unit controls the robot to enter the base station, and controls the connection assembly to separate the mopping module, and the mopping module collection unit collects the mopping module separated from the body of the robot into the first storage unit.

In an embodiment, when the cleaning robot replaces a mopping module, the mopping module providing unit transfers the mopping module of the second storage unit to the robot for mounting, and the control unit controls the connection assembly to mount the mopping module.

In an embodiment, the first storage unit includes a storage state detection module, and when it is detected that a state of the mopping module in the first storage unit meets a preset condition, an instruction of cleaning the mopping module is sent to a user.

In an embodiment, the preset condition includes that the first storage unit has been fully loaded with mopping modules.

In an embodiment, the preset condition includes that mopping modules have been stored in the first storage unit within for a specific time.

In an embodiment, the second storage unit includes a storage state detection module, and when it is detected that a quantity of mopping modules in the second storage unit is less than or equal to a preset value, an instruction of adding a mopping module is sent to a user.

In an embodiment, the cleaning robot includes a mopping module mounting sensor, and when it is detected that no mopping module is mounted on the robot, a fault instruction is sent to a user.

In an embodiment, the base station includes a fault detection sensor, and when it is detected that the transfer module has a fault, a fault instruction is sent to a user.

In an embodiment, the cleaning robot includes a position detection sensor, and when it is detected that a position between the robot and the base station meets a first condition, the connection assembly is controlled to separate a mopping module; and when it is detected that a position between the robot and the base station meets a second condition, the connection assembly is controlled to mount a mopping module.

In an embodiment, the position detection sensor includes a ranging sensor, the first condition is that a distance between the robot and the base station reaches a first preset value, and the second condition is that a distance between the robot and the base station reaches a second preset value.

In an embodiment, the position detection sensor includes at least one of an infrared sensor, a laser sensor, and an ultrasonic sensor.

In an embodiment, the position detection sensor includes a magnetic detection sensor, the first condition is that a first magnet disposed on the base station is detected, and the second condition is that a second magnet disposed on the base station is detected.

In an embodiment, the connection assembly includes an elastic element, configured to cause a mopping module to be in interference contact with the working surface during working.

In an embodiment, the elastic element includes at least one of a spring, a leaf spring, and a compression spring.

In an embodiment, the cleaning robot includes a vibration motor, connected to the connection assembly, and configured to cause the mopping module to be in vibration contact with the working surface, and the connection assembly includes a buffering element, configured to reduce vibration transferred by the vibration motor to the body of the cleaning robot through the connection assembly.

In an embodiment, the buffering element includes a rubber column.

In an embodiment, the cleaning robot is a domestic and/or indoor service robot.

Compared with the prior art, the beneficial effects of the present disclosure are as follows: In the robot cleaning system provided in the present disclosure, the cleaning robot is capable of automatically detecting a mopping module replacement condition, and automatically replacing a mopping module for the cleaning robot through the transfer module and the storage module disposed on the base station, thereby improving automation experience of the user, and the replacement method is simple and quick. The base station structure design provided in the present disclosure implements multi-function reuse of the base station, the structure is compact, and the occupied area is reduced.

In an embodiment, a base station is provided, including a functional module, located above the base station and configured to perform a preset function; an accommodation cavity, enclosed by the functional module and the base station and configured to accommodate the cleaning robot, where the functional module is located above the accommodation cavity; a signal transmitter, configured to at least send a leaving instruction signal of leaving the accommodation cavity to the cleaning robot; and an operating portion, electrically connected to the signal transmitter to at least control the signal transmitter to send the leaving instruction signal.

In an embodiment, the signal transmitter may be further configured to send an entering instruction signal of entering the accommodation cavity, and the operating portion is electrically connected to the signal transmitter to at least control the signal transmitter to send the entering instruction signal.

In an embodiment, the signal transmitter is disposed in the accommodation cavity.

In an embodiment, the accommodation cavity has an opening in communication with the outside to be provided for the cleaning robot to leave and/or enter, the base station includes a supporting portion facing the opening, and the signal transmitter is disposed on the supporting portion.

In an embodiment, the operating portion is exposed from an outer surface of the base station.

In an embodiment, the operating portion is disposed on an upper surface of the base station.

In an embodiment, the functional module includes a storage module configured to accommodate a storage substance.

In an embodiment, the storage module is located above the accommodation cavity, the functional module includes a communicating mouth that may be opened and closed, the storage module is in communication with the accommodation cavity up and down in a state of opening the communicating mouth, and the storage module is not in communication with the accommodation cavity up and down in a state of closing the communicating mouth.

In an embodiment, the storage module is configured to store mopping modules of the cleaning robot, the storage module includes a first storage unit configured to store a dirty mopping module and a second storage unit configured to store a clean mopping module, and the communicating mouth includes a first communicating mouth and a second communicating mouth that are respectively located below the first storage unit and the second storage unit and that may be opened and closed.

In an embodiment, the first storage unit and the second storage unit are located abreast above the accommodation cavity in the horizontal direction.

In an embodiment, the base station includes a base plate and a supporting portion configured to connect the base plate and the functional module, and the base plate includes an accommodation groove configured to accommodate the storage substance.

In an embodiment, the base station further includes a charging module configured to charge the cleaning robot, and the charging module includes a charging terminal configured to dock to and charge the cleaning robot.

The present disclosure may further adopt the following technical solution:

a cleaning robot system, including the foregoing base station and a cleaning robot corresponding to the base station, where the cleaning robot includes a signal receiver configured to receive an instruction signal transmitted by the signal transmitter.

In an embodiment, the signal receiver is located in front of a movement direction of the cleaning robot.

In an embodiment, the cleaning robot includes a mopping module configured to clean a ground.

Compared with the prior art, the beneficial effects of the solution provided in the present disclosure are as follows: A key that may at least control the cleaning robot to quit is disposed on the base station, to avoid a case that the cleaning robot is stuck in the accommodation cavity of the base station and the user cannot operate the cleaning robot to quit.

In an embodiment, a base station for a cleaning robot is provided, including: a charging module, disposed on the base station and configured to charge the cleaning robot; a storage module, where the storage module is configured to store a mopping module of the cleaning robot; a storage state detection module, configured to detect whether a storage state in the storage module is a preset state; a reminding module, configured to send reminding information indicating that a storage state in the storage module is the preset state; and a control unit, configured to control, according to a detection result of the storage state detection module, the reminding module to send the reminding information to the outside.

In an embodiment, the base station further includes a transfer module configured to drive the mopping module to move, and the control unit is further configured to control the transfer module to autonomously drive the mopping module to move to automatically replace the mopping module.

In an embodiment, the storage state detection module includes a detection element, and a movable member at least partially movably disposed in the storage module to trigger the detection element.

In an embodiment, the storage state detection module further includes an elastic member configured to provide a restoring force to the movable member.

In an embodiment, the movable member is disposed on an inner wall in the storage module, so that when being accommodated in the storage module, the mopping module may touch the movable member.

In an embodiment, the storage state detection module includes a photoelectric sensor, the photoelectric sensor includes a transmit end and a receive end, and a connecting line between the transmit end and the receive end passes through the storage module.

In an embodiment, the storage state detection module includes at least one of a Hall sensor, an infrared sensor, a reed switch, a photoelectric switch, and a micro-switch.

In an embodiment, the reminding module includes at least one of a light warning apparatus, a sound warning apparatus, and a wireless sending module that is configured to send the reminding information to the outside.

In an embodiment, the storage module is located above the base station, the base station includes a base plate and a supporting portion configured to connect the base plate and the storage module, the storage module, the supporting portion, and the base station enclose an accommodation cavity configured to accommodate the cleaning robot, the storage module is located above the accommodation cavity, the storage module includes a communicating mouth that may be opened and closed, the storage module is in communication with the accommodation cavity up and down in a state of opening the communicating mouth, and the storage module is not in communication with the accommodation cavity up and down in a state of closing the communicating mouth.

In an embodiment, the storage module includes a first storage unit and a second storage unit respectively configured to store a dirty mopping module and store a clean mopping module, and each of the first storage unit and the second storage unit includes a storage state detection module.

Compared with the prior art, the beneficial effects of the solution in the present disclosure are as follows: The storage module configured to store the mopping module and the storage state detection module configured to detect the mopping module are disposed on the base station, so that in a case of automatically replacing a mopping cloth, the base station may notify the user of a storage state in the storage module in time, to avoid a case that a mopping cloth cannot continue to be automatically replaced because supply of clean mopping modules is insufficient or dirty mopping modules are full.

BRIEF DESCRIPTION OF THE DRAWINGS

The foregoing objects, technical solutions, and beneficial effects of the present disclosure can be implemented with reference to the accompanying drawings below.

DETAILED DESCRIPTION

Detailed descriptions and technical content of the present disclosure are described below in cooperation with the accompanying drawings. However, the accompanying drawings only provide reference and description rather than limit the present disclosure.

Figure 1:
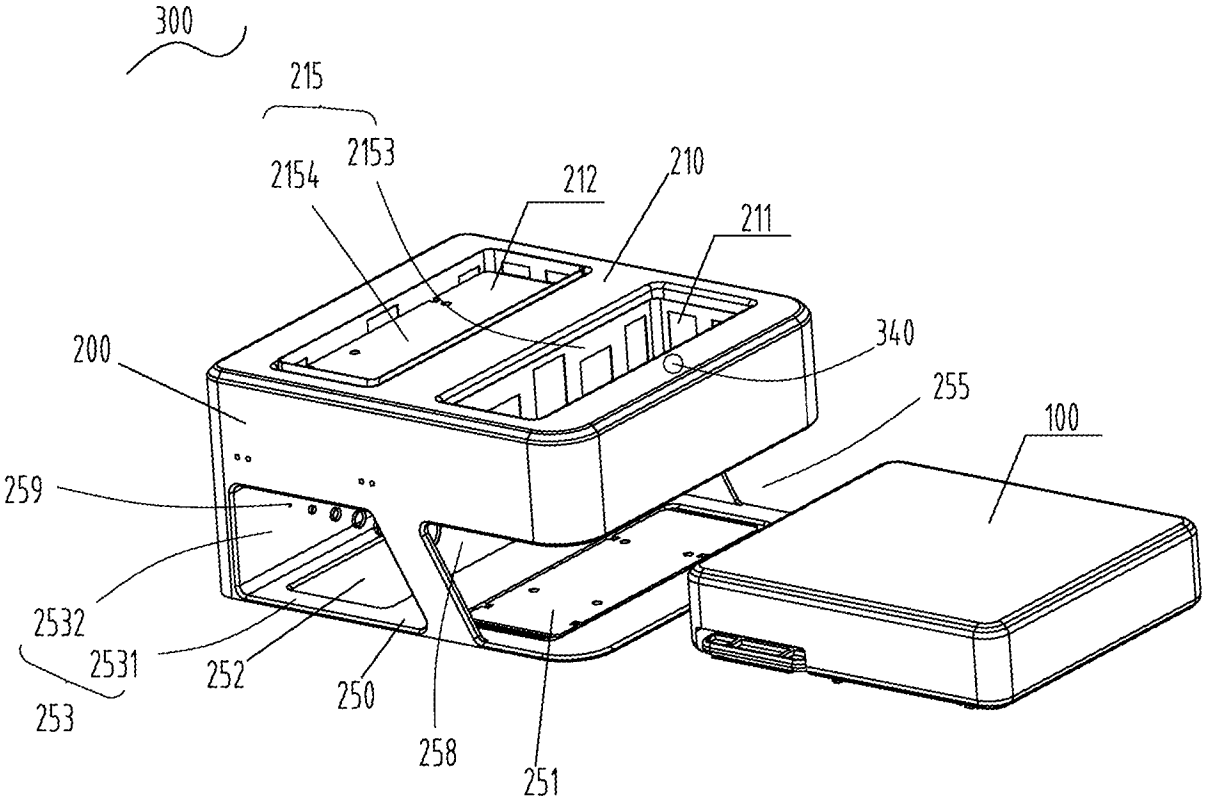
FIG. 1 is a three-dimensional diagram of a robot cleaning system according to an embodiment of the present disclosure.
Figure 4:
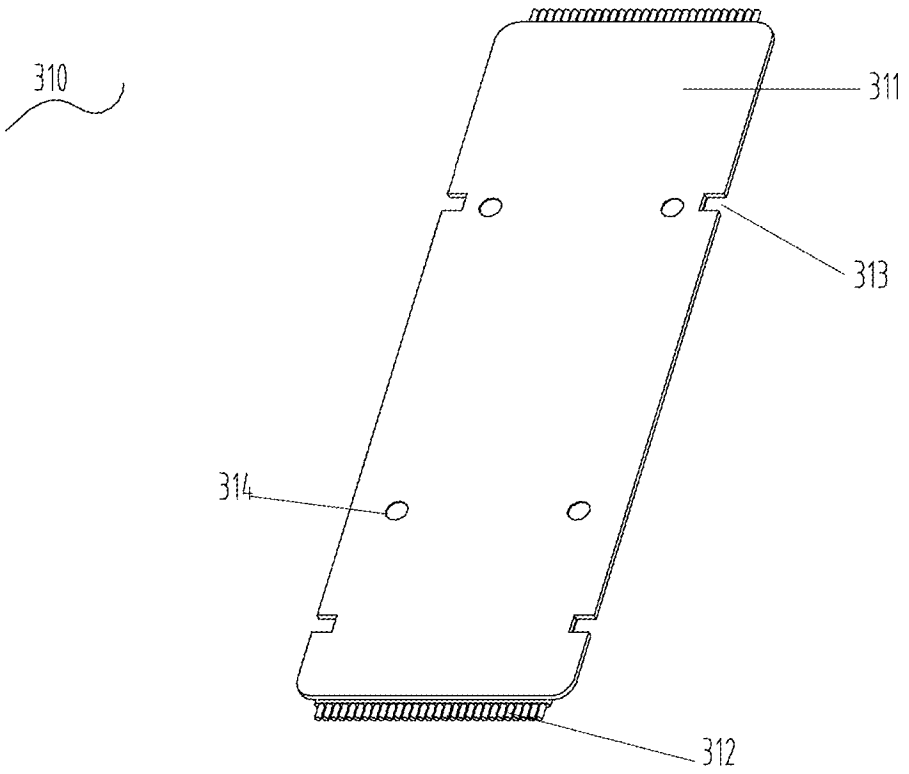
FIG. 4 is a schematic diagram of a mopping module according to an embodiment of the present disclosure.
Figure 26:
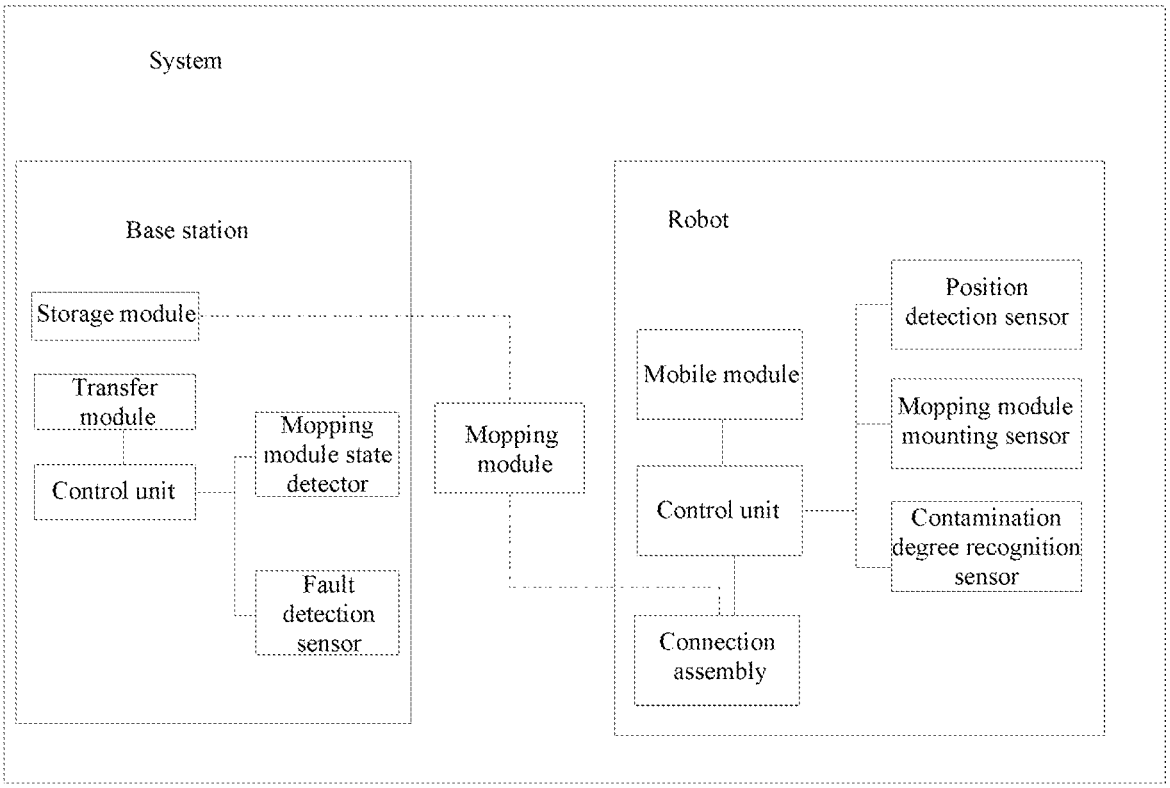
FIG. 26 is a schematic diagram of modules of a robot cleaning system according to the present disclosure.

FIG. 1 shows a robot cleaning system 300 according to an embodiment of the present disclosure. Referring to FIG. 26, FIG. 26 is a schematic diagram of module composition of the robot cleaning system according to this embodiment. The robot cleaning system 300 includes: a cleaning robot 100, where the cleaning robot 100 is detachably connected to a mopping module 310; and a base station 200 provided for the cleaning robot 100 to dock. The cleaning robot 100 includes: a main body; a mobile module, disposed on the main body, configured to drive the cleaning robot 100 to move on a working surface; and a connection assembly, configured to detachably dispose the mopping module on the body of the robot. The base station 200 includes: a storage module 210, configured to store at least one mopping module 310; an operating position, formed in the base station 200, and there being a partition space between the operating position and the storage module 210, for the cleaning robot to dock to replace the mopping module; and a transfer module, configured to transfer the mopping module 310 between the storage module 210 and the operating position; and the robot cleaning system 300 further includes a control unit, where the control unit is configured to control the connection assembly 120 to mount and/or unload a corresponding mopping module 310 at the operating position, for the cleaning robot 100 to replace the mopping module. Specifically, optionally, the control unit is located on at least one of the base station 200 and the cleaning robot 100. Moreover, the robot cleaning system 300 further includes the mopping module 310 suitably used in cooperation with the base station 200 and the cleaning robot 100. FIG. 4 is design of a mopping module 310 in this embodiment. The mopping module 310 includes a rear board 311, the rear board 311 is suitably connected to a mopping cloth 312, and the mopping module 310 is provided with a notch 313, where the mopping cloth 312 may be an ordinary mopping cloth, or may be replaced with a frequently used means such as a wet wipe, a sponge eraser, or a degradable mopping cloth, and the rear board 311 includes an adsorption element. Specifically, the adsorption element includes a magnetic element, capable of being connected to the cleaning robot 100 through a magnetic action and being taken in by the base station 200. Specifically, the mopping module 310 includes a groove, the mopping cloth 312 includes a disposable floor cleaning sheet or the like, the surface area of the mopping cloth 312 is greater than the surface area of the rear board 311, the rear board is provided with a groove, the rear board is wrapped in the mopping cloth 312, and the mopping cloth is fixed through the groove on the rear board, to form one complete mopping module 310. The mopping module 310 may be mounted on the cleaning robot 100 to work. After the mopping module 310 becomes dirty, the cleaning robot 100 is separated from the mopping module 310, and the mopping module 310 is taken in through the base station 200. A user may separate the mopping cloth 312 connected to the rear board 311, and replace the mopping cloth with a new mopping cloth 312, to obtain a clean mopping module 310 and provide the mopping module 310 to the base station 200, for the cleaning robot 100 to mount and use. In this embodiment, the mopping cloth 312 is connected to the rear board 311 and has an edge slightly exceeding the rear board 311, that is to say, the size of the mopping cloth 312 is greater than the size of the rear board 311. It is set that the size of the mopping cloth 312 is slightly greater than the size of the rear board 311, so that when the cleaning robot 100 needs to clean a corner region, for example, clean a wall crack, the mopping module 310 is capable of being in better contact with a to-be-cleaned surface, and in particular, has a relatively good cleaning effect on a vertical surface of on a side of a wall, thereby ensuring a relatively good cleaning effect on the corner region. In another embodiment, the mounting manner of the mopping module 310 may further include other common means in this field such as groove clamping and adhesion, and meanwhile the corresponding design of mounting the mopping module on the cleaning robot 100 and design of taking in the mopping module by the base station 200 also correspondingly change.

Figure 2:
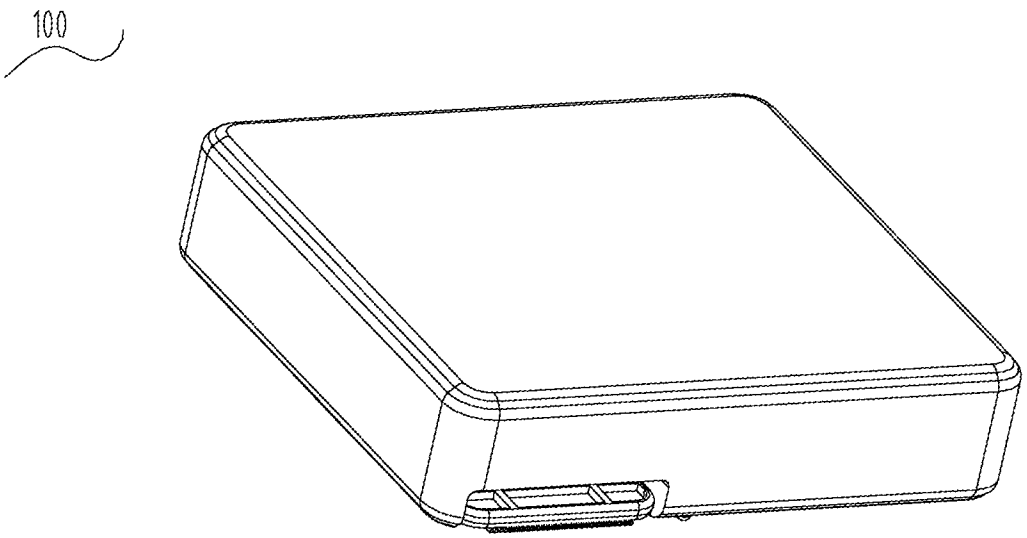
FIG. 2 is a three-dimensional diagram of a cleaning robot according to an embodiment of the present disclosure.
Figure 3:
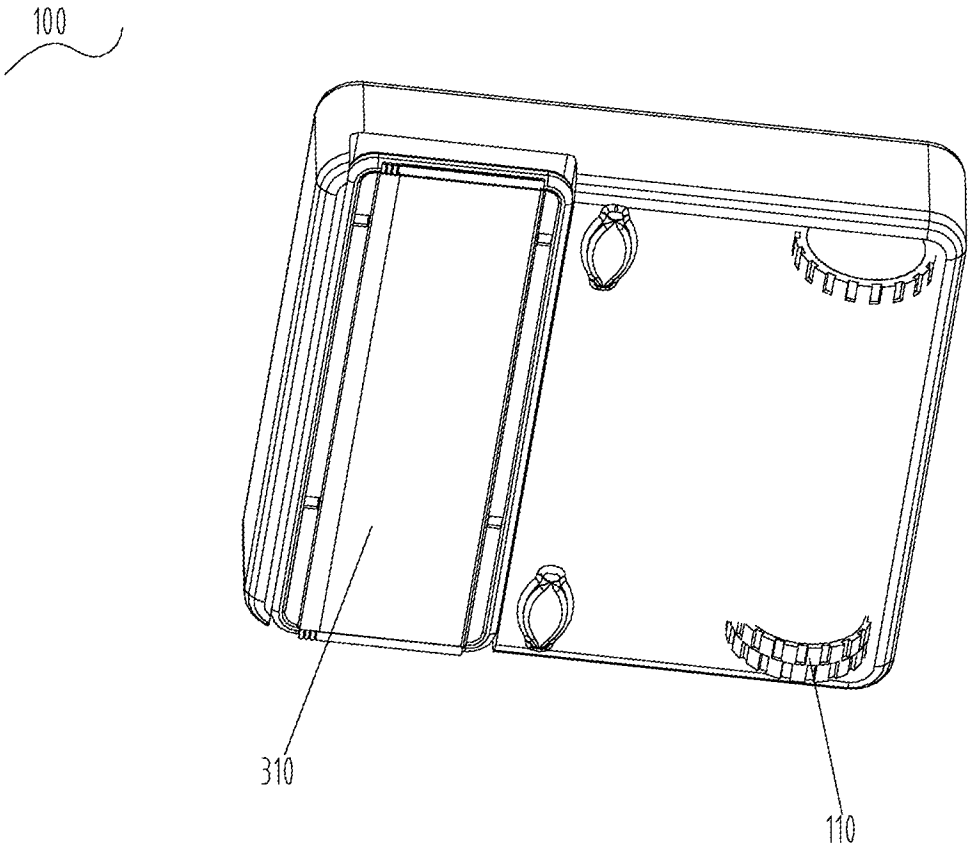
FIG. 3 is a bottom view of the cleaning robot in FIG. 2.

In this embodiment, referring to FIG. 2 and FIG. 3, the cleaning robot 100 includes a main body, and a mobile module configured to drive the main body to move on a working surface, where the mobile module includes a moving wheel 110. It may be understood that, the mobile module may alternatively include a track structure or move in another regular movement manner. The cleaning robot 100 further includes a cleaning mechanism, and the cleaning mechanism includes a plurality of forms. In this embodiment, the mopping module 310 serves as a cleaning mechanism, and the cleaning robot 100 performs mopping work on the working surface through the mopping module 310. In another embodiment, the cleaning mechanism of the cleaning robot 100 may further include a roller brush and a side brush, which are configured to clean sundries such as dust on a ground, a wall corner, and the like. For example, the sundries are relatively concentrated at the roller brush by using the side brush for processing, and the dust is collected into a dust-collecting box. The cleaning robot 100 further includes a power mechanism, an energy module, and a sensor system. The power mechanism includes a motor and a transmission mechanism connected to the motor, the transmission mechanism is connected to the mobile module, the motor drives the transmission mechanism to work, and a transmission effect of the transmission mechanism enables the mobile module to move. The transmission mechanism may be a worm gear and worm mechanism, a bevel gear mechanism, or the like. The energy module of the cleaning robot 100 is configured to provide energy to the cleaning robot 100, power provided to the power mechanism enables the cleaning robot 100 to move and work, and the energy module is usually set as a battery pack. When energy consumption of the battery pack reaches a threshold, the cleaning robot 100 automatically returns to a charging station to replenish energy, and continues to work after charging ends. The sensor system of the cleaning robot 100 includes a cliff sensor, configured to change a moving policy when detecting that a cliff exists; an edge sensor, configured to generate a policy of moving along an edge when detecting an edge of a working region; an inclination sensor, configured to change a working policy when detecting that the machine inclines and send an indication to the user; and various other common sensors. Details are not described herein again. Moreover, the cleaning robot 100 further includes a control unit, and may include an embedded digital signal processor (DSP), a microprocessor unit (MPU), an application-specific integrated circuit (ASIC), A programmable logic device (PLD), a system on chip (SOC), a central processing unit (CPU), a field programmable gate array (FPGA), or the like. The control unit may control, according to a preset condition or according to an instruction received by the cleaning robot 100, the cleaning robot 100 to work. Specifically, the control unit may control the mobile module to move according to a preset moving path in a working region of the cleaning robot 100. While the mobile module drives the cleaning robot 100 to move, the cleaning mechanism works, to clear stains, dust, and the like on the surface of the working region. The mobile module drives the cleaning robot 100 to move along a preset path. When the cleaning mechanism completes cleaning work, the control unit may control the cleaning mechanism to stop working, and control the mobile module to move, so that the mobile module drives the cleaning robot 100 to leave the working region. The moving path of the cleaning robot 100 may be preset in the control unit, and the control unit controls the mobile module to move on the moving path.

Figure 5:
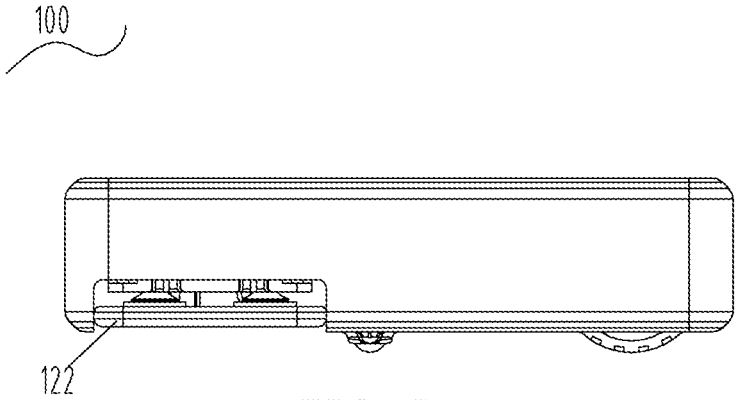
FIG. 5 is a schematic diagram of a cleaning robot on which no mopping module is mounted according to an embodiment of the present disclosure.
Figure 6:
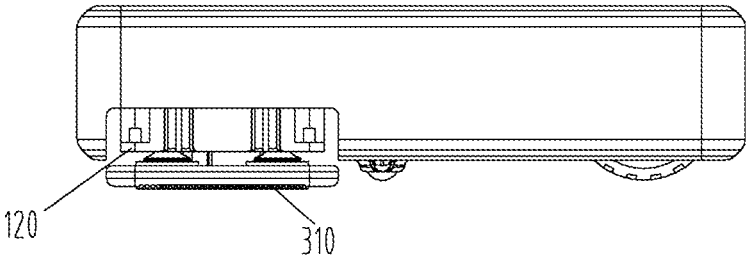
FIG. 6 is a schematic diagram of a cleaning robot on which a mopping module is mounted according to an embodiment of the present disclosure.
Figure 7:
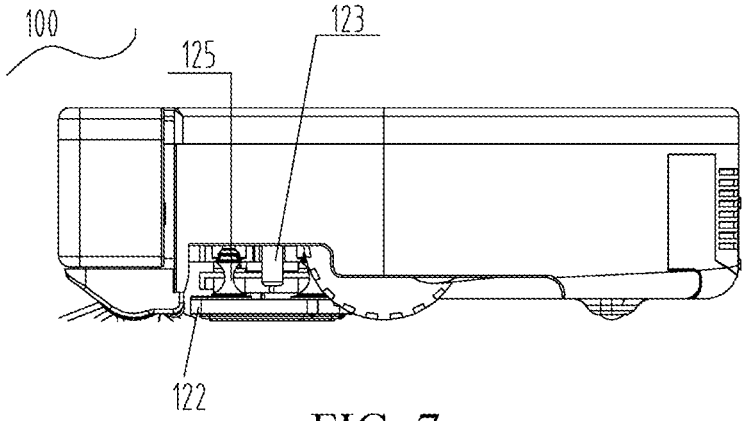
FIG. 7 and FIG. 8 are schematic diagrams of a connection assembly of a cleaning robot according to an embodiment of the present disclosure.
Figure 8:
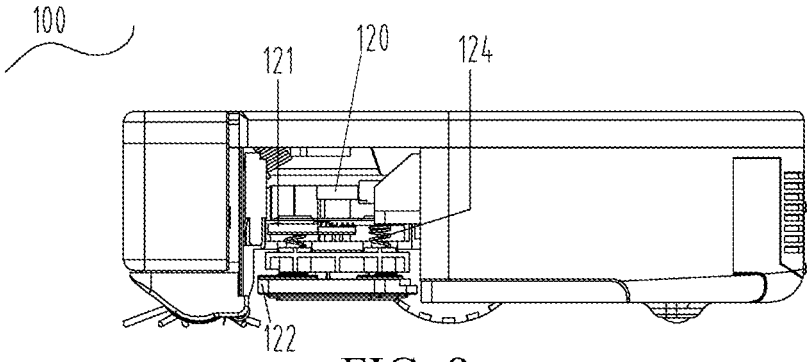

Referring to FIG. 5 and FIG. 6, in this embodiment, the mopping module 310 is detachably mounted on the cleaning robot 100. FIG. 5 shows a state in which the mopping module 310 is not mounted on the cleaning robot 100. FIG. 6 shows a state in which the mopping module 310 is mounted on the cleaning robot 100. The cleaning robot 100 on which the mopping module 310 is mounted is capable of moving in the working region and performing cleaning work. In this embodiment, the cleaning robot 100 further includes a connection assembly 120, the cleaning robot 100 is capable of automatically mounting the mopping module 310 on the cleaning robot 100 through the connection assembly 120, and the connection assembly 120 is controlled through the control unit, thereby separating the mopping module 310 from the body of the cleaning robot 100. In this embodiment, referring to FIG. 7 and FIG. 8, the connection assembly 120 includes a rack 121, where the rack 121 is connected to the main body of the cleaning robot 100; and a partition board 122, where the mopping module 310 is connected to the main body of the cleaning robot 100 by the partition board 122. In this embodiment, the connection assembly 120 includes a magnetic element, by which the mopping module 310 is connected to the main body of the cleaning robot 100 through a magnetic action. In this embodiment, the connection assembly 120 is capable of adjusting a height of the mopping module 310 relative to the ground in response to a control signal of the control unit. In this embodiment, when the cleaning robot 100 needs to mount the mopping module 310, the control unit controls the connection assembly 120 to descend to approach the mopping module 310, and the magnetic element on the connection assembly 120 and a magnetic element 314 on the mopping module 310 approach to attract each other. Therefore, the mopping module 310 is connected to the main body of the cleaning robot 100. In this embodiment, when the mopping module 310 needs to be separated from the body of the cleaning robot 100, the control unit controls the connection assembly 120 to ascend. The connection assembly 120 further includes an ejector rod 123, and the ejector rod 123 generates a downward pressure to the mopping module 310, so that the mopping module 310 is separated from the main body of the cleaning robot 100. In this embodiment, when performing cleaning work, the mopping module 310 is in contact with the ground to perform cleaning work on the surface; and in a scenario of performing no cleaning work, for example, a scenario of returning for charging, or returning to replace the mopping module, the mopping module 310 is lifted, to avoid contact between the mopping module 310 and the ground to prevent the dirty mopping module 310 from contaminating the cleared working surface. By arranging the connection assembly 120, beneficial effects lie in that, the mopping module 310 is automatically connected to the main body of the cleaning robot 100, and the mopping module 310 is automatically separated from the main body of the cleaning robot 100, so that the design is capable of effectively reducing manual participation during working of the cleaning robot 100.

The cleaning robot 100 is usually used for clearing different regions in a house, thereby comprehensively cleaning rooms. However, different regions in a house are usually contaminated to different extents, and in particular, it is difficult to clean some regions that may have relatively stubborn stains. In an embodiment, the connection assembly 120 of the cleaning robot 100 further includes an elastic element 124, referring to FIG. 7, for example, a spring or a leaf spring, and the elastic element 124 is disposed between the rack 121 of the cleaning robot 100 and the partition board 122. When the mopping module 310 is connected to the partition board 122 of the cleaning robot 100, the user applies a downward pressure to the rack 121 by manually adjusting the rack 121 or through artificial intelligence control, and in response to the pressure transferred by the rack 121, the spring applies a pressure to the partition board 122. Because the partition board 122 is connected to the mopping module 310, the mopping module 310 generates a pressure to the ground. Specifically, the cleaning robot 100 further includes a detection element such as a visual sensor, configured to determine a cleaning extent of the current working surface and adjust the magnitude of the pressure of the spring based on the cleaning extent of the current surface. Specifically, when the cleaning robot 100 detects that the current working surface is relatively dirty and needs to be emphatically cleaned, and a substance difficult to clean exists on the current working surface, the pressure of the elastic element 124 on the mopping module 310 is automatically adjusted and becomes larger, thereby ensuring a relatively good cleaning effect; and when the cleaning robot 100 detects that the current working surface is relatively clean, the pressure of the elastic element 124 on the mopping module 310 is automatically adjusted and becomes smaller, thereby reducing energy consumption of the cleaning robot 100. By arranging the elastic element 124, the mopping module 310 fits the ground more fully, and has a better cleaning effect on the ground, thereby effectively clearing a region with a stubborn stain in a house.

In an embodiment, the cleaning robot 100 further includes a vibration motor (not shown), and the vibration motor is connected to the connection assembly 120, and is configured to apply a vibration force to the mopping module 310, so that the mopping module 310 is in vibration contact with the working surface, thereby ensuring a relatively good cleaning effect. Because of arranging the vibration motor, the mopping module 310 vibrates, and if the mopping module 310 continuously vibrates during working, vibration transferred to another element of the cleaning robot 100 affects the working stability of the cleaning robot 100 and the working life of the element of the cleaning robot 100. In an embodiment, the connection assembly 120 of the cleaning robot 100 further includes a buffering apparatus 125, referring to FIG. 8, for example, a rubber column, and the rubber column is connected between the rack 121 and the partition board 122, and is configured to reduce vibration and perform buffering.

Figure 9:
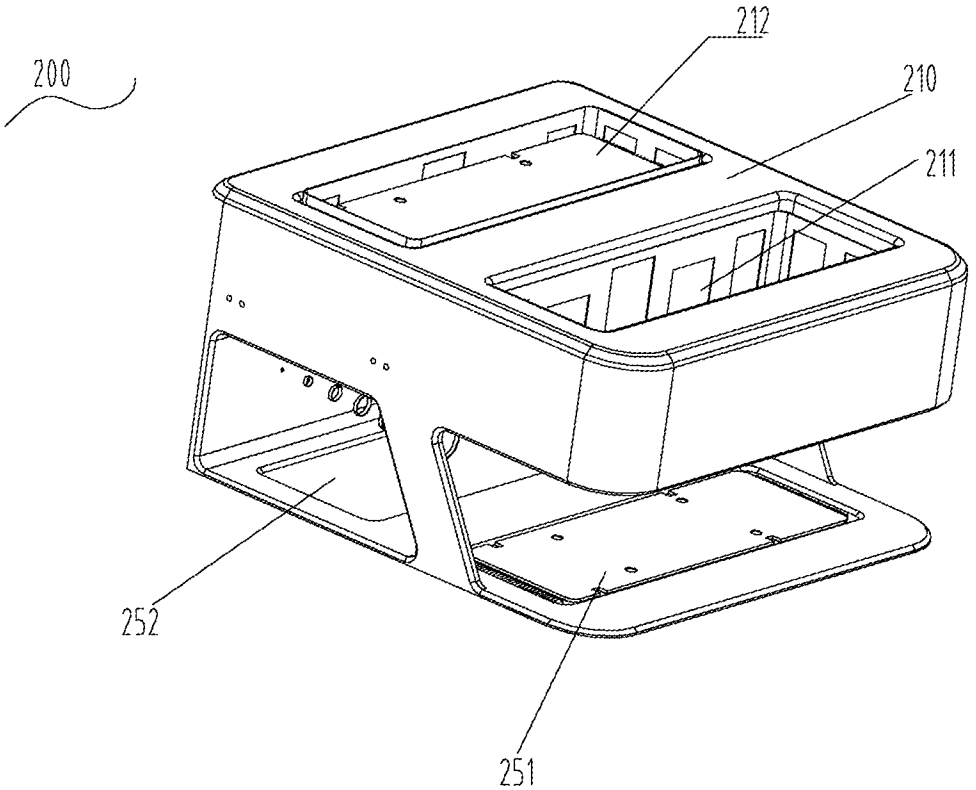
FIG. 9 is a schematic diagram of a base station according to an embodiment of the present disclosure.

Referring to FIG. 1 and FIG. 9, the cleaning robot 100 includes a storage module 210 and an operating position, where the storage module is disposed above the operating position. The storage module 210 includes a first storage unit 211 and a second storage unit 212, where the first storage unit is configured to store a mopping module 310 separated from the cleaning robot, and the second storage unit is configured to store a mopping module 310 provided to the cleaning robot 100 for mounting. The operating position includes a first operating position 251 and a second operating position 252, where the first operating position is provided for the mopping module 310 separated from the cleaning robot 100, and the second operating position 252 is provided for the cleaning robot to mount the mopping module 310. Specifically, the first storage unit 211 is located above the first operating position, and the second storage unit 212 is located above the second operating position 252. By arranging the storage module 210 above the operating position, the mopping module is capable of implementing transfer through vertical movement, so that the structure of the base station is compact. By arranging two storage units and two docking positions, the robot 100 is capable of separating and mounting mopping modules 310 at different positions, so that the cleaning robot automatically replaces a mopping module 310.

Figure 10:
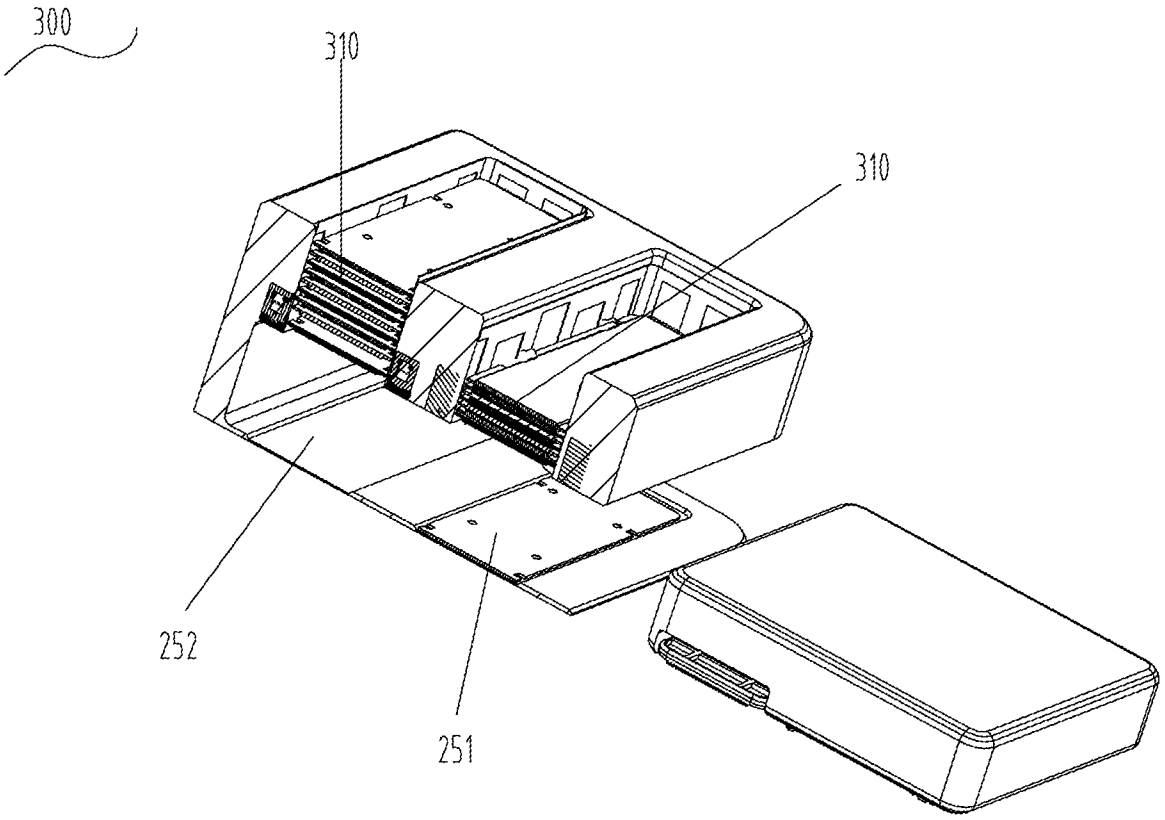
FIG. 10 is a cross-sectional view of a base station according to an embodiment of the present disclosure.

Specifically, the base station 200 includes a transfer module, where the transfer module is configured to transfer the mopping module between the storage module and the operating position. Specifically, the transfer module includes a driving member and a loading member, where the loading member is connected to the mopping module and causes the mopping module to move under the action of the driving member. The loading member includes a mopping module collection unit 231 and a mopping module providing unit 236, where the mopping module collection unit 231 is configured to move the mopping module 310 at the first operating position 251 separated from the cleaning robot 100 to the first storage unit 211; and the mopping module providing unit 236 is configured to obtain the mopping module 310 from the second storage unit 212 and move the mopping module to the second operating position 252, for the cleaning robot 100 to mount. Moreover, the loading member includes a supporting assembly, configured to support the mopping module in storage module to prevent the mopping module from falling. Specifically, the supporting assembly includes a first supporting assembly configured to support the mopping module in the first storage unit and a second supporting assembly configured to support the mopping module in the second storage unit. Specifically, the mopping module collection unit includes a first supporting assembly, and the mopping module providing unit includes a second supporting assembly. That is to say, the supporting assembly includes the first supporting assembly of the mopping module collection unit, and the second supporting assembly of the mopping module providing unit. Specifically, the mopping module collection unit 231 is configured to collect the mopping module 310 separated from the main body of the cleaning robot 100, and the mopping module providing unit 236 is configured to provide, to the cleaning robot 100, the mopping module 310 with which the cleaning robot 100 performs replacement. The first storage unit 211 cooperates with the mopping module collection unit, to collect the mopping module 310 separated from the main body of the cleaning robot 100 to the first storage unit 211; and the second storage unit 212 cooperates with the mopping module providing unit, to transfer, through the mopping module providing unit, the mopping module 310 stored in the second storage unit 212 to the cleaning robot 100 for mounting. Specifically, the cleaning robot 100 enters the base station and then reaches the operating position, and a part on the cleaning robot 100 on which the mopping module is mounted corresponds to the operating position on the base station 200. Specifically, when the cleaning robot 100 reaches the first operating position 251, the cleaning robot 100 separates the mopping module 310 mounted on the main body and places the mopping module on the first operating position 251; and when the cleaning robot reaches the second operating position 252, the cleaning robot 100 mounts the mopping module 310 placed on the second operating position 252 onto the main body of the cleaning robot 100. Specifically, the operating position includes an operating region, the region may be configured to place the mopping module 310, and the region may be provided for the cleaning robot 100 to separate the mopping module and/or for the cleaning robot 100 to mount the mopping module. Specifically, the first operating position 251 includes a first operating region, and after the robot 100 enters the base station and reaches the first operating region, the mopping module 310 mounted on the main body of the robot is separated and is placed on the first operating region, where more than one mopping module may be stacked on the first operating region; and the second operating position 252 includes a second operating region, and after the robot enters the base station and reaches the second operating region, the mopping module 310 placed on the second operating region is mounted on the main body of the cleaning robot. Specifically, one or more mopping modules 310 may be placed on the second operating region. That is to say, the operating position of the base station 200 includes an operating region, the mopping module 310 may be placed on the region, and the cleaning robot 100 is capable of replacing the mopping module of the cleaning robot 100 on the region. In this embodiment, the first storage unit 211 and the second storage unit 212 are disposed in parallel. Referring to FIG. 10, specifically, the bottom surface of the first storage unit 211 and that of the second storage unit 212 are approximately located in the same plane. Specifically, the first storage unit 211 is configured to store a used dirty mopping module 310 separated from the cleaning robot 100, and the second storage unit 212 is configured to store a clean mopping module 310 for the cleaning robot 100 to mount. Specifically, referring to FIG. 10, each of the first storage unit 211 and the second storage unit 212 may store a plurality of mopping modules 310, and the plurality of mopping modules 310 are stacked. Specifically, the first storage unit 211 and the second storage unit 212 are approximately the same in capacity, and are capable of holding mopping modules whose quantities are approximately the same. In this embodiment, the storage module 210 is disposed in the vertical direction of the operating position. Specifically, the storage module 210 is disposed above the operating position, so that a projection of the storage module on the horizontal plane approximately covers a projection of the operating region on the horizontal plane. When the cleaning robot 100 enters the base station 200, a distance between the top of the cleaning robot 100 and the bottom of the storage module of the base station 200 in the vertical direction is less than or equal to 50 mm. In this embodiment, the position of the first storage unit 211 and the first operating position 251 of the cleaning robot 100 on the base plate of the base station are correspondingly set. Specifically, the first storage unit 211 is disposed in the vertical direction of the first operating position 251. More specifically, the first storage unit 211 is disposed at the top of the vertical direction of the first operating position 251, so that the projection of the first storage unit on the horizontal plane approximately covers the projection of the first operating position on the horizontal plane. In this embodiment, the position of the second storage unit 212 and the second operating position 252 of the cleaning robot 100 on the base plate of the base station are correspondingly set. Specifically, the second storage unit 212 is disposed in the vertical direction of the second operating position 252. More specifically, the second storage unit 212 is disposed at the top of the vertical direction of the second operating position 252. In another embodiment, the storage module 210 may alternatively be located below the operating position. When the cleaning robot 100 travels to the operating position to separate the mopping module, the transfer module collects, through movement from top to bottom, the mopping module 310 separated from the main body of the cleaning robot into the storage module; and when the cleaning robot needs to mount the mopping module, the transfer module transfers, through movement from bottom to top, the mopping module to the cleaning robot for mounting. In this embodiment, when the cleaning robot 100 returns to the base station 200 to replace the mopping module 310, the cleaning robot enters the base station 200 and reaches the first operating position 251, and the control unit controls the mopping module 310 to be separated from the cleaning robot 100; and the second operating position 252 is located in front of the first operating position 251 relative to the pull-in direction of the cleaning robot 100, the cleaning robot 100 reaches the first operating position 251 and then continues to travel forward, to reach the second operating position 252, and the cleaning robot 100 mounts the mopping module 310 here. In this embodiment, the second storage unit 212 is disposed in front of the first storage unit 211 relative to the pull-in direction of the cleaning robot 100, so that during pull-in, the cleaning robot 100 is capable of first approaching the first storage unit 211, and then approaching the second storage unit 212. Advantages of such design in this embodiment lie in that, the transfer module includes the mopping module collection unit, the cleaning robot 100 performs cleaning work on the working surface, the mopping module 310 is continuously in contact with the working surface, the mopping module 310 becomes dirty and needs to be replaced after a period of time of working, the mopping module collection unit 231 is disposed in the base station 200, and the mopping module 310 of the cleaning robot 100 is capable of autonomously returning, after becoming dirty, to the base station 200 for replacement, to prevent the dirty mopping module 310 from continuing to contaminate the working surface. After the cleaning robot 100 automatically separates the mopping module 310 from the main body of the cleaning robot 100, the separated dirty mopping module is automatically picked up by the mopping module collection unit, and collected into the first storage unit 211 of the storage module 210, thereby taking in the dirty mopping module. By taking in the dirty mopping module, the working surface is neat and ordered. In an embodiment, the transfer module includes a mopping module providing unit. By arranging the mopping module providing unit, when the mopping module 310 becomes dirty after the cleaning robot 100 has worked for a period of time, a new mopping module can be obtained in time to perform replacement, thereby reducing manual work. By arranging the mopping module providing unit, after the cleaning robot 100 separates a used dirty mopping module 310, a clean mopping module 310 needs to be mounted to continue to perform cleaning work, and the base station 200 is capable of automatically taking out the clean mopping module 310 stored in the storage module 210, for the cleaning robot 100 to mount, so that the cleaning robot 100 may always automatically obtain the clean mopping module 310 through the base station 200, to automatically continuously perform cleaning work on the working surface. In an embodiment, by arranging the mopping module collection unit 231, the base station 200 is capable of automatically collecting the used dirty mopping module separated from the main body of the cleaning robot 100; and by arranging the mopping module providing unit, the base station is capable of providing at least one clean mopping module to the cleaning robot 100 for mounting. Such design enables the base station 200 to implement both a function of collecting and taking in the dirty mopping module 310 separated from the cleaning robot 100, and a function of providing the clean mopping module 310 to the cleaning robot 100 for mounting. When the cleaning robot 100 needs to replace the mopping module 310, the mopping module 310 connected to the main body of the robot is first separated through the connection assembly, and the mopping module collection unit of the base station 200 collects the mopping module, and stores the mopping module into the first storage unit; and after the cleaning robot 100 separates the used dirty mopping module 310, a clean mopping module needs to be mounted, and the clean mopping module is automatically taken out from the second storage unit through the mopping module providing unit, for the cleaning robot 100 to mount, so that the cleaning robot 100 can automatically separate and take in the dirty mopping module in order, and automatically mount the clean mopping module 310 to continuously perform cleaning work on the working surface. Moreover, when the cleaning robot 100 replaces the mopping module 310, the operating position of the cleaning robot 100 corresponds to the storage module 210 of the base station 200 in the vertical direction; and when the cleaning robot 100 cooperates with the base station 200 to replace the mopping module 310, the transfer module causes the mopping module 310 to move in the vertical plane, so that the structure of the base station 200 is relatively compact, and the motion path of the mopping module 310 is relatively short.

Figure 27:
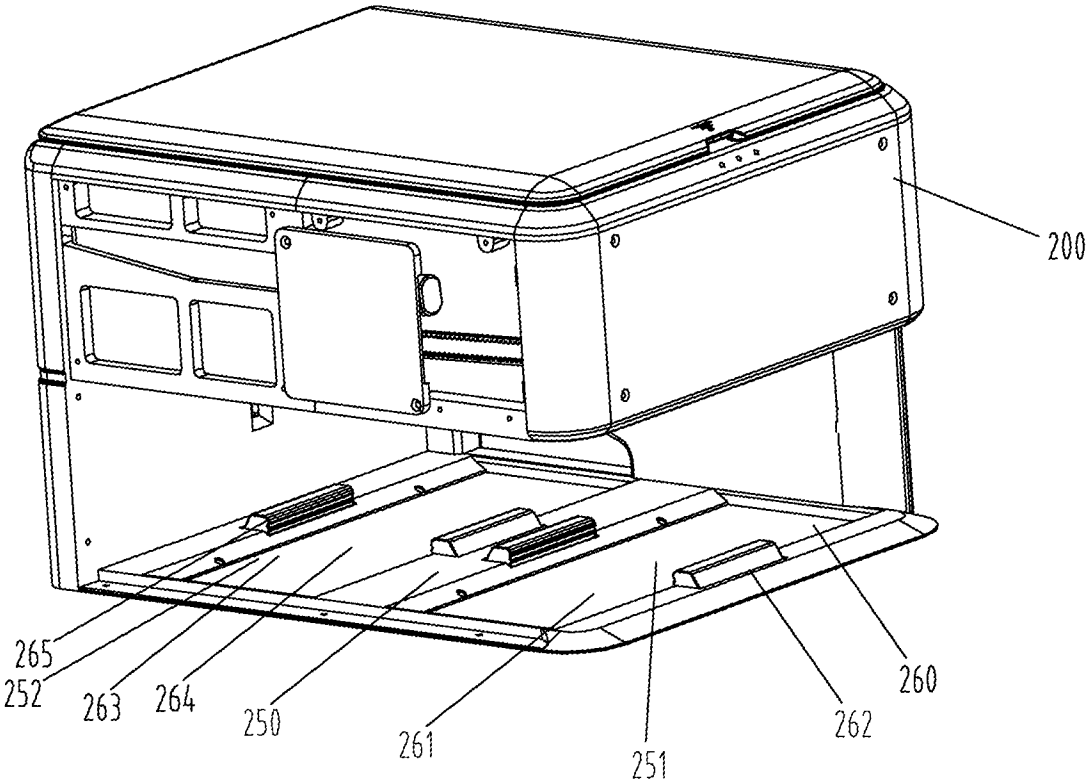
FIG. 27 is a schematic diagram of a base plate of a base station according to an embodiment of the present disclosure.

As shown in FIG. 27, FIG. 27 shows the operating position of the base station 200. The operating position is provided with a stop structure, to limit the mopping module 310 placed on the operating position. The stop structure is disposed, to avoid a case that when the cleaning robot moves on the base station 200, the moving wheel of the cleaning robot drives the mopping module placed on the operating position to move, and a position change of the mopping module affects the working effect of replacing the mopping module by the cleaning robot 100. Specifically, the base station 200 includes a base plate 250, and the operating position is formed on the base plate 250 of the base station. In an embodiment, the first operating position 251 is provided with a first stop structure 260, and the first stop structure 260 is configured to stop the dirty mopping module 310 separated from the cleaning robot, to avoid a case that after being separated, the dirty mopping module 310 cannot accurately fall onto the first operating position 251, a case that the dirty mopping module 310 falls onto the first operating position 251 and then is moved, and another case. Specifically, the first stop structure 260 includes a first groove 261, that is, the base plate 250 is provided with a groove structure lower than a plane of the base plate. When needing to replacement the mopping module, the cleaning robot returns to the first operating position 251, the dirty mopping module is separated by the connection assembly of the robot 100 from the robot and falls into the first groove 261. That is to say, the first groove 261 is configured to store the dirty mopping module 310 separated from the main body of the robot, and the first groove 261 has a specific depth, and is capable of storing at least one dirty mopping module. When needing to collect the dirty mopping module, the base station 200 automatically starts the mopping module collection unit, to collect the dirty mopping module in the first groove 261 into the first storage unit 211. It may be understood that, when a plurality of dirty mopping modules are stored in the first groove 261, the plurality of dirty mopping modules may be stacked in the first groove 261, and the first groove 261 has a specific capacity. When the quantity of dirty mopping modules exceeds a specific quantity, the robot automatically starts the mopping module collection unit, to collect the dirty mopping modules in the first groove 261 into the first storage unit. Finally, a highest point of the dirty mopping modules stored in the first groove 261 is controlled to not exceed a height of a side wall of the first groove 261, that is to say, the highest point of the dirty mopping modules is not higher than the horizontal plane of the base plate, so that when passing through the groove structure, the mobile module of the robot, for example, the moving wheel does not sink into the groove structure. In this way, the dirty mopping modules stored in the groove structure are prevented from being crushed by the moving wheel of the robot and being moved out of the first groove 261 For example, in a process in which the robot is separated from the dirty mopping module 310 and continues to forward move to the second operating position 252 to mount a new mopping module, the moving wheel of the robot passes through the first groove 261, that is, passes through the detached dirty mopping module. Moreover, when the quantity of the dirty mopping modules in the first groove 261 is controlled to be lower than the horizontal plane of the base plate, a case that crushing of the moving wheel of the robot on the detached dirty mopping module causes the dirty mopping module to be moved out of the first groove 261 due to friction between the moving wheel and the dirty mopping module, to affect normal collection of the dirty mopping module is avoided. In another example, when the robot quits the base station 200, a case that the moving wheel of the robot crushes the dirty mopping module and the dirty mopping module is moved out of the first groove 261 is avoided. As shown in FIG. 27, the edge position of the side wall of the first groove 261 is further provided with a stop board structure 262, configured to stop the cleaning robot separated from the mopping module from being moved out. In a specific embodiment, the stop board structure 262 is disposed at edges of at least two side walls of the first groove 261, or may be disposed at edges of three side walls or four side walls, and is preferably disposed at edges of two opposite side walls in this embodiment, and the stop board structure 262 protrudes from the horizontal plane of the base plate. When a dirty mopping module is stored in the first groove 261, arrangement of the stop board structure 262 prevents the dirty mopping module from being moved away by the moving wheel. Meanwhile, when the dirty mopping module falls from the robot, the stop board structure 262 can also play a role in guiding the dirty mopping module to accurately fall into the first groove 261, to prevent the separated dirty mopping module from falling out of the first groove 261 to affect normal collection of the dirty mopping module. Neither the form nor the quantity of stop board structures 262 is limited, and any structure that protrudes from the horizontal plane of the base plate and can play a stop role such as a stop strip or a stop block is included. As shown in FIG. 27, further, in this embodiment of the present disclosure, the second operating position 252 is also provided with a second stop structure 263, configured to stop the mopping module 310 provided for the robot to mount, and the second stop structure 263 includes a second groove 264, configured to store the mopping module provided for the robot to mount. Specifically, the second groove 264 is configured to store the new mopping module separated from the second storage unit 212, the edge position of the side wall of the second groove 264 is also provided with a stop board structure 265, that is configured to stop the mopping module provided for the robot to mount from being crushed by the moving wheel of the robot and being moved out of the second groove 264, and can also quite well guide the mopping module separated from the second storage unit 212 to fall into the second groove 264 for the robot to mount. The specific principle and structure of the second stop structure 263 are approximately the same as those of the first stop structure 260, and details are not described herein again. It may be understood that, the first stop structure 260 and the second stop structure 263 are disposed in parallel, and respectively correspond to the first storage unit 211 and the second storage unit 212, the first groove 261 and the second groove 264 are approximately the same as in capacity, and are capable of holding mopping modules whose quantities are approximately the same, and the plurality of held mopping modules are stacked.

In this embodiment, the cleaning robot 100 enters the base station to replace the mopping module 310. Specifically, the base plate of the base station 200 protrudes from the cleaning surface, and only after travelling onto the base plate, the cleaning robot can enter the base station 200, and the base plate of the base station is provided with the first groove, the second groove, the first stop structure, and the second stop structure. Therefore, the base plate needs to have a specific thickness. Specifically, the cleaning robot 100 has a specific obstacle crossing capability, the obstacle crossing capability of the cleaning robot affects setting of the thickness of the base plate, and the obstacle crossing capability of the cleaning robot is affected by the height of the moving wheel of the cleaning robot. Usually, when the height of the moving wheel is relatively large, the obstacle crossing capability is relatively good. In this embodiment, the thickness of the base plate is less than 20 mm, so that the obstacle crossing capability of the cleaning robot is capable of ensuring that the cleaning robot 100 enters the base station, ensuring working stability of the robot cleaning system.

In an embodiment, to cause the mopping module 310 to be placed relatively accurately after moving from the second storage unit 212 to the second operating position 252, if the mopping module 310 is placed at the second operating position relative accurately, accuracy of mounting the mopping module 310 by the cleaning robot 100 can be improved. Specifically, the second operating position 252 is provided with a positioning magnet, a magnetic element is mounted on the mopping module, and when the mopping module falls from the second storage unit 212, the position of the mopping module 310 after falling is corrected because of adsorption of the positioning magnet. Specifically, the second operating position 252 is provided with four positioning magnets, the mopping module 310 is provided with four magnetic elements, and positions of the four positioning magnets correspond to those of the four magnetic elements. Specifically, the mopping module 310 is further provided with a magnetic element provided for the cleaning robot 100 to mount the mopping module. Specifically, for the magnetic element used for alignment and the magnetic element used for mounting, one magnetic element may be used to implement two functions, or two magnetic elements may be used to respectively implement alignment and mounting. Specifically, when two magnetic elements are used, the magnetic element used for alignment is magnetically weaker than the magnetic element used for mounting. Specifically, when the mopping module 310 includes two or more magnetic elements, there is an anti-interference structure between the magnetic elements.

Figure 11:
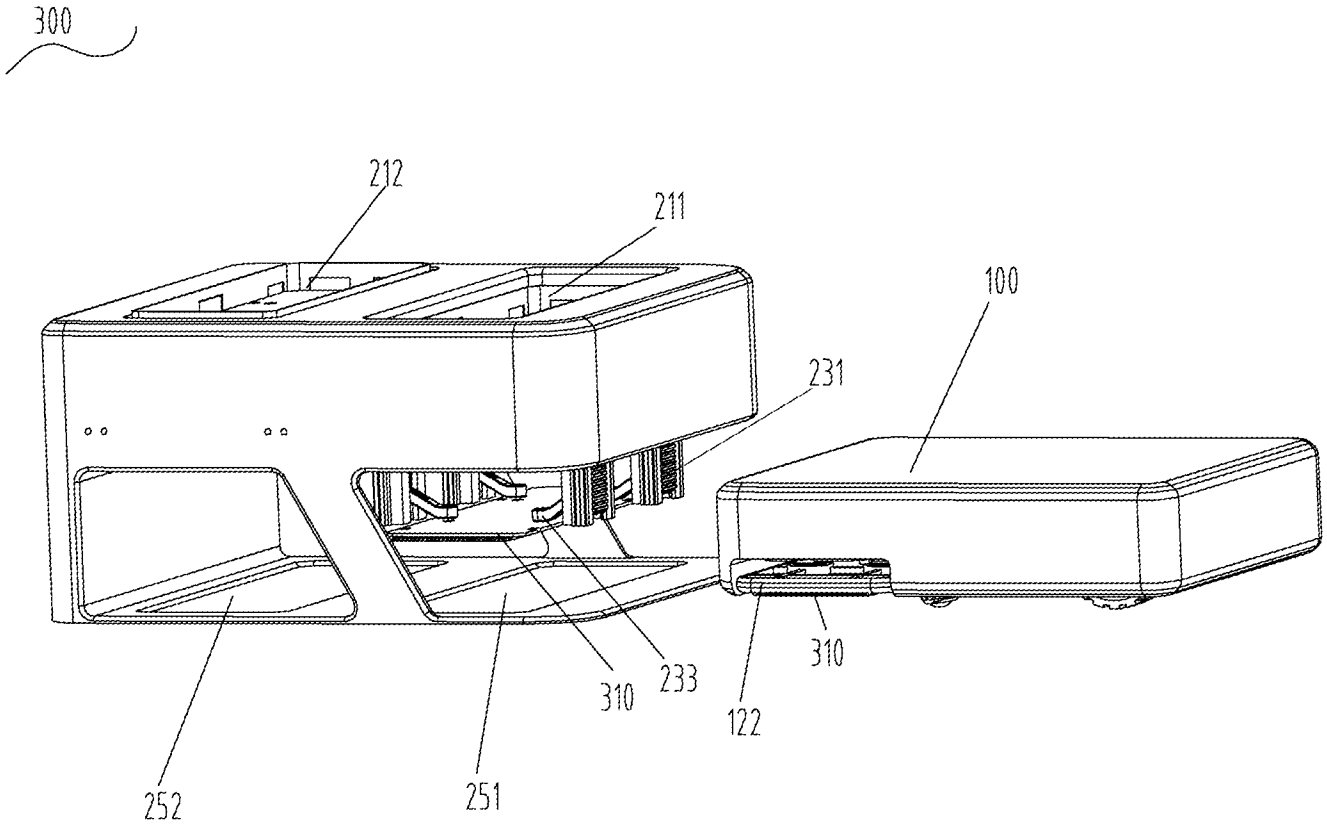
FIG. 11 is a schematic diagram of a base station collecting a mopping module according to an embodiment of the present disclosure.
Figure 12:
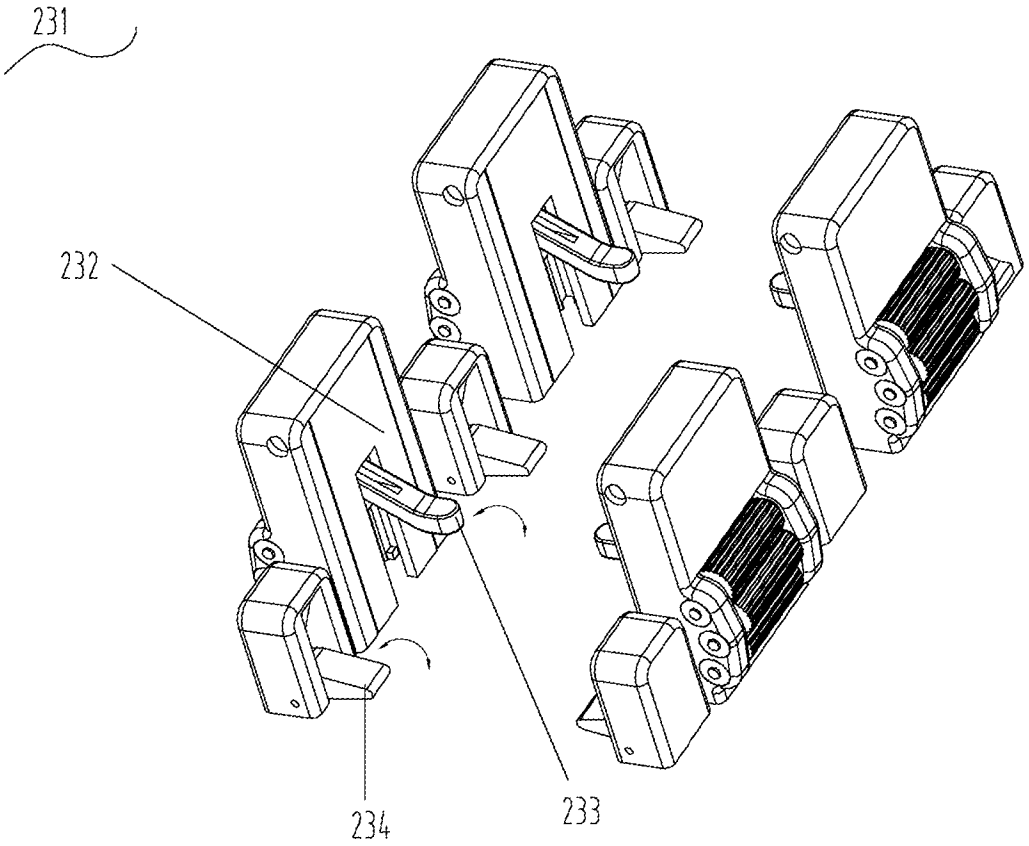
FIG. 12 is a schematic diagram of a mopping module collection unit according to an embodiment of the present disclosure.
Figure 13:
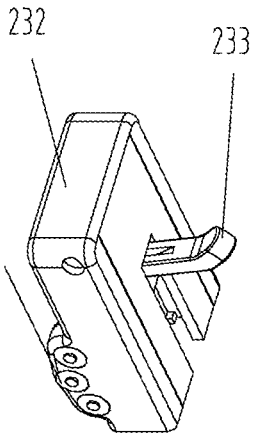
FIG. 13, FIG. 14, and FIG. 15 are schematic diagrams of a lifting mechanism according to an embodiment of the present disclosure.
Figure 14:
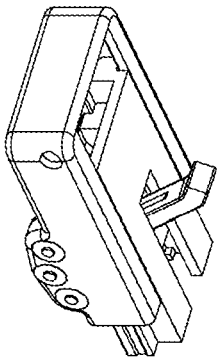
Figure 15:
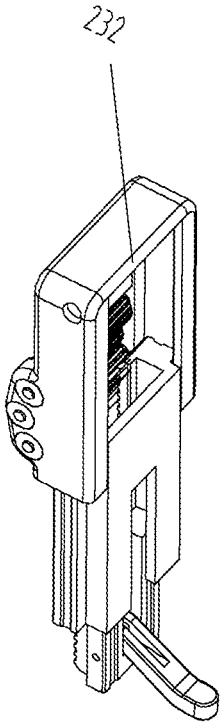

In this embodiment, the loading member includes a mopping module collection unit 231, the mopping module collection unit 231 further includes a first supporting assembly (referring to FIG. 11 to FIG. 15), and the mopping module collection unit 231 picks up the mopping module 310 and collects the mopping module into the first storage unit 211. In this embodiment, the mopping module collection unit and the first operating position 251 of the base station are correspondingly disposed, the cleaning robot 100 separates the mopping module 310 and places the mopping module on the first operating position 251, and the mopping module collection unit 231 picks up the mopping module 310 from the first operating position 251 and takes in the mopping module to the first storage unit 211. The mopping module collection unit 231 includes a lifting mechanism 232 movable at two stages in the vertical direction, FIG. 12 is an example of the mopping module collection unit of this embodiment, FIG. 13, FIG. 14, and FIG. 15 are examples of the lifting mechanism 232, the lifting mechanism 232 is movable at two stages and therefore has three motion states, and FIG. 13, FIG. 14, and FIG. 15 respectively represent three motion states of the lifting mechanism 232, that is, a retraction state, a first extension state, and a second extension state. Specifically, reference is made to FIG. 13 for a state of the lifting mechanism 232 when not extending, and in this case, the lifting mechanism is in the retraction state; reference is made to FIG. 14 for a state of the lifting mechanism 232 when partially extending, and in this case, the lifting mechanism is in the first extension state; and reference is made to FIG. 15 for a state of the lifting mechanism 232 when completely extending, and in this case, the lifting mechanism is in the second extension state. When elongating, the lifting mechanism 232 performs two-stage extension movement along a movement direction. Specifically, when not working, the lifting mechanism 232 is in an initial state, where the initial state is the first extension state; and when the lifting mechanism 232 is in the retraction state, the lifting mechanism 232 has a minimum length. When the mopping module collection unit needs to collect the mopping module 310, the lifting mechanism 232 elongates to be in the second extension state, the lifting mechanism 232 in the second extension state has a maximum length, and when elongating to be in the second extension state, the lifting mechanism 232 is capable of picking up the mopping module 310. Referring to FIG. 11, when the mopping module collection unit works to collect the mopping module 310, the lifting mechanism 232 elongates to be in the second extension state to pick up the mopping module 310. After the lifting mechanism 232 picks up the mopping module 310, the elongating lifting mechanism 232 is first shortened from being in the second extension state to being in the first extension state, and then shortened from being in the first extension state to being in the retraction state. When the lifting mechanism 232 is shortened to be in the retraction state, the lifting mechanism 232 drives the mopping module 310 to be collected into the first storage unit 211. In this embodiment, when the mopping module collection unit collects the mopping module 310, the mopping module collection unit 231 drives the mopping module 310 to move in the vertical direction to transfer the mopping module 310 separated from the main body of the cleaning robot 100 to the first storage unit 211. In this embodiment, a movement direction of the mopping module 310 is perpendicular to a movement direction of the cleaning robot 100 entering the base station 200. Specifically, when moving vertically downward, the lifting mechanism 232 picks up the mopping module 310; and when the lifting mechanism 232 moves vertically upward, the mopping module 310 is collected into the first storage unit 211. Through the structure design of the mopping module collection unit, the mopping module collection unit causes the mopping module 310 to move in the vertical direction to collect the mopping module 310 into the first storage unit, and the mopping module 310 is collected through the movement of the mopping module 310 in the vertical direction, so that the base station 200 has a compact structure design and a small occupied area. Moreover, by designing the lifting mechanism 232 movable at two stages, the height of the base station 200 in the vertical direction is reduced, and the entire size of the base station is relatively small.

In this embodiment, the lifting mechanism 232 further includes a pickup assembly. In this embodiment, the pickup assembly includes an adsorption assembly 233, and the adsorption assembly 233 is disposed at a tail end of the lifting mechanism, and picks up the mopping module 310 by the adsorption assembly 233. In this embodiment, the adsorption assembly 233 includes a magnetic element, configured to perform a magnetic action with the magnetic element 314 of the rear board 311 of the mopping module to adsorb the mopping module 310. Specifically, in this embodiment, the magnetic element includes a magnet. Specifically, the adsorption assembly 233 and the lifting mechanism 232 are combined, and when the mopping module collection unit needs to collect the mopping module 310, the lifting mechanism elongates to be in the second extension state, and the adsorption assembly 233 disposed at the tail end of the lifting assembly approaches the mopping module 310 with extension of the lifting mechanism and adsorbs the mopping module 310 through a magnetic action, or the adsorption assembly 233 comes into contact with the mopping module 310 and adsorbs the mopping module 310 through a magnetic action. In this embodiment, the mopping module 310 is provided with four magnetic elements 314, the mopping module collection unit is provided with four the lifting mechanisms 232, each lifting mechanism 232 is provided with a magnetic element, and the four lifting mechanisms 232 on the mopping module collection unit synchronously elongate or retract. The magnetic element on the lifting mechanism 232 corresponds to the magnetic element 314 on the mopping module 310, to pick up the mopping module 310. When the mopping module collection unit needs to collect the mopping module, the lifting mechanism 232 extends to adsorb the mopping module 310 through the adsorption assembly 233, the adsorbed mopping module 310 is a dirty mopping module 310 that is separated from the main body of the cleaning robot 100 and has worked for a period of time, and the cleaning robot 100 travels to the first operating position 251 of the base station 200 to separate the dirty mopping module 310 from the main body of the cleaning robot 100. However, when separating the mopping module 310, the cleaning robot 100 cannot ensure that the mopping module 310 is accurately aligned with the mopping module collection unit at all moments. Consequently, correspondingly, the position of the magnetic element on the mopping module collection unit cannot be completely aligned with that of the magnetic element 314 on the mopping module 310 always, as described above. In other embodiments, the connection manner and the collection manner of the mopping module 310 may be frequently used. In this embodiment, by arranging the magnetic elements, because of attraction between the magnetic elements, even if the position of the mopping module 310 is not completely aligned, the magnetic elements have a calibration function. A beneficial effect of this design lies in that, through adsorption of the magnetic element, the process of collecting the mopping module 310 by the mopping module collection unit is calibrated, ensuring that the mopping module collection unit has relatively good working stability.

In this embodiment, referring to FIG. 12, the mopping module collection unit 231 includes a stop block 234. Specifically, the first supporting assembly includes the stop block 234, configured to hold up the mopping module 310 in the first storage unit 211. As shown by an arrow in FIG. 12, when the stop block is subject to an upward extrusion force, the stop block 234 is capable of rotating upward counterclockwise in a vertical plane, and restores to an initial state when being subject to no extrusion force, and when the stop block 234 is at the initial position, the mopping module in the first storage unit 211 is held up. Specifically, the tail end of the lifting mechanism 232 is capable of ascending or descending in the vertical direction as the lifting mechanism 232 is elongated/shortened. When the lifting mechanism 232 continuously extends, the tail end of the lifting mechanism descends in the vertical direction to cause the adsorption assembly disposed at the tail end of the lifting mechanism to approach the to-be-collected mopping module 310. When the lifting mechanism 232 retracts, the tail end of the lifting mechanism ascends in the vertical direction. Specifically, the tail end of the lifting mechanism 232 is further capable of rotating. As shown by an arrow in FIG. 12, the tail end of the lifting mechanism 232 is capable of rotating upward counterclockwise when being extruded, and restores to the original state when being not extruded. When the mopping module collection unit needs to collect the mopping module 310, the lifting mechanism 232 downward extends to cause the adsorption assembly disposed at the tail end of the lifting mechanism to adsorb the mopping module, the lifting mechanism drives the mopping module to upward move, and the stop block 234 is extruded by the mopping module 310 to rotate upward counterclockwise, so that the mopping module is placed into the first storage unit 211. When being not extruded, the stop block restores to the original state, thereby holding up the mopping module. When the lifting mechanism 232 again collects the mopping module 310, the lifting mechanism extends, the tail end of the lifting mechanism is extruded by the mopping module in the first storage unit 211 to upward rotate, and restores to the original state after passing through the opening of the first storage unit, the lifting mechanism is connected to the mopping module 310 when extending to be in the second extension state, and the lifting mechanism again upward retracts and extrudes the stop block to cause the mopping module to be taken in to the first storage unit 211.

Figure 16:
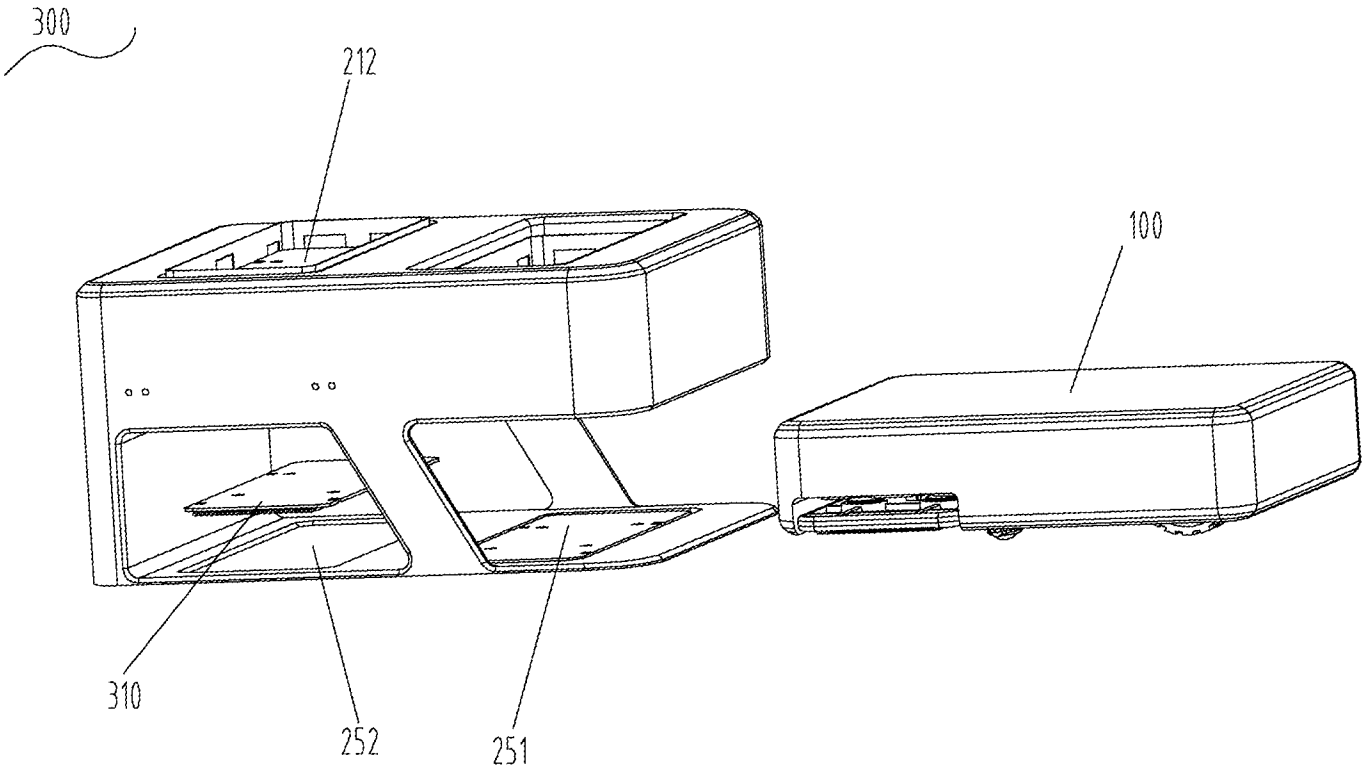
FIG. 16 is a schematic diagram of a base station providing a mopping module according to an embodiment of the present disclosure.
Figure 17:
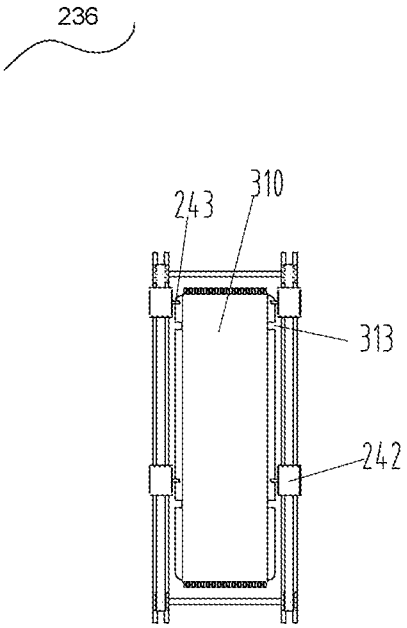
FIG. 17 and FIG. 18 are schematic diagrams of a mopping module providing unit according to an embodiment of the present disclosure.
Figure 18:
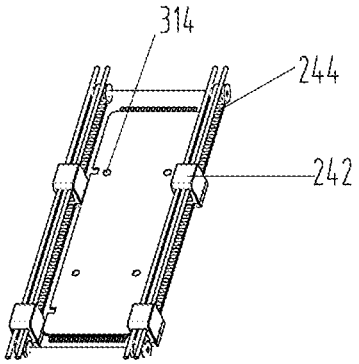

In this embodiment, referring to FIG. 16 to FIG. 18, the mopping module providing unit 236 cooperates with the second storage unit 212, the mopping module 310 in the second storage unit 212 is taken out from the operating position 252 of the base station the second for the cleaning robot 100 to mount, and the cleaning robot 100 mounts, on the second operating position 252, the mopping module 310 provided by the mopping module providing unit. FIG. 16 to FIG. 18 show design of the mopping module providing unit in this embodiment and movement for providing the mopping module 310. FIG. 17 and FIG. 18 are structure design of the mopping module providing unit according to this embodiment. Specifically, the mopping module providing unit can operate the mopping module 310 to be in the first state of fixing the mopping module 310 and the second state of releasing the mopping module 310. The mopping module providing unit includes a second supporting assembly, configured to support the mopping module in the second storage unit. Specifically, the second supporting assembly includes a slider, the transfer module further includes a transfer mechanism 244, the motor drives the transfer mechanism 244 to move, the slider 242 is located on the transfer mechanism 244 and moves in response to movement of the transfer mechanism 244, and the transfer mechanism 244 drives the slider 242 to move from the first position to the second position, where when the slider 242 is at the first position, the mopping module 310 is stored in the second storage unit 212; and when the slider 242 is at the second position, the mopping module 310 is released from the second storage unit 212. In this embodiment, the transfer mechanism 244 includes a synchronization belt, configured to move back and forth in a set direction in response to driving of the motor. In this embodiment, referring to FIG. 17 to FIG. 18, the slider 242 includes a protrusion 243, and when the slider 242 is at the first position, the mopping module 310 is held up through the protrusion 243, and the mopping module 310 is fixed to the second storage unit 212; and when the slider 242 is at the second position, the protrusion 243 on the slider 242 cooperates with the notch 313 on the mopping module 310, and the mopping module 310 is released from the second storage unit 212. Specifically, two edges of the mopping module 310 are provided with notches 313, and when the transmission assembly drives the slider 242 to move, the protrusion 243 on the slider 242 moves as the slider 242 moves; and when the protrusion 243 on the slider 242 just reaches the notch 313 of the mopping module 310, the mopping module 310 falls through the second supporting assembly of the mopping module providing unit. Specifically, the second supporting assembly of the mopping module providing unit includes a plurality of sliders 242, and the quantity of sliders 242 is related to the quantity of notches 313 on the mopping module 310. Specifically, two sliders 242 are disposed on each side of a synchronization belt pulley. Correspondingly, two notches 313 are disposed on each edge on two sides of the mopping module 310, a protrusion 243 is disposed on each slider 242, and when each protrusion 243 just matches each notch 313, the mopping module 310 is released. Specifically, to ensure that the protrusions 243 of the sliders 242 just match the notches 313 of the mopping module 310, when the sliders 242 are disposed, a distance between the two sliders 242 is constant, a distance between the two neighboring notches 313 on the mopping module 310 is also constant, and the distance between the sliders 242 is equal to the distance between the two neighboring notches 313 on the mopping module 310. When the protrusions 243 of the two sliders 242 on each side of the second supporting assembly of the mopping module providing unit match the notches 313 on each side on the mopping module 310, the mopping module 310 is released. When the second supporting assembly of the mopping module providing unit releases the mopping module, the cleaning robot 100 can mount only one mopping module 310 at a time, while a plurality of mopping modules 310 need to be stored in the second storage unit 212, to provide a replaceable mopping module to the cleaning robot 100 a plurality of times at different moments. Therefore, the mopping module providing unit needs to provide only one mopping module 310 to the cleaning robot 100 for replacement each time. To cause the mopping module providing unit to provide only one mopping module to the cleaning robot 100 each time, in this embodiment, the second storage unit 212 may store a plurality of mopping modules 310, to enable the base station 200 to stably provide the mopping module 310 to the cleaning robot in a relatively long time. If positions of the notches 313 of all mopping modules are completely consistent, when the slider 242 moves to the notch 313, the mopping module providing unit may simultaneously release a plurality of mopping modules 310. Therefore, in this embodiment, the positions of the notches 313 of all of the mopping modules 310 are not completely the same. Because the positions of the notches 313 of all of the mopping modules 310 are not completely the same, when the slider 242 reaches a notch 313 of a mopping module 310, the mopping module 310 is released through the second supporting assembly of the mopping module providing unit, and another mopping module 310 neighboring to the previous mopping module is continuously fixed because of the protrusion 243 of the slider 242 and is not released with release of the previous mopping module 310.

Figure 28:
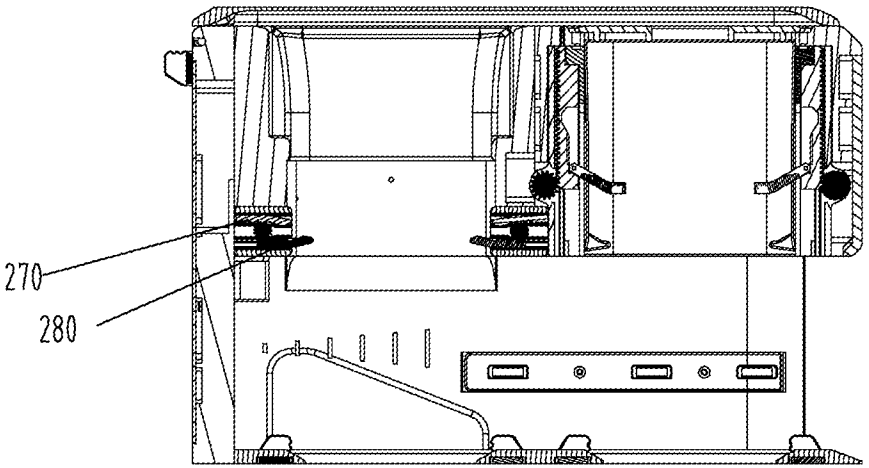
FIG. 28 is a schematic diagram of a base station on which a mopping module providing unit is disposed according to an embodiment of the present disclosure.
Figure 29:
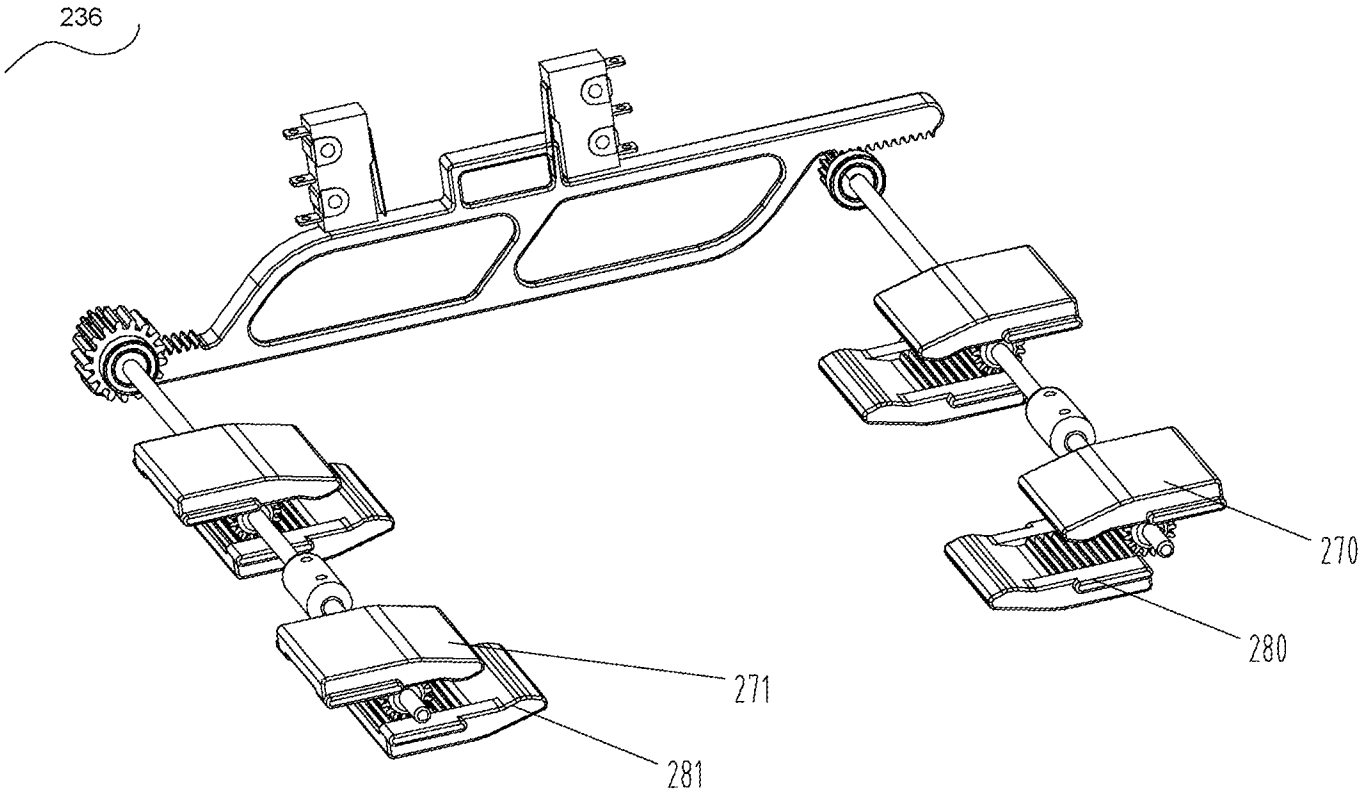
FIG. 29 is a schematic diagram of a mopping module providing unit according to an embodiment of the present disclosure.
Figure 30:
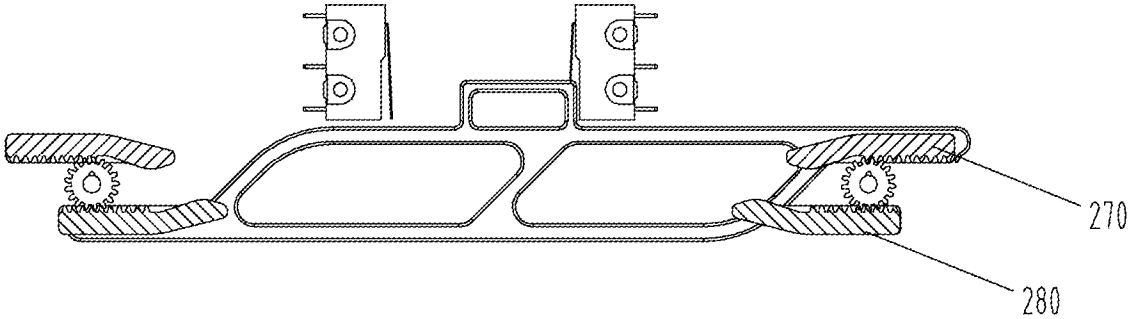
FIG. 30 is a side view of a mopping module providing unit according to an embodiment of the present disclosure.

As shown in FIG. 28 to FIG. 30, in another specific embodiment, the second supporting assembly of the mopping module providing unit includes a first blocking sheet telescoping mechanism 270 and a second blocking sheet telescoping mechanism 280 located below the first blocking sheet telescoping mechanism 270, the transfer module further includes a transmission mechanism configured to drive the first blocking sheet telescoping mechanism 270 and the second blocking sheet telescoping mechanism 280 to move, the transmission mechanism is connected to a motor, the motor drives the transmission mechanism to work, a transmission effect of the transmission mechanism causes the first blocking sheet telescoping mechanism 270 to switch between an extension position and a retraction position to fix mopping modules and release the mopping modules, and the transmission mechanism drives the second blocking sheet telescoping mechanism 280 to switch between an extension position and a retraction position to fix the mopping modules 310 released from the first blocking sheet telescoping mechanism 270 and release at least one of the mopping modules, to finally gradually release the mopping modules. In this embodiment of the present disclosure, at least one mopping module includes a first mopping module closest to the base plate, that is, an earliest falling mopping module. In another embodiment, a plurality of mopping modules may be alternatively released according to needs. Gradual release includes first-stage release and second-stage release, and is specifically described below. The transmission mechanism in this embodiment includes a gear and rack structure, and may be alternatively a worm gear and worm structure or the like in another embodiment.

Figure 31:
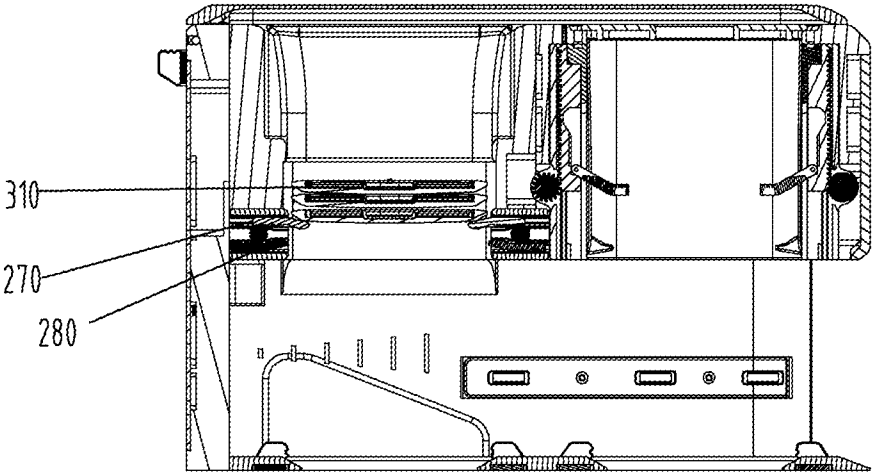
FIG. 31 is a schematic diagram of a first blocking sheet telescoping mechanism at an extension position according to an embodiment of the present disclosure.
Figure 32:
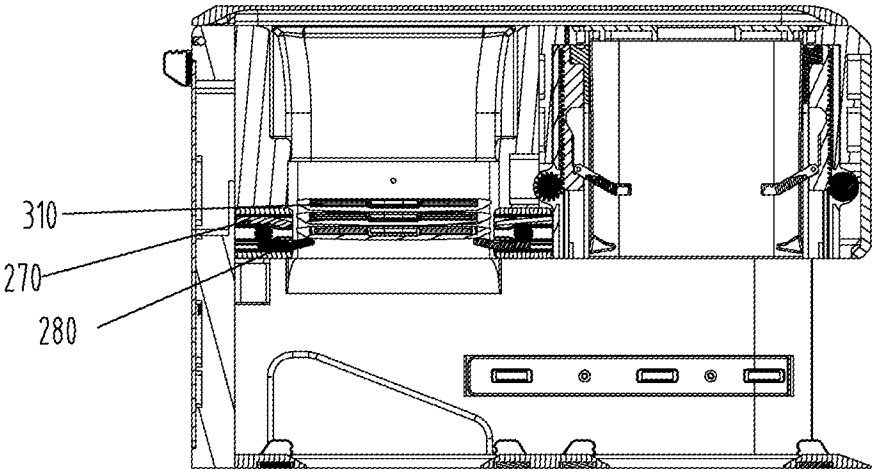
FIG. 32 is a schematic diagram of a first blocking sheet telescoping mechanism performing first-stage release on a mopping module according to an embodiment of the present disclosure.
Figure 33:
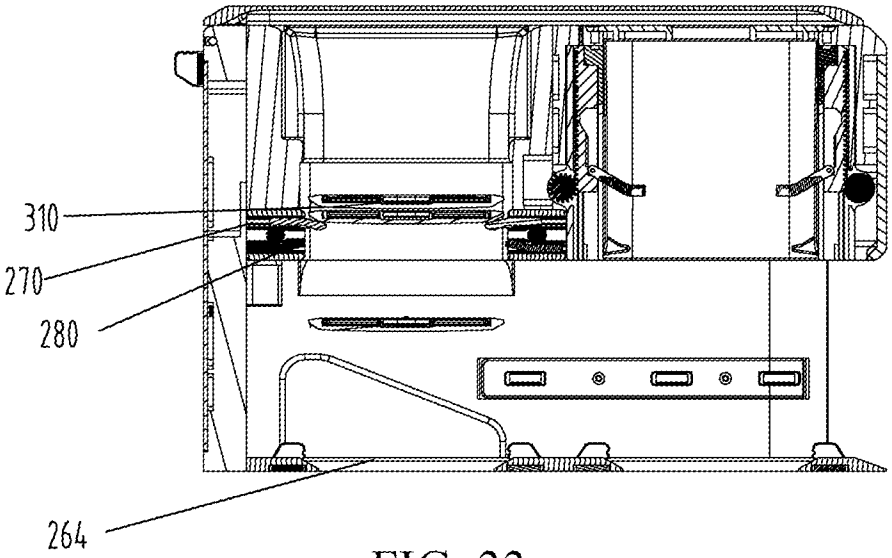
FIG. 33 is a schematic diagram of a second blocking sheet telescoping mechanism performing second-stage release on a mopping module according to an embodiment of the present disclosure.

As shown in FIG. 31, in this embodiment, the first blocking sheet telescoping mechanism 270 is located above the second blocking sheet telescoping mechanism 280. Specifically, both of the two are parallel to the ground. In this way, the mopping module 310 can be stably fixed, and is not easy to fall. When the mopping module 310 is released, the mopping module 310 can also be stably released into the second groove 264 of the base station 200. Certainly, the two blocking sheet telescoping mechanisms may be alternatively not parallel, provided that the mopping module 310 can be effectively fixed and released. It may be understood that, the first blocking sheet telescoping mechanism 270 at the extension position is capable of fixing the plurality of mopping modules 310 stored in the second storage unit 212. As shown in FIG. 31, when the transmission mechanism drives the first blocking sheet telescoping mechanism 270 to be at the extension position, a plurality of mopping modules 310 are stacked above the extension position. That is to say, because of the supporting function of the first blocking sheet telescoping mechanism 270, the first blocking sheet telescoping mechanism 270 at the extension position is capable of fixing a plurality of mopping modules 310, and the plurality of mopping modules include at least one mopping module. As shown in FIG. 32, when the transmission mechanism drives the first blocking sheet telescoping mechanism 270 to move from the extension position to the retraction position, the mopping module 310 fixed above the extension position is released and falls. In this case, the second blocking sheet telescoping mechanism 280 moves to the extension position, to fix the mopping module 310 falling from above. In this case, first-stage release of the mopping modules 310 is completed. As shown in FIG. 33, when the second blocking sheet telescoping mechanism 280 moves from the extension position to the retraction position, a plurality of mopping modules 310 fixed above the second blocking sheet telescoping mechanism 280 fall. In this case, the first blocking sheet telescoping mechanism 270 moves from the retraction position move to the extension position. In an extension process, the first blocking sheet telescoping mechanism 270 can be inserted into a gap between earliest falling first mopping module and the second mopping module, to stop the mopping module above the first mopping module from falling, so that only the first mopping module is released into the second groove 264 of the base station 200, and remaining mopping modules are still fixed above the first blocking sheet telescoping mechanism 270. In this case, second-stage release of the mopping modules is completed. Such cycling is performed, to gradually release the mopping modules 310, so that the second storage unit 212 of the base station 200 releases only one mopping module 310 each time for the cleaning robot to mount. It may be understood that, a relationship between a spacing d between the first blocking sheet telescoping mechanism 270 and the second blocking sheet telescoping mechanism 280 in the vertical direction and a thickness n of each mopping module meets $n<d<2n$. Such a relationship is met, so that when the first mopping module is released from the second blocking sheet telescoping mechanism 280, the first blocking sheet telescoping mechanism 270 is extended and inserted into the gap between the first mopping module and the second mopping module, thereby stopping the mopping module above the first mopping module, so that remaining mopping modules are fixed above the extension position of the first blocking sheet telescoping mechanism 270, to finally release the mopping modules 310 one by one. More specifically, a relationship between a spacing d between the first blocking sheet telescoping mechanism 270 and the second blocking sheet telescoping mechanism 280 in the vertical direction and a thickness n of each mopping module meets $0.2n<d<2n$. Such a relationship is met, so that one mopping module just falls from the second storage unit 212 each time.

The transmission mechanism may asynchronously drive the first blocking sheet telescoping mechanism 270 and the second blocking sheet telescoping mechanism 280 to move, and may alternatively synchronously drive the first blocking sheet telescoping mechanism 270 and the second blocking sheet telescoping mechanism 280 to move. A specific form is not limited. The transmission mechanism in this embodiment of the present disclosure is simultaneously meshed with the first blocking sheet telescoping mechanism 270 and the second blocking sheet telescoping mechanism 280 through the gear and rack structure. When the transmission mechanism moves, the first blocking sheet telescoping mechanism 270 and the second blocking sheet telescoping mechanism 280 synchronously move, and switching between the extension position and the retraction position is implemented through forward rotation and reverse rotation of the motor. Such setting enables each stage of release process of the mopping module to be precise and stable, and a case that the first blocking sheet telescoping mechanism 270 moves, while the second blocking sheet telescoping mechanism 280 does not operate, causing a plurality of mopping modules to be simultaneously released onto the base plate, or a similar case does not occur.

As shown in FIG. 29, the first blocking sheet telescoping mechanism 270 and the second blocking sheet telescoping mechanism 280 respectively include a plurality of telescopic blocking sheets disposed on side walls of the second storage unit, that is, include a plurality of first telescopic blocking sheets 271 and a plurality of second telescopic blocking sheets 281. It may be understood that, a plurality of telescopic blocking sheets are disposed on at least two side walls of the second storage unit 212, and the telescopic blocking sheets disposed on the at least two side walls can play a role in fixing the mopping module 310. In a specific embodiment, the at least two side walls include two opposite side walls. For example, the telescopic blocking sheets in FIG. 29 are disposed on a front wall and a rear wall of the base station 200. Certainly, in another deformed embodiment, the telescopic blocking sheets may be alternatively disposed on a left wall and a right wall of the base station 200, or to improve stability of fixing the mopping module on the telescopic structure, a telescopic blocking sheet may be alternatively disposed on each of three side walls or four side walls of the second storage unit. In this embodiment, the first blocking sheet telescoping mechanism 270 includes four telescopic blocking sheets 271, and the second blocking sheet telescoping mechanism 280 also includes four telescopic blocking sheets 281. Certainly, the quantity of first telescopic blocking sheets 271 may be alternatively different from the quantity of second telescopic blocking sheets 281. In this embodiment, the four telescopic blocking sheets 271 of the first blocking sheet telescoping mechanism and the four telescopic blocking sheets 281 of the second blocking sheet telescoping mechanism are symmetrically disposed in the vertical direction, and a plurality of blocking sheets of each blocking sheet telescoping mechanism are located in the same horizontal plane, to increase structural stability.

Figure 48:
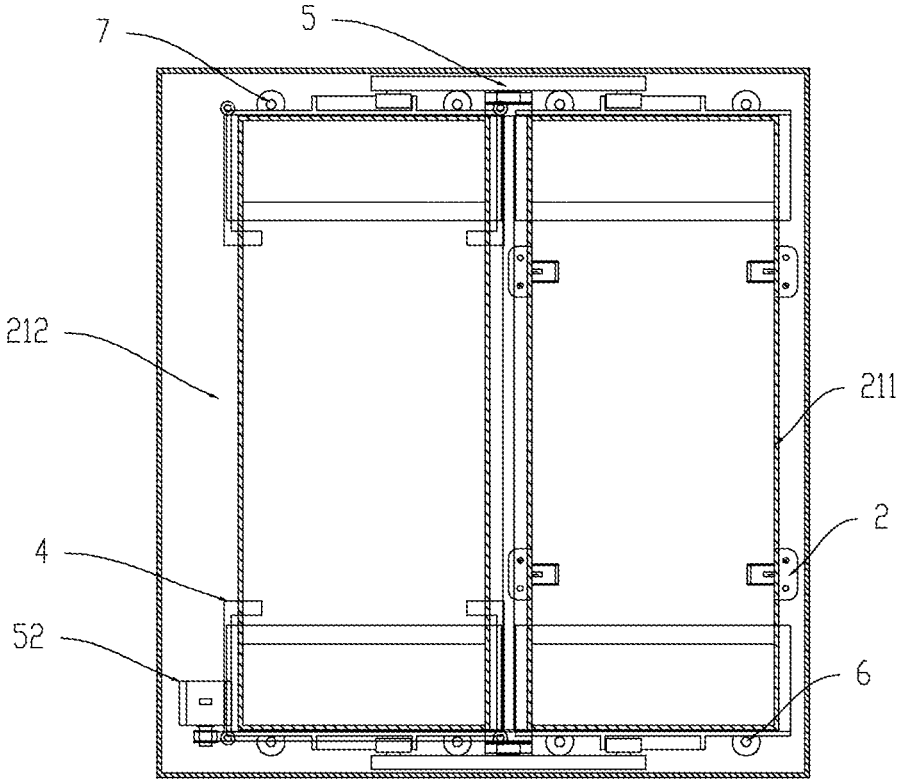
FIG. 48 is a top view of a base station of a cleaning robot according to an embodiment of the present disclosure.
Figure 49:
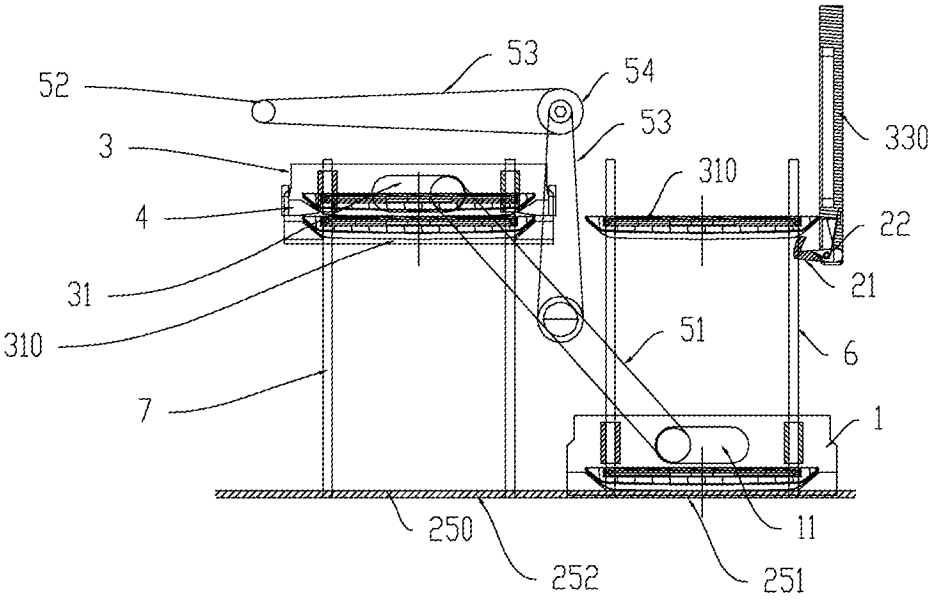
FIG. 49 is a front view of recycling a mopping module by a base station of a cleaning robot according to an embodiment of the present disclosure.
Figure 50:
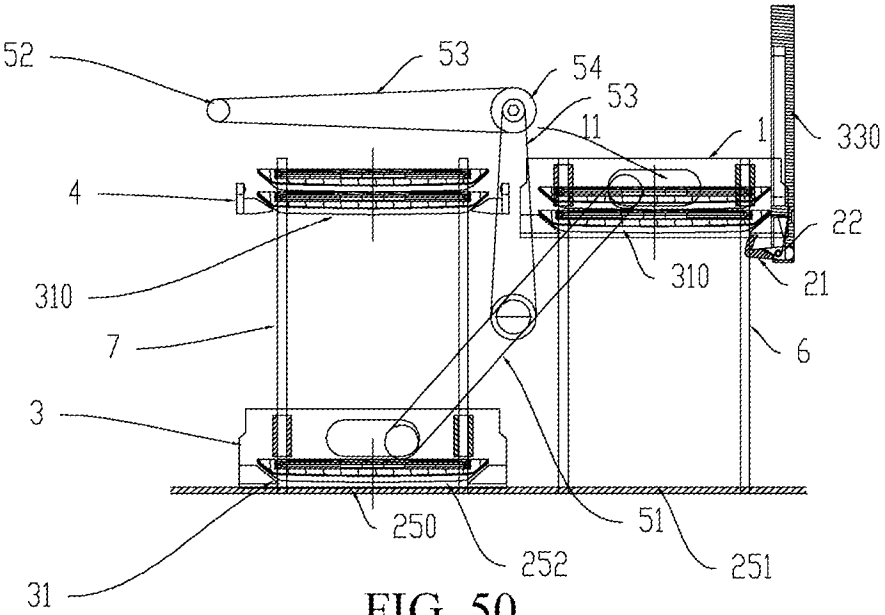
FIG. 50 is a front view of releasing a mopping module by a base station of a cleaning robot according to an embodiment of the present disclosure.

FIG. 48 is a top view of a base station of a cleaning robot according to an embodiment. FIG. 49 is a front view of recycling a first mopping module by a base station of a cleaning robot according to an embodiment of the present disclosure. FIG. 50 is a front view of releasing a second mopping module by a base station of a cleaning robot according to an embodiment of the present disclosure. As shown in the figures, in an embodiment, referring to FIG. 48 to FIG. 50, the base station for a cleaning robot may include: a mopping module collection unit, including: a first mopping module lifting frame, where the first mopping module lifting frame is capable of being driven by the driving member to ascend, to bear and drive the mopping module to move from the first operating position to the first storage unit; and when the first mopping module lifting frame ascends, the mopping module borne by the first mopping module lifting frame is capable of passing through the first supporting assembly; and when the first mopping module lifting frame descends, the first supporting assembly is capable of supporting the mopping module to cause the mopping module to not descend as the first mopping module lifting frame descends; and a mopping module providing unit, including a second mopping module lifting frame, where the second mopping module lifting frame is capable of being driven by the driving member to descend, to bear and drive the mopping module to move from the second storage unit to the second operating position; and when descending, the second mopping module lifting frame is capable of driving at least one mopping module in the second storage unit to descend, and the second supporting assembly is capable of supporting the mopping module in the second storage unit and causing the at least one mopping module in the second storage unit to descend onto the second mopping module lifting frame.

When the mopping module 310 is used by the cleaning robot 100 for mopping to a specific extent or for a specific time and needs to be replaced, the robot travels to the base station 200. In this case, the first mopping module lifting frame 1 is located below, the robot travels to the operating position of the base station 200, the mopping module 310 of the robot is aligned with the first mopping module lifting frame 1, then the mopping module 310 on the robot separated from the cleaning robot is detached, and the detached mopping module 310 separated from the cleaning robot descends onto the first mopping module lifting frame 1. Then, the robot leaves the first mopping module lifting frame 1 or the base station. Specifically, the robot enters the first operating position of the base station, separates the mopping module 310, and places the mopping module 310 on the first mopping module lifting frame 1. Then, the first mopping module lifting frame 1 is driven through the driving member 5 to ascend, the first mopping module lifting frame 1 holds up the mopping module 310 separated from the cleaning robot to ascend, and then reach the first supporting assembly 2, and the first supporting assembly 2 supports the mopping module 310 separated from the cleaning robot to cause the mopping module to not descend as the first mopping module lifting frame 1 descends. Then, the first mopping module lifting frame 1 is capable of descending under driving of the driving member 5, to prepare for next arrival of the robot. A plurality of mopping modules 310 to be replaced are stacked in advance in the second storage unit, and are supported through the second supporting assembly 4, and when the second mopping module lifting frame 3 descends, at least one mopping module 310 is caused to descend from the second supporting assembly 4 of the storage module onto the second mopping module lifting frame 3. When the second mopping module lifting frame 3 continues to descend, the second mopping module lifting frame 3 and the at least one mopping module 310 descending onto the second mopping module lifting frame descend to the bottom. In this case, the robot may travel to the top of the second mopping module lifting frame to automatically mount the mopping module 310 on the second mopping module lifting frame onto the bottom of the robot. Specifically, when the mopping module 310 is mounted, the cleaning robot 100 enters the second operating position of the base station, and mounts the mopping module placed on the second mopping module lifting frame 3 onto the cleaning robot 100. Through the foregoing process, the mopping module used by the robot for mopping is automatically replaced. After a new replacement mopping module 310 is used and dirty, the foregoing steps may be performed, and a plurality of mopping modules 310 may be supported on the first supporting assembly 2.

To better understand the base station 200 for a cleaning robot in this application, the base station is further explained and described below. As shown in FIG. 48 to FIG. 50, the base station 200 for a cleaning robot may include: a mopping module collection unit, a mopping module providing unit, and a driving member 5. The mopping module collection unit includes a first mopping module lifting frame 1 and a first supporting assembly 2.

The first mopping module lifting frame 1 is capable of ascending or descending in the vertical direction, the first mopping module lifting frame 1 is capable of bearing the mopping module 310 separated from the cleaning robot and driving the mopping module 310 separated from the cleaning robot to ascend.

In a feasible implementation, the transfer module of the base station includes at least one guiding rod body, and the first mopping module lifting frame 1 and the second mopping module lifting frame 3 are disposed on the guiding rod body and are slidable along the guiding rod body to ascend or descend. Specifically, the guiding rod body includes a first guiding rod body and a second guiding rod body at least. Specifically, the mopping module collection unit may include at least one first guiding rod body 6, the first guiding rod body 6 extends along the vertical direction, and the lifting frame for the mopping module 310 separated from the cleaning robot is disposed on the first guiding rod body 6 and can slide along the first guiding rod body 6 to ascend or descend. Specifically, to fix the first guiding rod body 6, the base station for a cleaning robot may include a base plate 250, and the first guiding rod body 6 is connected to the base plate 250. The first mopping module lifting frame 1 is provided with a through-hole, and the first mopping module lifting frame 1 is sleeved on the first guiding rod body 6 through the through-hole and can slide along the first guiding rod body 6 to ascend or descend.

In a preferred implementation, there are a plurality of first guiding rod bodies 6, and different positions on the first mopping module lifting frame 1 are provided with a plurality of through-holes. For example, when the first mopping module lifting frame 1 is roughly in the shape of a rectangle on the horizontal plane, and there may be 4 through-holes respectively provided at corners of the rectangle. In this way, when the first mopping module lifting frame 1 slides along the first guiding rod body 6, stability of the entire first mopping module lifting frame 1 can be ensured, and smoothness of ascending and descending is improved.

When the first mopping module lifting frame 1 descends onto the bottom along the first guiding rod body 6, that is, falls onto the base plate 250, the robot needing to replace the mopping module travels onto the first mopping module lifting frame 1, the robot is automatically detached from the dirty mopping module at the bottom of the robot, and the detached mopping module descends onto the base plate. Specifically, the cleaning robot moves to the first operating position 251, the cleaning robot separates the mopping module and places the mopping module on the first operating position of the base plate. That is to say, the mopping module 310 separated from the cleaning robot descends onto the first mopping module lifting frame 1.

As shown in FIG. 48 to FIG. 50, the first supporting assembly 2 can limit the mopping module 310, on the first mopping module lifting frame 1, separated from the cleaning robot and cause the mopping module 310 to not descend with the first mopping module lifting frame 1. In a feasible implementation, the first supporting assembly 2 may include a rotatable limit member 21; and a reset member 22 configured to drive the limit member 21 to be reset. The limit member 21 is preferably configured to rotate in a vertical plane. Usually, a torsion spring or a spring may be used as the reset member 22. When a torsion spring is used, the torsion spring and the limit member 21 are sleeved on the same rotatable shaft, and the torsion spring may separately butt the limit member 21 and the rotatable shaft, or may butt the limit member 21 and another near immobile component. When a spring is used, the limit member 21 is sleeved on a rotatable shaft, one end of the spring is connected to the limit member 21, and the other end of the spring is connected to another near immobile component.

The limit member 21 has at least two states, and when the limit member 21 is in a first state, the first mopping module lifting frame 1 when ascend is capable of causing the mopping module 310 on the first mopping module lifting frame 1 to pass through the limit member 21; and when the limit member 21 is in a second state, the limit member 21 is capable of propping the mopping module 310.

Usually, the limit member 21 is in the second state. When the first mopping module lifting frame 1 ascends to the limit member 21, the first mopping module lifting frame 1 butts the limit member 21 to cause the limit member 21 to rotate, and the limit member 21 overcomes a force of the reset member 22 to rotate. Then, the limit member 21 is in the first state, and the first mopping module lifting frame 1 is capable of ascending to the top of the limit member 21. Then, the limit member 21 restores to the second state under the action of the force of the reset member 22. When the first mopping module lifting frame 1 descends, the mopping module 310, on the first mopping module lifting frame 1, separated from the cleaning robot is propped by the limit member 21, so that the mopping module 310 does not descend, and is recycled and stacked on the limit member 21. In this way, the dirty mopping module 310 separated from the cleaning robot is stored.

In a feasible implementation, there may be a plurality of limit members 21 and matching reset members 22, and the plurality of limit members 21 are capable of propping different positions at edges of the mopping module 310 separated from the cleaning robot, thereby ensuring stability of propping the mopping module 310 separated from the cleaning robot, so that the mopping module 310 separated from the cleaning robot does not fall.

In a feasible implementation, the base station 200 for a cleaning robot may include: a first mopping module recycling bracket 330 extending along the vertical direction. The limit member 21 and the reset member 22 may be mounted on the first mopping module recycling bracket 330, the first mopping module recycling bracket 330 is located on a side of the mopping module 310 separated from the cleaning robot and stacked on the limit member 21, and when there are a plurality of dirty mopping modules 310 separated from the cleaning robot and stacked on the limit member 21, the mopping modules 310 separated from the cleaning robot and stacked on the limit member 21 may be prevented from falling.

As shown in FIG. 48 to FIG. 50, the mopping module providing unit may include a second mopping module lifting frame 3, the supporting assembly includes a second supporting assembly 4, and the mopping module providing unit includes a second supporting assembly 4. The second mopping module lifting frame 3 can ascend or descend in the vertical direction. The second mopping module lifting frame 3 when descending can drive at least one mopping module 310 to descend. The first mopping module lifting frame 1 and the second mopping module lifting frame 3 may be distributed abreast.

In a feasible implementation, as shown in FIG. 49 and FIG. 50, the transfer module further includes at least one second guiding rod body 7, the second guiding rod body 7 extends along the vertical direction, and the second mopping module lifting frame 3 is disposed on the second guiding rod body 7 and can slide along the second guiding rod body 7 to ascend or descend. To fix the second guiding rod body 7, the first guiding rod body 6 may be connected to the base plate 250. The second mopping module lifting frame 3 is provided with a through-hole, and the second mopping module lifting frame 3 is sleeved on the second guiding rod body 7 through the through-hole and can slide along the second guiding rod body 7 to ascend or descend.

In a preferred implementation, as shown in FIG. 49 and FIG. 50, there are a plurality of second guiding rod bodies 7, and different positions on the second mopping module lifting frame 3 are provided with a plurality of through-holes. For example, when the second mopping module lifting frame 3 is roughly in the shape of a rectangle on the horizontal plane, and there may be 4 through-holes respectively provided at corners of the rectangle. In this way, when the second mopping module lifting frame 3 slides along the second guiding rod body 7, stability of the entire second mopping module lifting frame 3 can be ensured, and smoothness of ascending and descending is improved.

When the second mopping module lifting frame 3 carrying at least one mopping module 310 obtained from the second storage unit 212 descends to the bottom along the second guiding rod body 7, that is, falls onto the base plate 250, the robot on which a clean mopping module is mounted needs to travel onto the second mopping module lifting frame, and the robot automatically mounts the mopping module 310 on the second mopping module lifting frame onto the bottom of the robot, and then leaves the second mopping module lifting frame, to continue to perform programmed mopping work.

Figure 52:
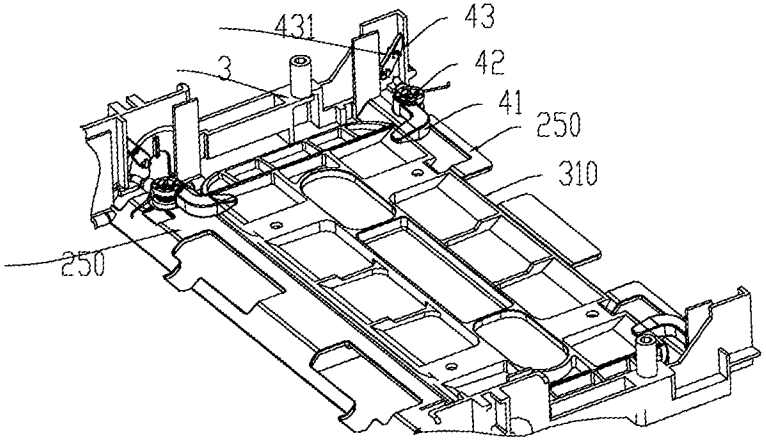
FIG. 52 is a schematic structural diagram of a second supporting assembly of a base station of a cleaning robot according to an embodiment of the present disclosure.

FIG. 52 is a schematic structural diagram of a second supporting assembly of a base station of a cleaning robot according to an embodiment of the present disclosure. As shown in FIG. 49, FIG. 50, and FIG. 52, the second supporting assembly 4 may include a rotatable clamping member 41; and a pressure biasing member 42 configured to drive the clamping member 41 to be reset. The clamping member 41 is roughly configured to rotate in a horizontal direction. The clamping member 41 may be mounted on a component fixed at another near position. For example, the base station 200 for a cleaning robot may include: a fixing framework 500, where the clamping member 41 and the pressure biasing member 42 are mounted on the fixing framework 500. The fixing framework 500 may be connected to the base plate 250 to implement position fixing. Usually, a torsion spring or a spring may be used as the pressure biasing member 42. When a torsion spring is used, the torsion spring and the clamping member 41 are sleeved on the same rotatable shaft, and the torsion spring may separately butt the clamping member 41 and the rotatable shaft, or may butt the clamping member 41 and another near immobile component such as the fixing framework 500. When a spring is used, the clamping member 41 is sleeved on a rotatable shaft, one end of the spring is connected to the clamping member 41, and the other end of the spring is connected to another near immobile component such as the fixing framework 500.

The clamping member 41 has at least two positions, and when the clamping member 41 is at the first position, the second mopping module lifting frame 3 when descending is capable of causing at least one mopping module placed on the clamping member 41 to be detached from the clamping member 41; and when the clamping member 41 is at the second position, the clamping member 41 is capable of propping the mopping module 310.

To cause the mopping module 310 placed on the clamping member 41 to be detached from the clamping member 41 when the second mopping module lifting frame 3 descends, as shown in FIG. 52, the second supporting assembly 4 may include: a guiding member 43 mounted on the second mopping module lifting frame 3, where the guiding member 43 has a guiding surface 431. There is a preset angle between the guiding surface 431 and the vertical direction, and the preset angle is greater than 0 degrees and less than 90 degrees.

When the second mopping module lifting frame 3 descends, the guiding surface 431 butts one end of the clamping member 41, the one end of the clamping member 41 deflects under the action of the guiding surface 431, and then the clamping member 41 is rotated, so that the other end of the clamping member 41 is detached from the mopping module 310. In this case, at least one lowest mopping module 310 of the stacked mopping modules 310 falls onto the second mopping module lifting frame 3. In the foregoing manner, through displacement of the second mopping module lifting frame 3 in the vertical direction and cooperation with the guiding surface 431, the clamping member 41 is rotated on the horizontal plane.

After the second mopping module lifting frame 3 continues to descend, and one end of the clamping member 41 is detached from the guiding surface 431, the clamping member 41 is rotated under driving of the pressure biasing member 42, so that the other end of the clamping member 41 approaches the mopping module 310. In this case, the other end of the clamping member 41 is at least inserted between the first mopping module 310 and the second mopping module 310 counted from bottom to top on the second mopping module lifting frame 3. In this way, the clamping member 41 is capable of propping the second mopping module 310 and a mopping module 310 above the second mopping module. The first mopping module 310 is placed on the second mopping module lifting frame 3, and is capable of continuing to descend to the bottom with the second mopping module lifting frame 3. In this case, the robot from which the dirty mopping module 310 is dismount may travel to the top of the second mopping module lifting frame to automatically mount the mopping module 310 on the second mopping module lifting frame onto the bottom of the robot. Through the foregoing process, the mopping module used by the robot for mopping is automatically replaced. After a new replacement mopping module is used and dirty, the foregoing steps may be performed, and a plurality of mopping modules may be supported on the second supporting assembly 4. The robot may adsorb the mopping module in a magnetic adsorption manner, and provided that a magnetic force is removed when the mopping module needs to be dismounted, the mopping module automatically descends.

In this application, the first mopping module lifting frame 1 and the second mopping module lifting frame 3 collect and store the mopping modules 310 separated from the cleaning robot in an ascending and descending manner and sequentially release the stored mopping modules 310. In the manner, the structure is simple, stability of the system is relatively good, and a stuck phenomenon and the like are not easy occur, so that the base station for a cleaning robot can normally run for a long time. In a feasible implementation, as shown in FIG. 48, there may be a plurality of clamping members 41 and matching pressure biasing members 42, and the plurality of clamping members 41 are capable of propping different positions at edges of the mopping module 310, thereby ensuring stability of propping the mopping module 310, so that the mopping module 310 does not fall.

In the foregoing process, the mopping module 310 separated from the cleaning robot may be understood as a dirty mopping module replaced from the robot. The mopping module 310 may be understood as a clean mopping module that is stored on the clamping member 41 in the base station for a cleaning robot in advance in a stacked form and is at least one in quantity. Specifically, the clamping member is located in the second storage unit 212.

In a feasible implementation, as shown in FIG. 49 and FIG. 50, the bottom of the first mopping module lifting frame 1 is in a concave shape, and two sides of the concave shape are inclined surfaces, and the shape of the bottom matches the structure of the edge of the bottom of the mopping module 310 separated from the cleaning robot, so that the mopping module 310 separated from the cleaning robot is capable of falling into the first mopping module lifting frame 1 as accurately as possible and is located in the middle of the first mopping module lifting frame 1, to prevent the mopping module 310 separated from the cleaning robot from deviating. Certainly, the second mopping module lifting frame 3 may also similarly have the foregoing structure, and details are not described herein again.

As shown in FIG. 48, in a feasible implementation, the base station 200 for a cleaning robot may include a housing, components such as the mopping module collection unit, the mopping module providing unit, and the driving member 5 may be mounted in the housing, and meanwhile, the second storage unit 212 and the first storage unit 211 may be further disposed in the housing. In this way, it may be convenient to stack the mopping module 310 separated from the cleaning robot on the limit member 21, and stack the mopping module 310 on the clamping member 41. Specifically, the limit member is located in the first storage unit 211, and the clamping member is located in the second storage unit 212.

As shown in FIG. 49 and FIG. 50, the driving member 5 is in transmission connection to the first mopping module lifting frame 1 and the second mopping module lifting frame 3, so that the first mopping module lifting frame 1 and the second mopping module lifting frame 3 ascend or descend. In a feasible implementation, the first mopping module lifting frame 1 is provided with a first opening 11, and the first opening 11 may extend along the horizontal direction; and the second mopping module lifting frame 3 is provided with a second opening 31, and the second opening 31 may extend along the horizontal direction; and The driving member 5 may include: a rotatable member 51, where one end of the rotatable member 51 is inserted into the first opening 11 and is slidable in the first opening 11, and the other end of the rotatable member 51 is inserted into the second opening 31 and is slidable in the second opening 31; and a motor 52, where the motor 52 is configured to drive the rotatable member 51 to cause the rotatable member 51 to rotate around a point between the two ends. When the rotatable member 51 rotates counterclockwise around a point between the two ends, a left end of the rotatable member 51 slides in the second opening 31 and drives the second mopping module lifting frame 3 to descend. A right end of the rotatable member 51 slides in the first opening 11 and drives the first mopping module lifting frame 1 to ascend. When the rotatable member 51 rotates clockwise around a point between the two ends, the left end of the rotatable member 51 slides in the second opening 31 and drives the second mopping module lifting frame 3 to ascend, and the right end of the rotatable member 51 slides in the first opening 11 and drives the first mopping module lifting frame 1 to descend. Preferably, there may be two first openings 11, respectively located at two ends of the first mopping module lifting frame 1, and there may be two second openings 31, respectively located at two ends of the second mopping module lifting frame. The rotatable member 51 may include two rotatable rod bodies respectively located at two ends of the first mopping module lifting frame 1 and a shaft body connecting the two rotatable rod bodies, and each rotatable rod body matches a first opening 11 and a second opening 31 that are located at the same end; and the motor 52 drives, through a synchronization belt 53, the rotatable member 51 to rotate. In this manner, ascending and descending of the first mopping module lifting frame 1 and the second mopping module lifting frame 3 are simultaneously driven respectively at two ends through the rotatable member 51, and the entire ascending and descending process is more stable and reliable.

To make it convenient to mount the motor 52, to cause the motor 52 to be located on a side of the entire base station, transmission between the motor 52 and the rotatable member 51 may be implemented through a plurality of synchronization belts 53 and a plurality of belt pulleys 54. For example, as shown in FIG. 49 and FIG. 50, the motor 52 is disposed above the left of the base station, the belt pulley 54 is disposed above the middle of the base station, transmission between the belt pulley 54 and the motor 52 is performed through a synchronization belt 53, the rotatable member 51 is disposed in the middle of the base station, and transmission between the rotatable member 51 and the belt pulley 54 is performed through a synchronization belt 53. In this way, rotation of the motor 52 can be transferred onto the rotatable member 51, and meanwhile, clockwise rotation and counterclockwise rotation of the rotatable member 51 can be implemented.

Specifically, the rotational belt extensible along the vertical direction is disposed between the first mopping module lifting frame and the second mopping module lifting frame, and the motor is disposed at one end, of the rotational belt extensible along the vertical direction, opposite to a remote end of a base plate of the base station. Moreover, the driving member further includes: a rotational belt extensible along a horizontal direction connected to the rotational belt extensible along the vertical direction, where the motor is disposed at one end, of the rotational belt extensible along the horizontal direction, far away from a remote end of the storage module.

Figure 51:
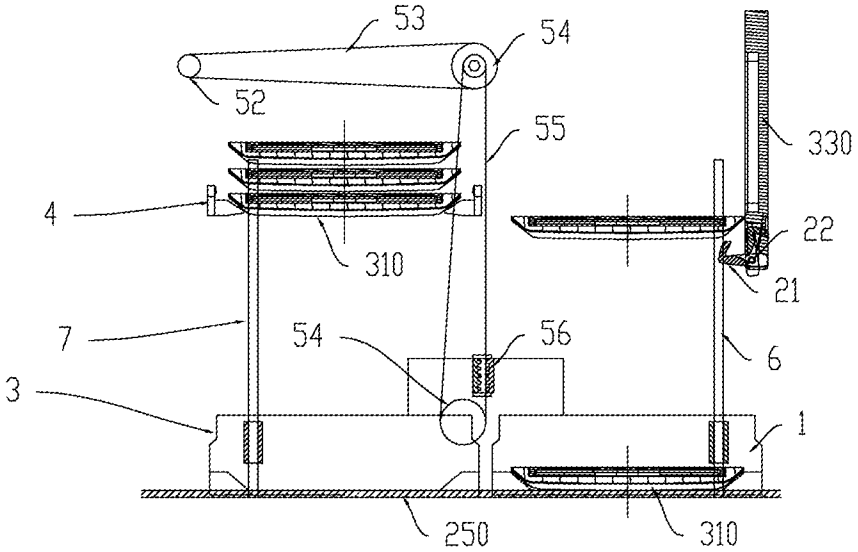
FIG. 51 is a front view of a driving member of a base station of a cleaning robot according to an embodiment of the present disclosure in another implementation.

FIG. 51 is a top view of a driving member of a base station of a cleaning robot according to an embodiment of the present disclosure in another implementation. As shown in FIG. 51, the first mopping module lifting frame 1 and the second mopping module lifting frame 3 synchronously move. When the first mopping module lifting frame 1 and the second mopping module lifting frame 3 synchronously ascend, the first mopping module lifting frame 1 drives the mopping module 310 placed on the first mopping module lifting frame to ascend; and when the mopping module 310 separated from the cleaning robot ascends to a height exceeding the limit member 21, the limit member 21 props the mopping module 310 separated from the cleaning robot. Meanwhile, during ascending, the second mopping module lifting frame 3 triggers the clamping member 41 in the second supporting assembly 4 to rotate, so that a lowest one of the mopping modules 310 stored on the clamping member 41 descends onto the second mopping module lifting frame 3. When the first mopping module lifting frame 1 and the second mopping module lifting frame 3 synchronously descend, the first mopping module lifting frame 1 directly descends, and does not carry any mopping module 310, and meanwhile, the second mopping module lifting frame 3 descends, and carries a descending clean mopping module 310 during descending, to cause the clean mopping module to descend to a lower position, for the robot to perform replacement with the clean mopping module.

In a feasible implementation, the driving member 5 may include: a rotational belt 55 extensible along the vertical direction; and a motor 52 configured to drive the rotational belt 55. The first mopping module lifting frame and the second mopping module lifting frame 3 may be fixed to the rotational belt 55 through a fixing buckle 56, so that the rotational belt 55 can drive the mopping module 310 separated from the cleaning robot to ascend or descend and the second mopping module lifting frame 3 to ascend or descend. Preferably, the mopping module 310 separated from the cleaning robot and the second mopping module lifting frame 3 may be an integrated structure. In a feasible manner, when the first mopping module lifting frame and the second mopping module lifting frame move in the vertical direction, and there is no relative movement between the first mopping module lifting frame and the second mopping module lifting frame, so that the first mopping module lifting frame and the second mopping module lifting frame synchronously move. Before the cleaning robot enters the base station to replace the mopping module, the first mopping module lifting frame descends. Meanwhile, the second mopping module drives a mopping module to descend, and the cleaning robot enters the base station, separates the dirty mopping module and places the dirty mopping module onto the first mopping module lifting frame. The cleaning robot continues to advance, and mounts the mopping module placed on the second mopping module lifting frame onto the cleaning robot. Subsequently, the cleaning robot leaves the base station, the first mopping module lifting frame and the second mopping module lifting frame synchronously ascend, the dirty mopping module on the first mopping module lifting frame is taken in through the limit member, and meanwhile a clean mopping module is placed on the second mopping module lifting frame to wait for next arrival of the cleaning robot. Preferably, the first mopping module lifting frame and the second mopping module lifting frame may serve as a whole structure, that is, the first mopping module lifting frame and the second mopping module lifting frame move upward or downward as a whole. No relative movement between the first mopping module lifting frame and the second mopping module lifting frame can simplify the structure of the base station for a cleaning robot, and improve working stability of the base station. Meanwhile, because the first mopping module lifting frame 1 and the second mopping module lifting frame 3 may be fixed to the rotational belt 55 through the fixing buckle 56, the first mopping module lifting frame 1 and the second mopping module lifting frame 3 simultaneously ascend when the motor 52 drives the rotational belt 55 to ascend. When ascending, the first mopping module lifting frame 1 transports the dirty mopping module replaced from the robot onto the limit member 21 for propping. When the motor 52 drives the rotational belt 55 to descend, the mopping module 310 separated from the cleaning robot and the second mopping module lifting frame 3 simultaneously descend. When descending, the second mopping module lifting frame 3 carries and transports a lowest mopping module 310 stored on the clamping member 41 to the bottom, for the robot to replace the mopping module.

For example, the rotational belt 55 may be in the shape of a ring, and the base station for a cleaning robot includes: two belt pulleys 54 arranged up and down, where the rotational belt 55 is sleeved on the belt pulleys 54, the motor 52 drives, through a synchronization transmission belt, one of the belt pulleys 54 to rotate, thereby implementing counterclockwise rotation and clockwise rotation of the rotational belt 55, and the rotational belt 55 is capable of driving the first mopping module lifting frame 1 and the second mopping module lifting frame 3 to ascend or descend. Certainly, the transmission belt may be alternatively in the shape of a strip, the base station for a cleaning robot includes only one rotatable shaft, and the motor 52 drives the rotatable shaft to rotate, and the transmission belt is capable of winding around the transmission shaft, to control ascending and descending of the first mopping module lifting frame 1 and the second mopping module lifting frame 3 through winding and releasing during rotation.

In the foregoing several implementations, both the first mopping module lifting frame 1 and the second mopping module lifting frame 3 ascend and descend through the same driving member 5, and the driving member 5 drives the first mopping module lifting frame 1 and the second mopping module lifting frame 3 to synchronously ascend or synchronously descend or drives one to ascend and the other to descend. In this way, synchronization between the first mopping module lifting frame 1 and the second mopping module lifting frame 3 may be relatively good, and the structure of the entire driving member 5 is simple and relatively compact.

This application further provides a cleaning robot system, including: any one of the foregoing base stations for a cleaning robot that are described above; and a cleaning robot, where a cleaning element is capable of being mounted on the cleaning robot, the cleaning robot is capable of separating and/or mounting the cleaning element from and/or on the base station for a cleaning robot, and the cleaning element is a mopping module 310.

In a feasible implementation, the base station for a cleaning robot includes a charging module, and the charging module provides energy to the cleaning robot when the cleaning robot docks to the base station. The cleaning robot returns, when being at a low power level, to the base station for a cleaning robot and leaves, after being charged fully, the base station for a cleaning robot, to continue to perform cleaning work.

Figure 40:
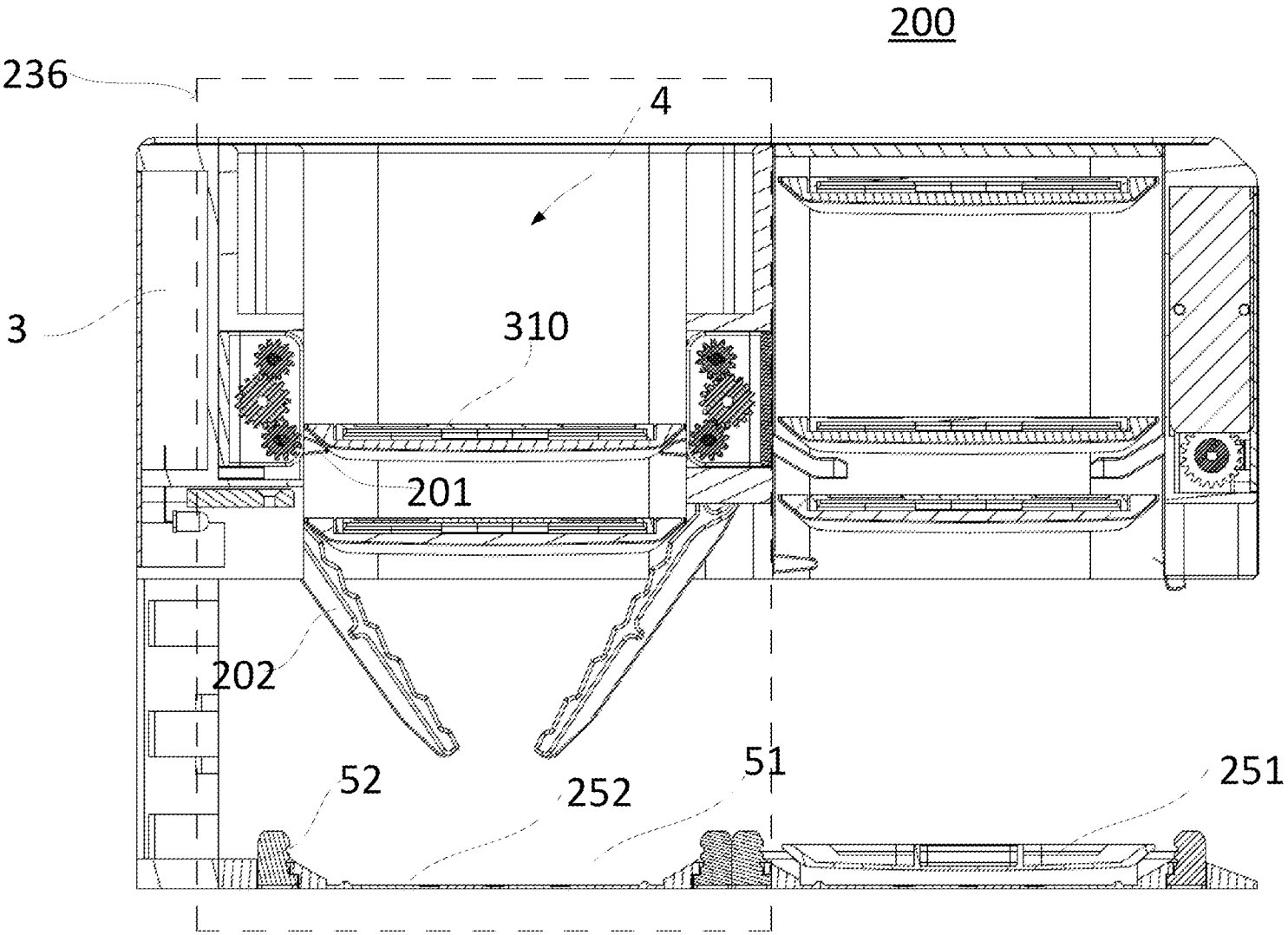
FIG. 40 is a schematic structural diagram of a base station according to an embodiment of this application.

An embodiment of this application provides a base station 200, referring to FIG. 40 to FIG. 47. When the cleaning robot needs to perform replacement with a new mopping module 310 such as a mopping paper or mopping cloth, the base station 200 may deliver, through the mopping module providing unit 236, the stored mopping module 310, to make it convenient for the cleaning robot to perform replacement with the new mopping module 310, thereby reducing intervention of the user and improving user experience. As shown in FIG. 40, the base station further includes a mopping module collection unit, thereby automatically recycling an old mopping module 310 and automatically replacing the old mopping module with a new mopping module 310.

In this embodiment, the base station 200 includes: a housing 3; a second supporting assembly disposed on the housing 3, where the second supporting assembly includes a first supporting mechanism 201; and a second supporting mechanism 202 disposed on the housing 3. On the housing 3, there are a storage module 210 in which mopping modules 310 are stacked, and an operating position located below the storage module 210. The first supporting mechanism 201 has a supporting state of supporting the mopping module 310 and a retraction state of not supporting the mopping module 310. The second supporting mechanism 202 has a holding-up state of supporting the mopping module 310 in the storage module 210 and an open state of releasing at least one mopping module 310 to the operating position.

Figure 42:
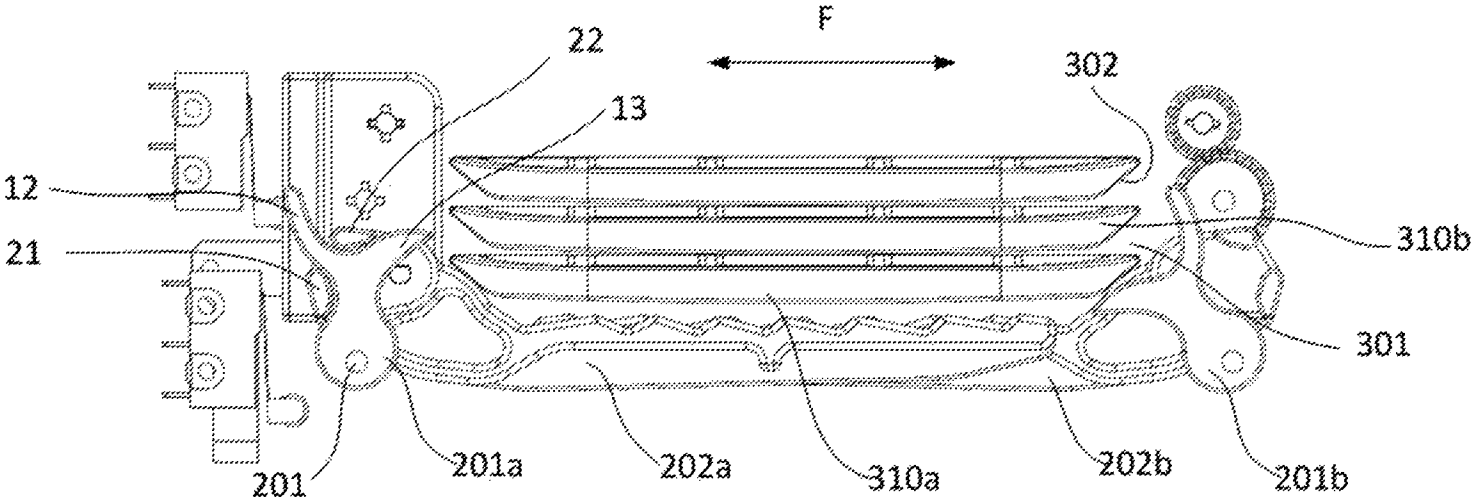
FIG. 42 is a schematic diagram of an initial state of a mopping module providing unit in FIG. 40.
Figure 45:
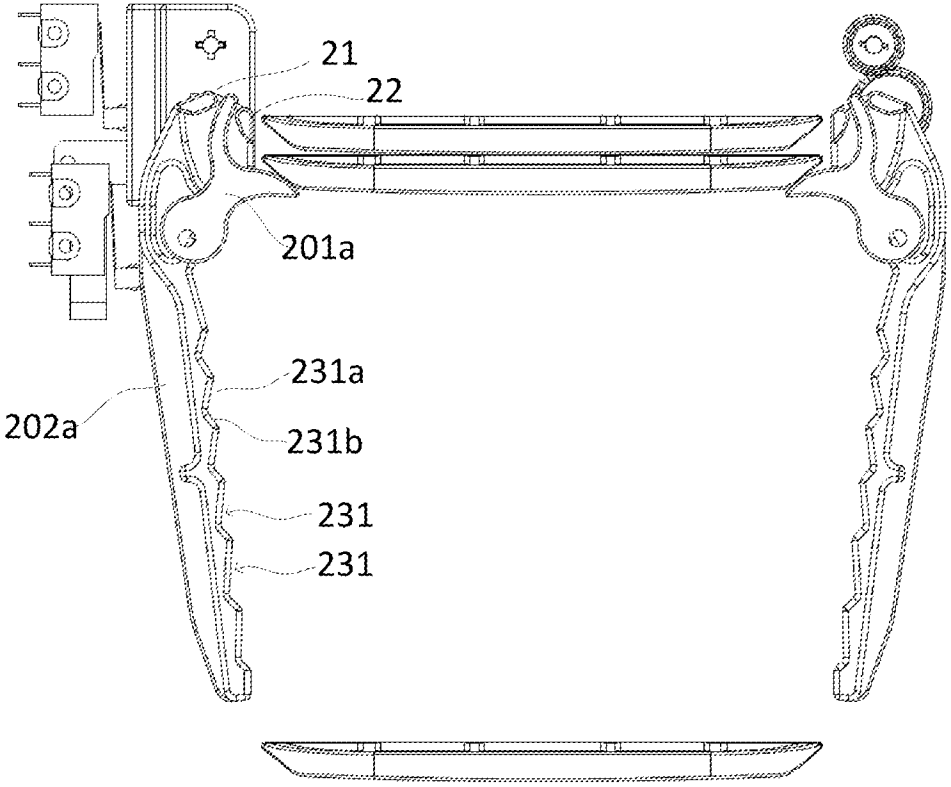

As shown in FIG. 42, when the second supporting mechanism 202 is in the holding-up state, the first supporting mechanism 201 is in the retraction state. As shown in FIG. 45, when the second supporting mechanism 202 is in the open state, the first supporting mechanism 201 is in the supporting state to support remaining mopping modules 310 in the storage module 210.

The base station 200 provided in this embodiment is provided with the first supporting mechanism 201 and the second supporting mechanism 202 matching each other, so that when the cleaning robot needs to replace a mopping module 310, the second supporting mechanism 202 is switched to the open state, at least one mopping module 310 is delivered the operating position, and the cleaning robot enters the operating position to replace the mopping module 310 at the operating position. Correspondingly, remaining mopping modules 310 in the storage module 210 are supported by the first supporting mechanism 201 to avoid falling, until the second supporting mechanism 202 is reset to the holding-up state to support the mopping module 310 again until the cleaning robot performs replacement again with a new mopping module 310. Therefore, when being applied to a scenario of replacing a mopping module 310, the base station 200 provided in this embodiment is capable of automatically delivering a mopping module 310, thereby automatically replacing the mopping module 310, reducing intervention by a user in mopping module 310 replacement, and improving user experience.

In this embodiment, when being in the holding-up state, the second supporting mechanism 202 supports the mopping module 310 in the storage module 210, and the first supporting mechanism 201 is in the retraction state. The second supporting mechanism 202 releases, when being in the open state, at least one mopping module 310 to the operating position, and the first supporting mechanism 201 supports, when being in the supporting state, remaining mopping modules 310 in the storage module 210. In this way, the first supporting mechanism 201 matches the second supporting mechanism 202, and mopping modules 310 may be delivered one by one, to make it convenient for the cleaning robot to replace a single mopping module 310 at a single time.

Certainly, in another embodiment, the base station 200 may further deliver two or even more mopping modules 310 at each time, to allow two or more cleaning robots to perform replacement with new mopping modules 310. This is not particularly limited in this application.

In this embodiment, a plurality of mopping modules 310 are stacked in the storage module 210. Specifically, the plurality of mopping modules 310 are stacked in the second storage unit 212 of the storage module 210 and are supported by the second supporting mechanism 202 to prevent falling, where the second supporting mechanism 202 is located in the second storage unit. The mopping module 310 has a specific structural rigidity, and is capable of maintaining a basic shape under supporting of the first supporting mechanism 201 or the second supporting mechanism 202. The mopping module 310 may be a mopping board to which a mopping paper or mopping cloth is attached. Additionally, the mopping module 310 may have a bracket to which a mopping paper or mopping cloth is attached, and the bracket may be a rigid bracket. Certainly, the material of the bracket may be a metal or plastic material, provided that the bracket can keep the entire shape unchanged.

The second storage unit 212 is wholly in a cuboid structure, and correspondingly, the mopping module 310 is wholly in a rectangular board body structure. The first supporting mechanism 201 and the second supporting mechanism 202 are located on two sides at the bottom of the second storage unit 212, to support the mopping module 310 in different states. The mopping module 310 in the storage module 210 is a clean mopping module 310, that is, a mopping module 310 with which replacement is to be performed. Specifically, the operating position is located below the storage module 210. Specifically, the second operating position 252 is located below the second storage unit 212, and the robot may enter the base station, dock at the second operating position 252, and mount the clean mopping module 310 at the second operating position 252.

The second operating position 252 is located below the second storage unit 212, and is configured to receive the mopping module 310 delivered through the second supporting mechanism 202. The operating position has a carrying groove for holding a mopping module 310. A minimum distance between the second supporting mechanism 202 and the carrying groove bottom of the groove is greater than a thickness of a single mopping module 310. There may be an opening formed on a side of a groove wall 52 of the carrying groove 51, to make it convenient for the cleaning robot to enter or leave. Certainly, the groove wall 52 of the carrying groove 51 may further limit the mopping module 310, to avoid a case that when the cleaning robot enters or leaves, the mopping module 310 is displaced, to affect smooth replacement.

The first supporting mechanism 201 and the second supporting mechanism 202 are located on two sides at the bottom of the storage module 210, and the first supporting mechanism 201 or the second supporting mechanism 202 supports the mopping module 310 in different states. The retraction state of the first supporting mechanism 201 and the open state of the second supporting mechanism 202 are similar. In either of the two states, the mopping module 310 in the storage module 210 is not supported, but supporting or limiting on the mopping module 310 is removed. Correspondingly, to avoid a case that all mopping modules 310 fall, supporting time points of the first supporting mechanism 201 and the second supporting mechanism 202 are mutually staggered, to deliver only the mopping module 310 with which replacement is to be performed, and keep remaining mopping modules 310 stored in the second storage unit 212.

The second supporting mechanism 202 and the first supporting mechanism 201 are linked. In this way, when the first supporting mechanism 201 and the second supporting mechanism 202 need to be driven or positions of the second supporting mechanism 202 and the first supporting mechanism 201 need to be detected, driving may be performed only in need of a single energy module, and similarly, a position state of only one supporting mechanism needs to be obtained to learn a position state of the other supporting mechanism, thereby reducing the quantity of sensors and reducing the costs.

In this embodiment, the first supporting mechanism 201 and the second supporting mechanism 202 are provided with linked structures (for example, limit protrusions 21 and 22, and a dial rod 12 described below). Through the linked structures, the first supporting mechanism 201 drives, when acting, the second supporting mechanism 202 to act, or the second supporting mechanism 202 drives, when acting, the first supporting mechanism 201 to act. In the embodiment shown in FIG. 40, the second supporting mechanism 202 drives, when acting, the first supporting mechanism 201 to act.

In another embodiment, the first supporting mechanism 201 and the second supporting mechanism 202 may be provided with no linked structure, and may be each independently equipped with an energy module, to mutually independently rotate, and actions of the two are controlled through a controller to achieve mutually staggered supporting time points.

In this embodiment of this application, the first supporting mechanism 201 switches between the supporting state and the retraction state through an action, and the second supporting mechanism 202 switches between the holding-up state and the open state through an action. Action forms of the first supporting mechanism 201 and the second supporting mechanism 202 may be back-and-forth rotation, back-and-forth telescoping, or translational movement, and the action forms of the two may be the same or different. This is not uniquely limited in this application. Preferably, the first supporting mechanism 201 switches between the supporting state and the retraction state through rotation, and the second supporting mechanism 202 switches between the holding-up state and the open state through rotation.

The first supporting mechanism 201 and the second supporting mechanism 202 have specific action ranges, and the supporting state and the retraction state, and the holding-up state and the open state may be an initial position and a final position or an initial state and a final state of the respective action ranges. For example, if the action form is translation or rotation, the first supporting mechanism 201 and the second supporting mechanism 202 has a back-and-forth translation range and back-and-forth rotation range with a specific distance or angle, and the supporting state and the retraction state, and the holding-up state and the open state may be endpoint positions or endpoint states of the translation range and the rotation range.

Specifically, the first supporting mechanism 201 is capable of rotating around a first rotational axis. The first supporting mechanism 201 switches between the supporting state and the retraction state through rotation. The second supporting mechanism 202 is capable of rotating around a second rotational axis 11. The second supporting mechanism 202 switches between the holding-up state and the open state through rotation. The first rotational axis and the second rotational axis 11 are parallel to each other. In the embodiment shown in FIG. 40 to FIG. 44, when rotating around the second rotational axis 11, the second supporting mechanism 202 drives the first supporting mechanism 201 to rotate around the first rotational axis (that is, an axis of a pivoting shaft 402).

In the embodiment shown in FIG. 40 to FIG. 44, the second supporting mechanism 202 includes a supporting board (201*a*, 202*b*). One end of the supporting board is a connection end 25 connected to the pivoting shaft 402, and the other end is a free end 26. The pivoting shaft 402 is rotatably mounted on the housing 3. The pivoting shaft 402 may be driven by the energy module, and the pivoting shaft 402 drives the supporting board to rotate around the first rotational axis.

The first supporting mechanism 201 includes a rotatable stop board (201*a*, 201*b*) configured to rotate around the second rotational axis 11. A supporting rod 13 is disposed on the rotatable stop board. The supporting rod 13 is, when being in the retraction state, located outside the storage module 210, and stretches, when being in the supporting state, into the second storage unit 212.

To make it convenient for the first supporting mechanism 201 and the second supporting mechanism 202 to be linked, a dial rod is further disposed on the rotatable stop board. The rotatable stop board is located on a side of the supporting board along an axial direction of the first rotational axis. The axial direction along the first rotational axis is a front-rear direction facing FIG. 42, and correspondingly, the rotatable stop board may be mounted on a front side or rear side of the supporting board. As shown in FIG. 42, the rotatable stop board is disposed on a front side of the supporting board.

A side surface of the supporting board at the connection end 25 is provided with a first limit protrusion 21 and a second limit protrusion 22. The first limit protrusion 21 and the second limit protrusion 22 are circumferentially spaced apart by a specific distance, a gap is formed between the first limit protrusion 21 and the second limit protrusion 22, and the dial rod is threaded between the first limit protrusion 21 and the second limit protrusion 22 through the gap. The dial rod is located between the first limit protrusion 21 and the second limit protrusion 22, and is limited by the first limit protrusion 21 and the second limit protrusion 22 during rotation.

To make it convenient for the first supporting mechanism 201 to be inserted between two neighboring mopping modules 310, then bear remaining mopping modules 310, and prevent the remaining mopping modules 310 from falling, there is a gap 301 between the two neighboring mopping modules 310, and the first supporting mechanism 201 may be insert into the gap 301 to bear the mopping module 310 above the first supporting mechanism. As shown in FIG. 42, there is a structure of a landing edge 302 between edges of mopping modules 310; and there is a gap 301 between structures of landing edges 302 of two vertically neighboring direction mopping modules 310, the mopping modules 310 have main body parts between the structures of the landing edges 302, and the main body parts of the two vertically neighboring mopping modules 310 are in contact with each other and bear each other. The supporting rod 13 may support the edge of the mopping module 310, and stretches into the storage module 210 by a relatively small length.

The second supporting mechanism 202 and the first supporting mechanism 201 linked to the second supporting mechanism form the second supporting assembly 60. The mopping module providing unit 236 is provided with a plurality of second supporting assemblies 60. At least two second supporting assemblies 60 are respectively mounted on two sides of the storage module 210 along a first direction; and the first direction F is perpendicular to the vertical direction. In this embodiment, the first direction F is a left-right direction facing FIG. 42, and the second direction is perpendicular to the first direction F, and the second direction is a front-rear direction facing FIG. 42.

Figure 41:
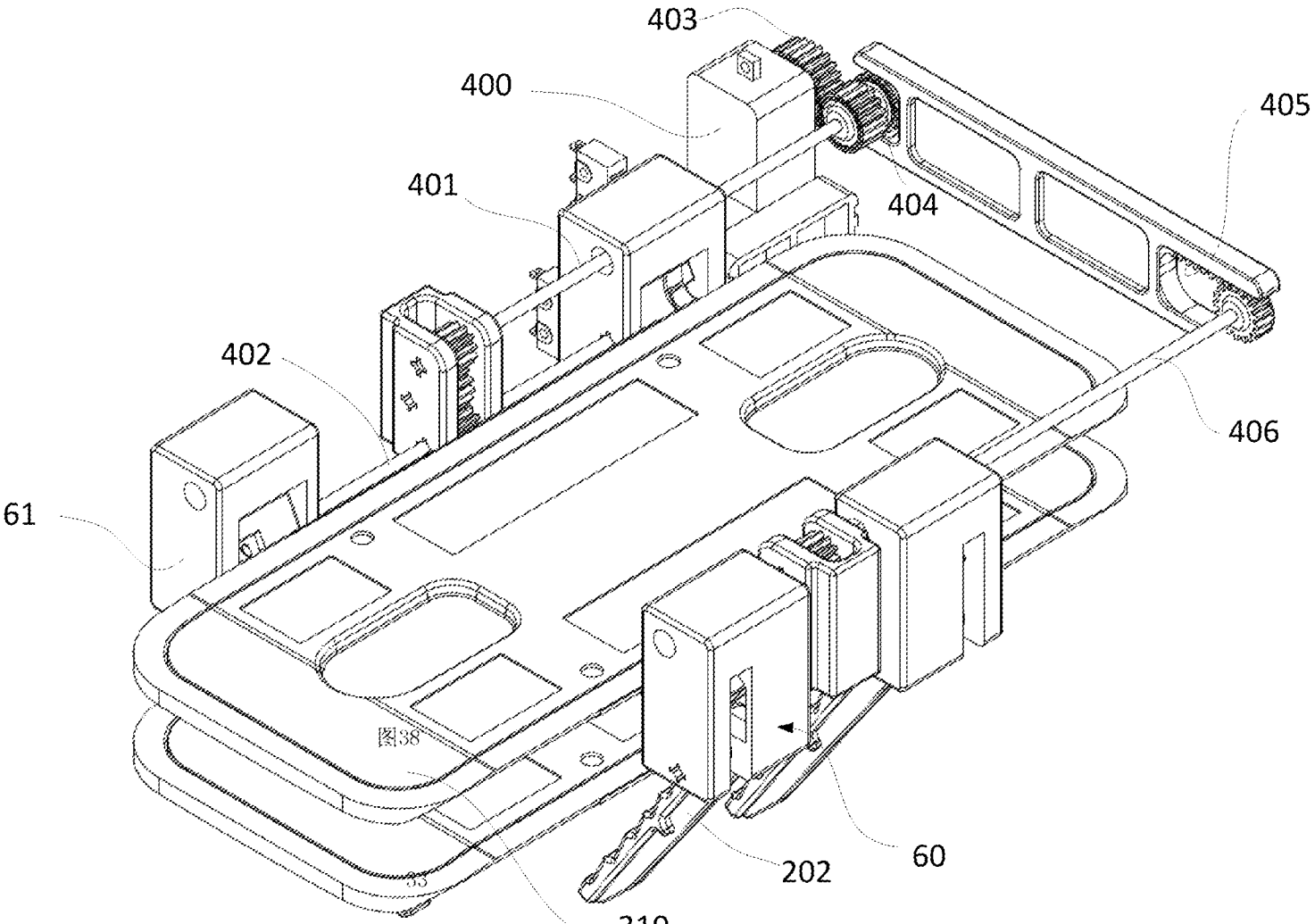
FIG. 41 is a schematic diagram of a driving structure of a mopping module providing unit in FIG. 40.

As shown in FIG. 40 and FIG. 41, each second supporting assembly 60 may be provided with a holding box 61, and there is an opening facing the storage module 210 on an inner side of the holding box 61. The supporting rod 13 is, when being the retraction state, located in the holding box 61, and extends, in the supporting state, from the opening of the holding box 61 into the storage module 210, to support the mopping module 310.

In the second supporting assembly 60, the first supporting mechanism 201 temporarily supports the mopping module 310 when the mopping module 310 is delivered, and the second supporting mechanism 202 continuously supports the mopping module 310 when no mopping module 310 is delivered. When the second supporting mechanism 202 switches from the holding-up state to the open state, the mopping module 310 descends in dependence on gravity before falling onto the bottom of the operating position. There are at least three second supporting assemblies. Correspondingly, the quantity of first supporting mechanisms 201 and the quantity of second supporting mechanisms 202 stably support the mopping modules 310, to prevent the mopping modules 310 from autonomously falling, and there are at least three second supporting assemblies 60.

In the embodiment shown in FIG. 41, four second supporting assemblies 60 are disposed on the housing 3, and correspondingly, four supporting boards and four matching rotatable stop boards are disposed on the housing 3. In the holding-up state, the four supporting boards are horizontally arranged and mutually staggered, and are not opposite to each other. When the supporting board switches from the holding-up state to the open state, the supporting board rotates downward, to open the bottom of the storage module 210, and a lowest mopping module 310*a* moves downward under the action of gravity.

To avoid a case that rotation forms interference, the second supporting assemblies 60 located on two sides of the storage module 210 are staggered. In this way, the supporting board has a larger length, thereby forming a delivery path when the mopping module 310 is delivered, to avoid a case that the mopping module 310 directly falls and deviates. A plurality of second supporting assemblies 60 or a plurality of second supporting mechanisms 202 are at different positions in the second direction. Two second supporting assemblies 60 are distributed on the left side of the storage module 210, and two second supporting assemblies 60 are distributed on the right side of the storage module 210. A distance between the two second supporting assemblies 60 on the left side is larger than a distance between the two second supporting assemblies 60 on the right side. There is a transmission gear group between two second supporting assemblies 60 located on the same side, and the transmission gear group implements transmission from a first driving shaft 401 to the pivoting shaft 402.

To avoid a case that the mopping module 310 deviates when being delivered, and ensure that the mopping module 310 is subsequently replaced smoothly, a length of the supporting board in the holding-up state stretching into the storage module 210 is greater than ½ of a width of the storage module 210 along the first direction F. In this way, the larger length of the second supporting mechanism 202 may form a descending path of the mopping module 310, to avoid a case that the mopping module 310 deviates when being delivered, ensure an accurate delivery position of the mopping module 310, and further make it convenient for the cleaning robot to perform replacement.

To be conveniently inserted between two neighboring mopping modules 310, the supporting rod 13 has a relatively small length. Specifically, A length of the supporting rod 13 in the supporting state stretching into the storage module 210 is less than a length of the supporting board in the holding-up state stretching into the second storage unit 212.

Further, a gap 301 is formed between edges (landing edges 302) of two neighboring stacked mopping modules 310. An outer end 131 is flat, to make it convenient to stretch into the gap 301 between the neighboring mopping modules 310. To further conveniently insert the first supporting mechanism 201 between the mopping modules 310, the supporting rod 13 has, when extending toward the outer end 131 of the supporting rod, the width gradually decreased. A width direction F2 of the supporting rod 13 is approximately parallel to a circumferential direction around the second rotational axis 11. The supporting surface of the supporting rod 13 is a curved surface.

When the mopping module 310 is delivered, as supporting boards on two sides of the mopping module 310 open toward the two sides, and the mopping module 310 descends along the bearing surfaces of the supporting boards. However, there may be a case that descending speeds or descending displacements on the two sides of the mopping module 310 are asynchronous, to cause the entire mopping module 310 to deviate laterally, until the delivery causes position deviation or overturning, which affects subsequent cleaning member replacement.

To avoid the problem, the second supporting mechanism 202 (for example, the supporting board) is further provided with a buffering portion 231. The buffering portion 231 includes a buffering inclined surface 231*b*; and a protrusion height of the buffering inclined surface 231*b* along a direction from the connection end 25 of the second supporting mechanism 202 to the free end 26 of the second supporting mechanism 202 is gradually increased. The buffering portion 231 is disposed on the supporting surface of the second supporting mechanism 202, and stops the mopping module 310 when the mopping module 310 descends, until opening to a larger degree to release the mopping module 310.

The second supporting mechanisms 202 located on the two sides of the storage module are each provided with a buffering portion 231. When the second supporting mechanism 202 rotates to open, the mopping module 310 descends, until coming into contact with the buffering inclined surface 231*b* of the buffering portion 231 to stop or slow descending. In this case, lateral deviation occurs on the two sides of the mopping module 310, a landing edge 302 on a side of the mopping module 310 comes into contact with the buffering inclined surface 231*b* in advance to stop or slow descending; and then, a landing edge 302 on the other side comes into contact with the landing edge 302 on the buffering inclined surface 231*b* in advance to form chasing, until the level of the mopping module 310 is restored, to eliminate the lateral deviation problem, thereby ensuring that the mopping module 310 is in an accurate to-be-replaced state during delivery. Moreover, the buffering inclined surface 231*b* may further reduce the descending speed of the mopping module 310, so that the mopping module is delivered into the carrying groove 51 at a relatively low speed, to further avoid a possibility that the mopping module 310 deviates.

Further, the buffering portion 231 further has a sliding inclined surface 231*a*; the sliding inclined surface 231*a* is closer to the connection end than the buffering inclined surface 231*b*; and a protrusion height of the buffering inclined surface 231*a* along a direction from the connection end 25 to the free end 26 is gradually decreased. The sliding inclined surface 231*a* and the buffering inclined surface 231*b* form a stepped structure. During descending, the mopping module 310 first comes, when sliding to the buffering portion 231, into contact with to the sliding inclined surface 231*a*, and the sliding inclined surface 231*a* is in contact with the inclined surface of the landing edge 302, so that the mopping module 310 stably slides; and then, the mopping module 310 forms, when sliding to the buffering inclined surface 231*b*, buffering and damping for the mopping module 310 through the buffering inclined surface 231*b*, to ensure that the mopping module 310 is in a level state. Preferably, the supporting board has a plurality of buffering portions 231; and the plurality of buffering portions 231 are arranged along a direction from the connection end 25 to the free end 26 to form a stepped buffering structure 23.

Specifically, the supporting board has the stepped buffering structure 23 configured to bear the mopping module 310. The stepped buffering structure 23 includes a plurality of buffering portions 231 arranged along the direction from the connection end 25 to the free end 26. Each buffering portion 231 includes a sliding inclined surface 231*a* and a buffering inclined surface 231*b*. The sliding inclined surface 231*a* is closer to the connection end 25 than the buffering inclined surface 231*b*. Along the direction from the connection end 25 to the free end 26, a protrusion height of the buffering inclined surface 231*a* is gradually decreased, and a protrusion height of the buffering inclined surface 231*b* is gradually increased. The buffering portion 231 wholly forms a "V" shaped groove, and a plurality of V shaped grooves are sequentially arranged along the direction from the connection end 25 to the free end 26, to form the stepped buffering structure 23.

When the mopping modules 310 are delivered, as the supporting boards open by an increased angle, the mopping modules 310 successively fall on the stepped buffering structure 23. When passing through a buffering portion 231 at a stage each time, the mopping module 310 is decelerated and buffered, to avoid a case that the delivery speed is excessively high and deviation occurs.

Still referring to FIG. 42 to FIG. 47, the supporting board is provided with a carrying curved surface 24 on a side of the stepped buffering structure 23 far away from the free end 26. The carrying curved surface 24 protrudes outward, to form a convex surface. In the holding-up state, the carrying curved surface 24 bears the mopping module 310. To conveniently deliver the mopping modules 310 one by one, when the supporting board rotates from the holding-up state toward the open state by at most 30 degrees, the carrying curved surface 24 continuously bears the mopping modules 310. At an initial stage in which the supporting board rotates, the lowest mopping module 310*a* descends by a relatively small amplitude; and as the supporting board opens by an increased angle, the mopping module 310 descends by an increased amplitude, and the mopping module 310 gradually fall onto the stepped buffering structure 23.

To ensure that the supporting rod 13 supports the remaining mopping modules 310 other than the lowest mopping module 310*a*, and avoid delivering an excessive quantity of mopping modules 310, in the holding-up state, a height difference between the free end 26 of the supporting board and the supporting rod 13 is greater than a thickness of a single mopping module 310 and less than a thickness of two mopping modules 310. In the retraction state, the outer end 131 of the supporting rod 13 is located above the lowest mopping module 310*a*. In the retraction state, the outer end 131 of the supporting rod 13 and the gap 301 are disposed opposite to each other along the first direction F.

In this embodiment, a transmission mechanism is disposed on the housing 3. A driving motor 400 drives, through the transmission mechanism, the plurality of second supporting assemblies 60 to synchronously act. The transmission mechanism may include a worm gear and a worm. The driving motor 400 drives, through the worm gear and the worm, the pivoting shaft 402 to rotate, and the pivoting shaft 402 may be fixedly connected to the plurality of second supporting mechanisms 202, thereby simultaneously driving the plurality of second supporting mechanisms 202 to simultaneously rotate.

Specifically, the driving motor 400, the first driving shaft 401, and a second driving shaft 406 are further disposed on the housing 3. The first driving shaft 401 and the second driving shaft 406 are respectively mounted on two sides of the storage module 210 along the first direction F. The first driving shaft 401 and the second driving shaft 406 are disposed parallel to the first rotational axis, and respectively drive pivoting shafts 402 located on two sides of the storage module 210 to rotate. The driving motor 400 is configured to drive the first driving shaft 401 and the second driving shaft 406 to rotate.

The driving motor 400 and the first driving shaft 401 are located on a side of the storage module 210 along the first direction F, and the second driving shaft 406 is located on another side of the storage module 210 along the first direction F. A side of the storage module 210 along a second direction is provided with a chain 405. The driving motor 400 drives the second driving shaft 406 through the chain 405. The second direction is perpendicular to the first direction F and the vertical direction.

A working principle of a mopping module providing unit 236 in an embodiment of this application is described below in detail with reference to FIG. 40 to FIG. 47, to better understand this application.

As shown in FIG. 40, the mopping module providing unit 236 and a cleaning member recycling apparatus are placed abreast to form a base station 200 for a cleaning robot to dock. The base station 200 may be provided with a sensor, the sensor is capable of detecting a position of the second supporting mechanism 202 (the supporting board), and then the mopping module providing unit 236 may control an action of the second supporting mechanism 202 according to a signal sent by the sensor.

The storage module 210 stores a plurality of stacked mopping modules 310 (310*a*, 310*b*, 310*c*), the operating position is located below the storage module 210, and the four second supporting assemblies 60 are respectively located on two sides of the bottom of the storage module 210. Two second supporting assemblies 60 are located on the left side. Correspondingly, two supporting boards are located on the left side, and share the same pivoting shaft 402 for driving, and are driven through the first driving shaft 401, and each supporting board corresponds to a linked rotatable stop board. Two second supporting assemblies 60 are located on the right side. Correspondingly, two supporting boards are located on the left side, and share the same pivoting shaft 402 for driving, and are driven through the second driving shaft 406, and each supporting board corresponds to a linked rotatable stop board.

The cross section of the mopping module 310 matches that of the storage module 210, and left and right edges of the mopping module 310 are close to left and right side walls of the storage module 210. In this way, the space of the storage module 210 may be used as much as possible, and it is convenient for the first supporting mechanism 201 to be inserted to support the remaining mopping modules 310.

As shown in FIG. 42, when no mopping module 310 needs to be delivered, the supporting board is in the holding-up state, to support all mopping modules 310 of the storage module 210. The supporting rod 13 is, when being in the retraction state, accommodated in the holding box 61 and does not extend from the opening of the holding box 61. In this case, there is the gap 301 between a landing edge 302 of the lowest mopping module 310*a* and that of the penultimate mopping module 310*b*, and the outer end 131 of the supporting rod 13 is aligned with the gap 301 along the first direction F. Moreover, the outer end 131 of the supporting rod 13 is higher than an upper surface of the lowest mopping module 310*a* and lower than an upper surface of the penultimate mopping module 310*b*.

Figure 43:
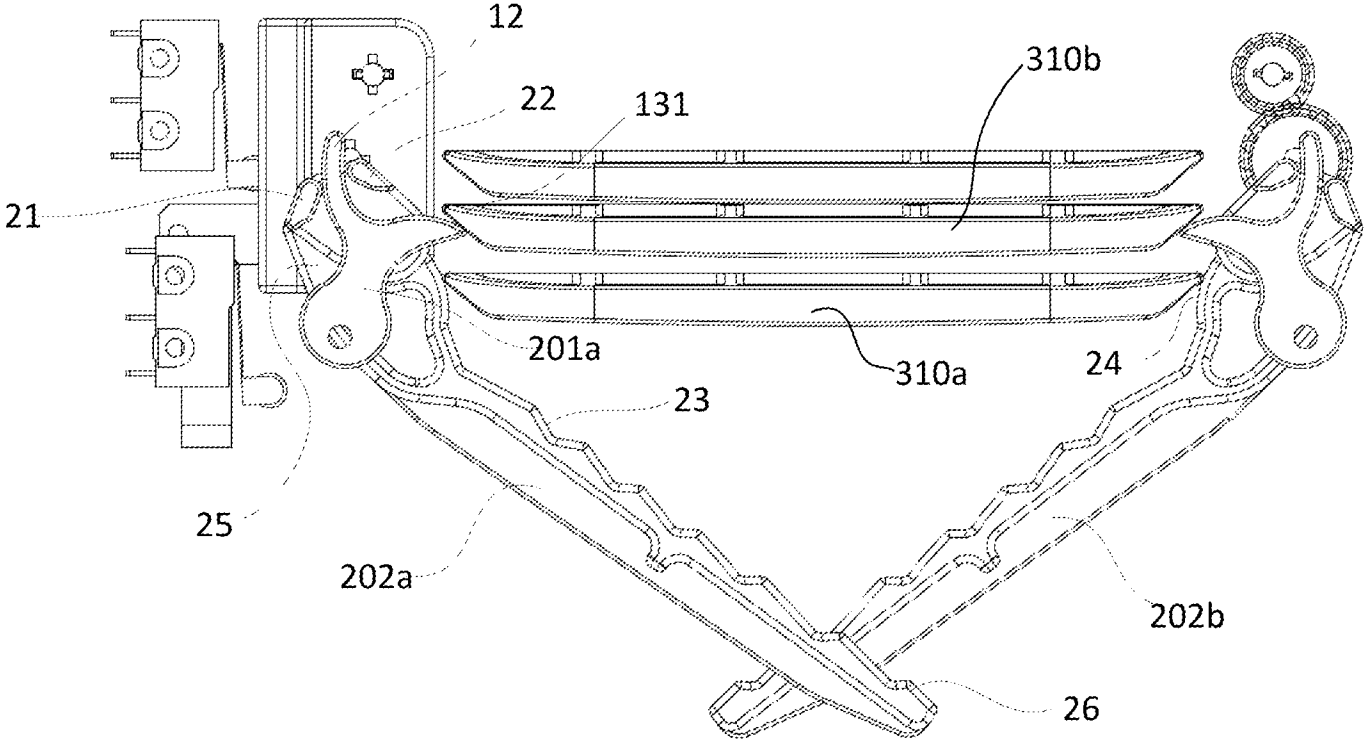
FIG. 43 to FIG. 47 are schematic diagrams of a process of delivering a mopping module by a mopping module providing unit.
Figure 44:
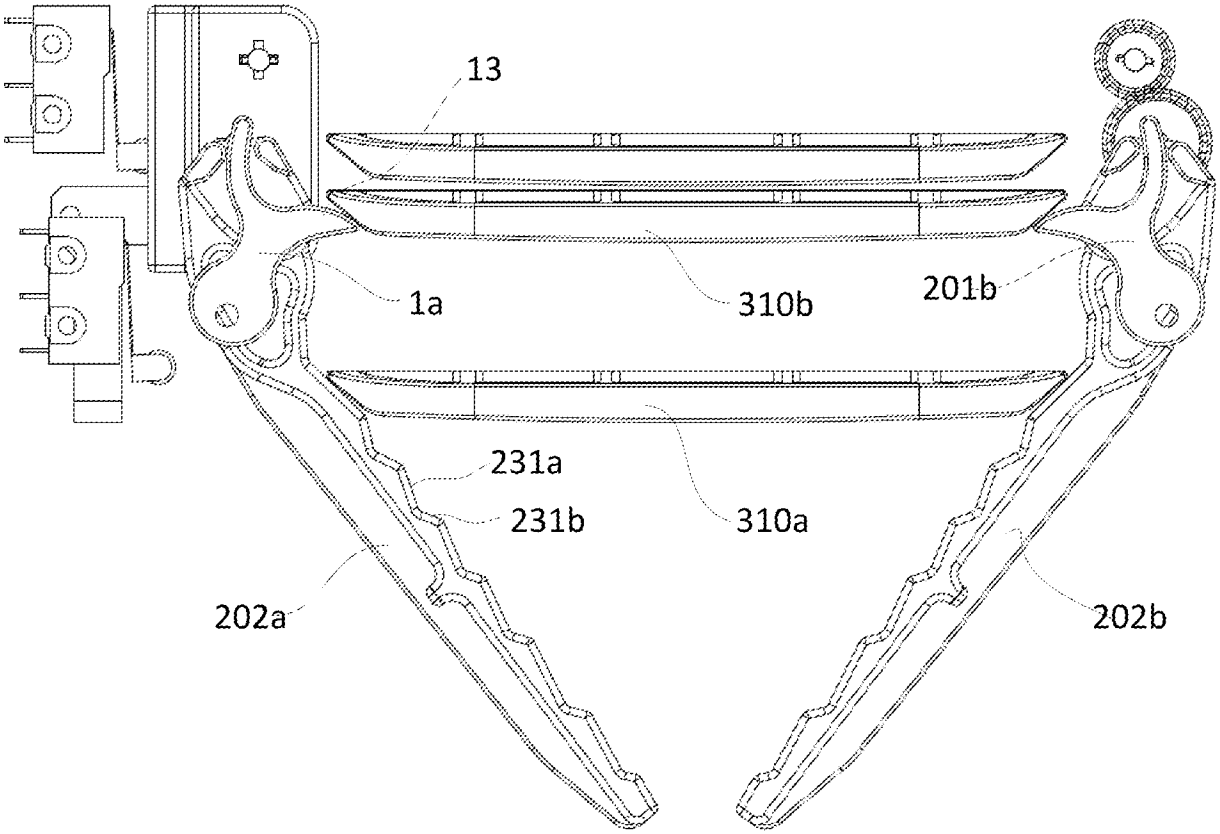

As shown in FIG. 43 to FIG. 45, when needing to replace the mopping module 310. The cleaning robot communicates with the base station 200, and the base station 200 controls the mopping module providing unit 236 to deliver a new mopping module 310. The controller of the base station 200 controls the driving motor 400 to start, and the driving motor 400 simultaneously drives, through the first driving shaft 401 and the second driving shaft 406, the four second supporting assemblies 60 to synchronously act.

The supporting board rotates downward and opens gradually, and the lowest mopping module 310*a* begins to move downward. At the initial stage in which the supporting board rotates, the supporting rod 13 extends from the opening of the holding box 61, and stretches into the gap 301. As shown in FIG. 43, when the supporting board rotates by about 30 degrees, the lowest mopping module 310*a* has a very small displacement amount, and is still supported by the carrying curved surface 24; and, in this case, the supporting rod 13 has stretched into the gap 301 to support the remaining mopping modules 310 starting from the penultimate mopping module 310*b*, so that only one mopping module 310 is delivered, to deliver the mopping modules 310 one by one.

As shown in FIG. 44, as the supporting board opens by an increased angle, the mopping module 310 falls from the carrying curved surface 24 onto the stepped buffering structure 23. The mopping module 310 may enter the buffering portion 231 through the sliding inclined surface 231*a*, and is stopped and slowed by the buffering inclined surface 231*b*, until the angle by which the supporting board opens continues to be increased and the mopping module 310 enters a next-stage buffering portion 231.

As shown in FIG. 45, the supporting board is, when completely opening (being in the open state), approximately at angle of 80 degrees to 90 degrees to the horizontal plane, and after passing through a final-stage buffering portion 231, the mopping module 310 is detached from the supporting board. In this case, the mopping module 310 is close to the carrying groove 51, and it is very difficult to form deviation or the deviation amount is very small, thereby ensuring accuracy of a falling position. In this case, the supporting rod 13 is in the supporting state.

Figure 46:
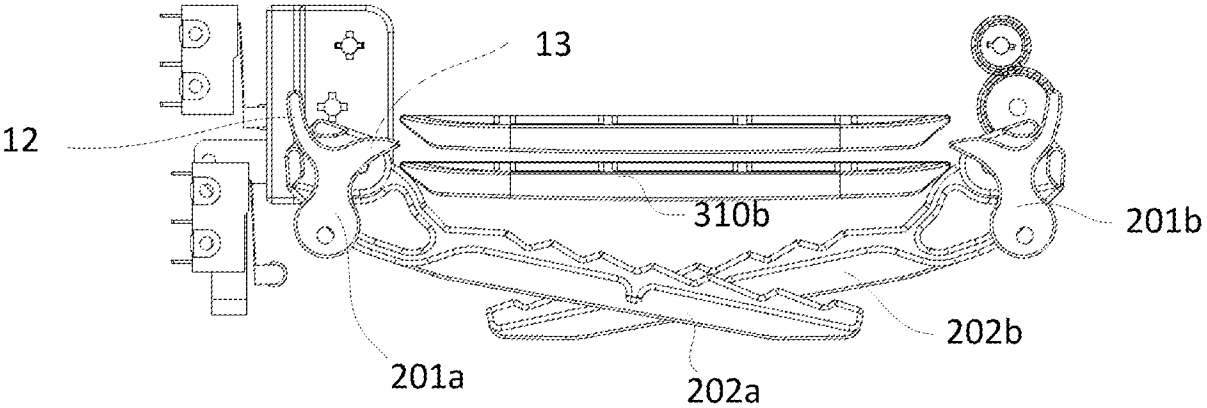
Figure 46:
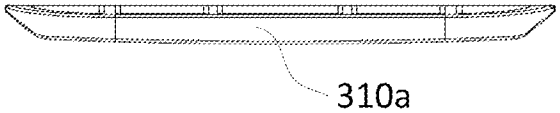
Figure 47:
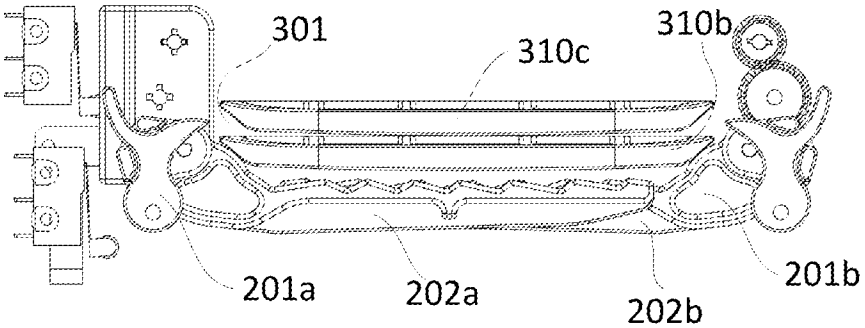
Figure 47:
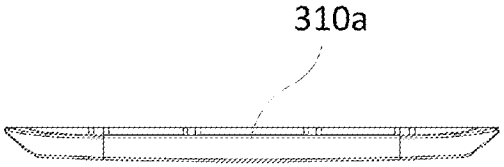

Subsequently, as shown in FIG. 46 and FIG. 47, the supporting board begins to be reset to the holding-up state, the driving motor 400 may be reversed, and the supporting board rotates upward. Correspondingly, the supporting rod 13 retracts, until the supporting board is reset to support the mopping module 310 in the storage module 210, and the supporting rod 13 completely retracts into the holding box 61, and returns to the retraction state. Correspondingly, the original penultimate mopping module 310*b* and antepenultimate mopping module 310*c* in the storage module 210 become the lowest mopping module 310*a* and the penultimate mopping module 310*b*. When a new mopping module 310 needs to be delivered again, the delivery process in FIG. 40 to FIG. 47 is performed again.

Based on the same idea, the present disclosure further provides a base station 200 for a cleaning robot to dock, and an automatic cleaning system, as described in the following embodiments. Principles with which the base station 200 for a cleaning robot to dock, and the robot cleaning system resolve problems, and achievable technical effects are similar to those of the cleaning member recycling apparatus. Therefore, for implementation of the base station 200 for a cleaning robot to dock, and the robot cleaning system, reference may be made to implementation of the foregoing base station 200. Repeated content is not described herein again.

Referring to FIG. 40 to FIG. 47, an embodiment of this application further provides a base station 200 for a cleaning robot to dock, the base station including: a mopping module collection unit and a mopping module providing unit, where the mopping module providing unit includes a mopping module providing unit 236, where the mopping module providing unit 236 includes: a first supporting mechanism 201, where the first supporting mechanism 201 has a supporting state of supporting the mopping module and a retraction state of not supporting the mopping module; and a second supporting mechanism 202, where the second supporting mechanism has a holding-up state of supporting the mopping module 310 in the second storage unit 212 and an open state of releasing at least one mopping module 310 to the second operating position 252, where when the second supporting mechanism 202 is in the holding-up state, the first supporting mechanism 201 is in the retraction state; and when the second supporting mechanism 202 is in the open state, the first supporting mechanism 201 is in the supporting state to support the remaining mopping modules 310 in the second storage unit 212.

Referring to FIG. 40 to FIG. 47, an embodiment of this application further provides a robot cleaning system, including: a cleaning robot; and a base station 200 for the cleaning robot to dock, where the base station 200 is capable of communicating with the cleaning robot; and the base station 200 includes: a mopping module collection unit, a mopping module providing unit, and an operating position for the cleaning robot to operate. The mopping module providing unit 236 includes: a first supporting mechanism 201 disposed on a housing 3 of the base station; and a second supporting mechanism 202 disposed on the housing 3 of the base station, where the first supporting mechanism 201 has a supporting state of supporting the mopping module 310 and a retraction state of not supporting the mopping module 310. The second supporting mechanism 202 has a holding-up state of supporting the mopping module 310 in the storage module 210 and an open state of releasing at least one mopping module 310 to the operating position.

When being in the holding-up state, the second supporting mechanism 202 supports the mopping module 310 in the storage module 210, and the first supporting mechanism 201 is in the retraction state. The second supporting mechanism 202 releases, when being in the open state, at least one mopping module 310 to the operating position, and the first supporting mechanism 201 supports, when being in the supporting state, remaining mopping modules 310. Usually, the mopping module 310 includes a disposable mopping cloth and a washable mopping cloth, the robot cleaning system 300 in this embodiment is compatible with the disposable mopping cloth and the washable mopping cloth, and the storage module 210 is capable of storing the disposable mopping cloth and the washable mopping cloth. In an embodiment, to enable the storage module 210 to be compatible with both the disposable mopping cloth and the washable mopping cloth, the design of the storage module 210 needs to be improved, so that in a case of being compatible with the mopping clothes, the storage module 210 is still capable of ensuring relatively good working stability. Specifically, gaps of the storage module 210 in the length direction and the width direction are increased, so that a mopping module of a relatively large size is also capable of matching the storage module 210, and when a plurality of mopping modules 310 are placed in the storage unit 210, edges of the mopping modules 310 may be stacked, to ensure the capability of the storage module 210 to store the mopping modules 310 by increasing an internal gap of the storage unit 210. When there is a gap on two sides of the storage module 210, it means that the internal space of the storage module 210 is greater than the actual size of the mopping module 310. Usually, the center region of the storage module 210 is just aligned with the operating position, so that the mopping module can be relatively accurately placed on a corresponding operating position. Therefore, when the mopping module 310 is stored in the storage module, the mopping module 310 also needs to be placed on the center region of the storage module 210 as much as possible. Specifically, mopping modules 310 with which replacement is to be performed are stored in the second storage unit 212, and when the cleaning robot 100 needs to replace a mopping module, the second storage unit 212 provides a mopping module 310 to the second operating position 252 for the cleaning robot to mount. Specifically, if the mopping module 310 needs to be accurately placed on the second operating position, the mopping module 310 in the second storage unit 212 needs to fall from the intermediate region. Specifically, referring to FIG. 29 to FIG. 32, a contact portion, of the blocking sheet telescoping mechanism, in contact with the mopping module 310 is set to an inclined surface, a part, of the mopping module 310, in contact with the contact portion is also designed into a corresponding inclined surface, the inclined surface contact portion is capable of applying, to the mopping module, a force for moving toward the intermediate region of the second storage unit 212, so that the mopping module 310 moves toward the middle under the action of the telescopic mechanisms on the two sides as much as possible, and is located on the intermediate region of the second storage unit 212 as much as possible. In another embodiment, the contact portion of the blocking sheet telescoping mechanism may be alternatively designed into another shape, provided that the mopping module 310 can be subject to a force causing the mopping module to move toward the center region of the second storage unit 212. It may be understood that, a position, on the mopping module 310, in contact with the contact portion is also correspondingly changed.

Figure 39:
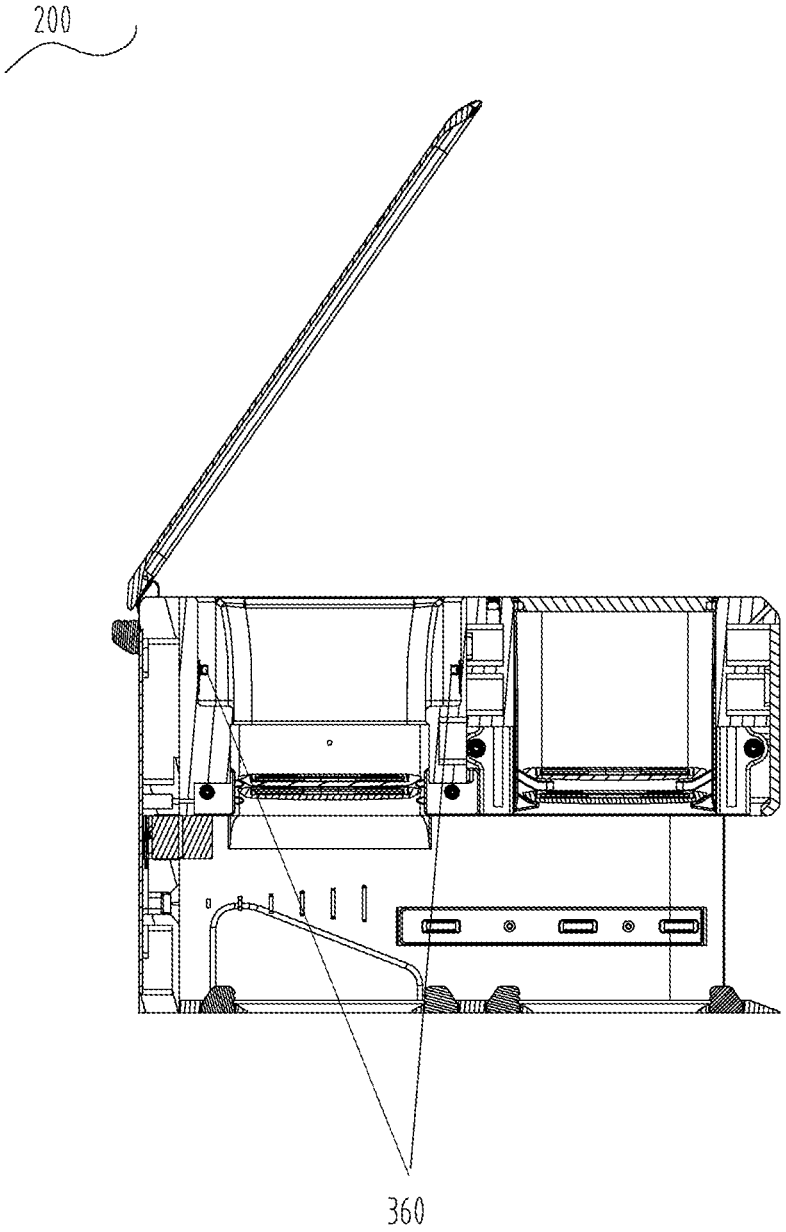
FIG. 39 is a schematic diagram of a storage state detection module on a base station according to an embodiment of the present disclosure.

It may be understood that, when the cleaning robot 100 separates the mopping module 310 from the main body, referring to FIG. 39, the mopping module collection unit needs to recycle the separated mopping module 310 into the first storage unit, that is, collect the mopping module 310 through movement of the lifting mechanism in the vertical direction. Specifically, to place the mopping module 310 collected into the first storage unit 211 on the center region as much as possible, the stop block of the mopping module collection unit should be designed to have a specific chamfer, so that the mopping module 310 is subject to a force for moving toward the center region of the first storage unit, to place the mopping module on the center region of the first storage unit as much as possible. A specific principle is the same as the design principle of the blocking sheet telescoping mechanism in the second storage unit, and details are not described herein again.

Figure 37:
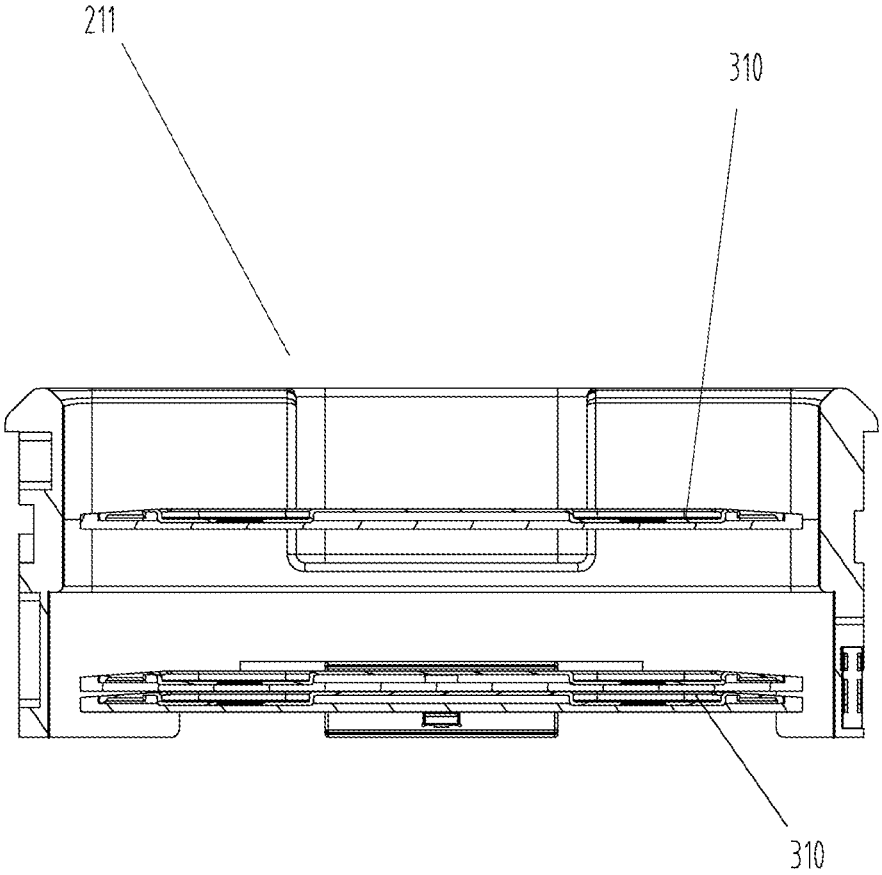
FIG. 37 is a schematic diagram of a first storage unit according to an embodiment of the present disclosure.

In an embodiment, FIG. 37 is a schematic diagram of the second storage unit 212, the second storage unit 212 may be divided into an upper portion and a lower portion, and an external region of the upper portion is provided with a lifting assembly, where the upper portion is mainly used to place the mopping module, and the mopping module 310 moves to the second operating position through the lower portion. Specifically, edge regions of the mopping modules 310 stored in the second storage unit 212 may be stacked or curled because of having no supporting of the rear board, and the mopping module may be stuck when falling through the lower portion, which affects working stability of the base station 200. Specifically, in this embodiment, the lower portion of the second storage unit 212 has a larger holding space than that of the upper portion, so that when moving through the lower portion, the mopping module 310 is capable of fully stretching, to reduce a possibility that the mopping module 310 is stuck and cannot normally fall, thereby improving working stability of the base station.

In this embodiment, referring to FIG. 14, the mopping module 310 is released from the second storage unit 212 through the mopping module providing unit, the mopping module 310 moves in the vertical direction under the action of the mopping module providing unit, and a movement direction of the mopping module 310 is perpendicular to a pull-in direction of the cleaning robot 100. Specifically, the mopping module 310 is released from the second storage unit 212 to the operating position 252 of the base station the second through the mopping module providing unit, and the cleaning robot 100 mounts, at the second operating position 252, the mopping module 310 released from the second storage unit 212. Specifically, the released mopping module 310 moves from top to bottom in the vertical direction. Specifically, the mopping module 310 is driven by the mopping module providing unit to freely fall in the vertical direction. Advantages of the foregoing design lie in that through the design of the mopping module providing unit, the base station is capable of automatically providing a to-be-mounted mopping module to the cleaning robot, thereby reducing manual participation, and improving the automation level of the cleaning robot. In an embodiment, the mopping module providing unit releases the mopping module, so that the mopping module moves in the vertical direction, and therefore the structure of the base station 200 is compact.

In this embodiment, the base station 200 further includes a supporting portion configured to connect the base plate of the base station 200 and the storage module 210 of the base station, and the supporting portion is disposed on a side of the base station 200, so that when the cleaning robot 100 docks, a projection of the machine body and that of the storage module 210 in the horizontal plane approximately coincide, to simultaneously support the base station 200. Therefore, the structure of the base station 200 is more stable. The supporting portion is disposed on a side of the base station 200, so that the structure of the base station 200 is more compact in the horizontal direction.

In this embodiment, the base station 200 includes a charging module (not shown), the charging module includes at least one pair of charging terminals, and the charging module includes a signal transmitter, configured to send a guiding signal to the cleaning robot 100. After detecting that its own power level is less than a threshold, the cleaning robot 100 moves toward the base station 200 according to a preset path, continuously detects, during moving, a signal sent by the charging module, and determines a position of the base station 200 according to the signal and completes charging and docking. In this embodiment, the charging terminals are located on the supporting portion, and after entering the base station 200 to complete docking, the cleaning robot 100 starts charging, and the cleaning robot 100 leaves the base station 200 after the charging ends. Specifically, when the cleaning robot 100 returns to the base station 200, the connection assembly 120 cause the mopping module 310 to be lifted up from the working surface, to avoid contaminating the cleaned working surface. In another embodiment, the charging terminals may be alternatively located at the bottom of the storage module 210 of the base station 200, so that the top of the cleaning robot 100 is in contact with the charging terminals to perform charging. In another embodiment, a manner in which the cleaning robot 100 returns for charging further includes wireless charging, the charging module includes a transmitting coil, and the cleaning robot 100 includes a receiving coil, to charge the cleaning robot 100 through electromagnetic induction between the transmitting coil and the receiving coil. The charging module is disposed on the base station 200, whose beneficial effect lies in that functions of the base station 200 are integrated, so that the base station 200 is reusable in function and compact in structure.

In this embodiment, referring to FIG. 39 and FIG. 40, the second storage unit 212 of the base station 200 includes a storage state detection module 360, capable of detecting a current state of the mopping module 310 in the second storage unit 212 and sending an instruction to the user. Specifically, when it is detected that the second storage unit has no mopping module 310, the user is reminded to add a mopping module in time, to avoid affecting working stability of the base station 200. Similarly, the first storage unit 211 also includes a storage state detection module, configured to send an instruction for processing mopping modules 310 to the user when it is detected that the quantity of mopping modules 310 placed in the first storage unit 211 reaches a preset value, or detected that a storage time of mopping modules in the first storage unit 211 reaches a preset value. Specifically, when the quantity of mopping modules 310 is greater than or equal to nine, a prompt instruction for processing the mopping modules 310 is sent to the user.

In an embodiment, the storage state detection module 360 includes a photoelectric sensor that may be configured to detect the quantity of mopping modules in the storage unit, be configured to determine whether the first storage unit 211 has been fully loaded with mopping modules, and be configured to determine whether the second storage unit 212 has no mopping module. Specifically, the mopping module 310 separated from the main body of the cleaning robot 100 is placed in the first storage unit 211, the mopping module 310 provided for the cleaning robot 100 to mount is placed in the second storage unit 212, and when the first storage unit 211 has been fully loaded with mopping modules 310, or the second storage unit 212 has no mopping module 310 that may be provided for the cleaning robot 100 to mount, the base station sends a corresponding prompt instruction. Specifically, the photoelectric sensor includes a transmit end and a receive end, the transmit end is disposed on a side of the storage unit, the receive end is disposed at a corresponding position on another side of the storage unit, and when a signal transmitted by the transmit end can be received by the receive end, it indicates that there is no obstacle between the transmit end and the receive end. Specifically, if whether the first storage unit 211 is fully loaded with mopping modules 310 needs to be detected, the transmitter of the photoelectric sensor is mounted on a side of the top of the first storage unit 211, and the receiver of the photoelectric sensor is mounted at another side; and if the first storage unit 211 is fully loaded with mopping modules 310, when the transmitter transmits a signal, because the signal is blocked by the mopping module 310 at the top of the first storage unit 211, the receiver cannot receive the signal, and it is determined accordingly that the first storage unit 211 has been fully loaded with mopping modules 310. Moreover, if whether the second storage unit 212 further has a mopping module 310 with which the cleaning robot 100 may perform replacement needs to be detected, the transmit end of the photoelectric sensor is mounted on a side of the bottom of the second storage unit 212, and the receive end is mounted at a corresponding position on another side; and if the second storage unit 212 has no mopping module 310 to be mounted, after the transmit end of the photoelectric sensor transmits a signal, because the signal is not blocked by any intermediate mopping module, the receive end can receive the signal, and it is determined accordingly that the second storage unit 212 has no mopping module 310 that may be provided for the cleaning robot 100 to mount. In another embodiment, the photoelectric sensor may be mounted on another position. For example, if it is determined that the quantity of mopping modules 310 in the storage unit 210 is less than 2, the photoelectric sensor may be mounted at a position where a second mopping module is stacked in the storage module 210; and if the receive end has not detected any signal, it indicates that the quantity of mopping modules 310 in the storage module is greater than or equal to 2; otherwise, it indicates that the quantity of mopping modules 310 in the storage module is less than 2.

Specifically, in this embodiment, a manner in which the base station sends an instruction includes: the base station communicates with a mobile device (for example, a mobile phone, a computer, or an iPad, etc), to send a prompt instruction to the user, to remind the user to clear the base station in time, or remind the user to add a mopping module. In another embodiment, the base station includes an indicator, and is capable of reminding, through light or sound of the indicator or in another manner, the user to perform a corresponding operation on the base station.

Figure 22:
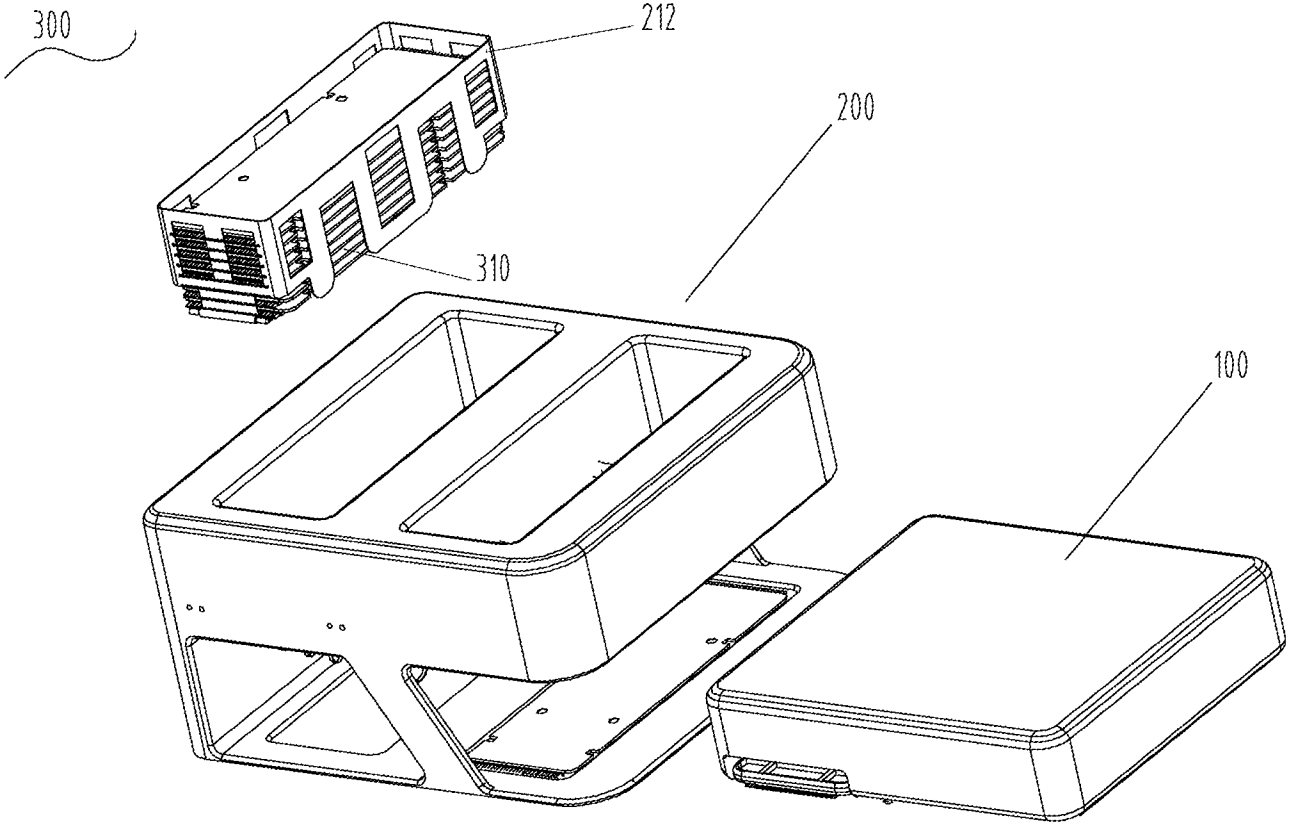
FIG. 22 is a schematic diagram of separating a second storage unit from a base station according to an embodiment of the present disclosure.

In this embodiment, referring to FIG. 22, the storage module 210 of the base station 200 is detachable, and FIG. 22 shows a state in which the second storage unit 212 is separated from the base station 200. Specifically, the first storage unit and the second storage unit 212 of the storage module 210 may be each separated from the body of the base station 200. When needing to add a mopping module 310, or remove a mopping module 310 in the storage module 210, or clean a mopping module 310 in the storage module 210, the user can place, by separating the storage module 210 from the base station 200, the storage module 210 at an appropriate position according to needs of the user. Specifically, the storage module 210 and the base station 200 are constructed into detachable design through various common mechanical structures such as groove design and magnet adsorption design, and details are not described herein again.

Figure 38:
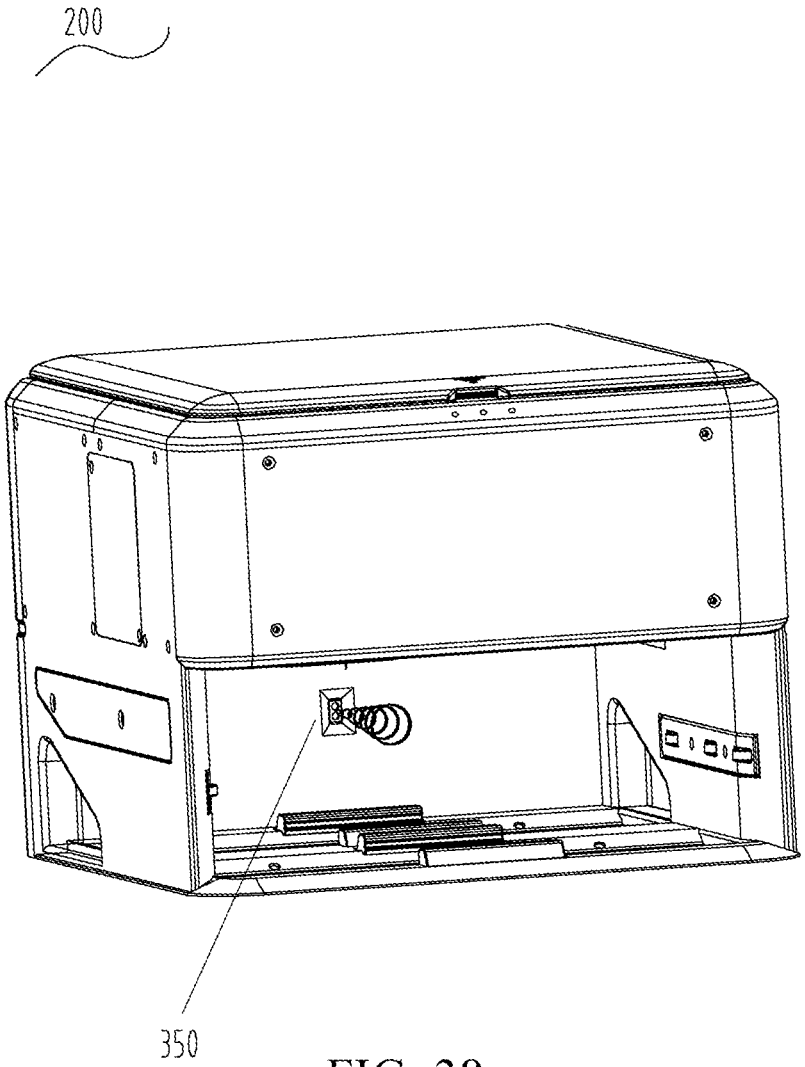
FIG. 38 is a schematic diagram of a fault detection sensor on a base station according to an embodiment of the present disclosure.

The cleaning robot 100 in this embodiment includes a plurality of sensors, configured to perform corresponding actions when detecting different cases. Usually, the cleaning robot 100 works in the working region after a mopping module 310 is mounted, and the cleaning robot 100 cannot perform cleaning work when no mopping module 310 is mounted, to avoid causing an irreparable damage to the working surface and the cleaning robot 100 itself. In this embodiment, the cleaning robot 100 has a mopping module mounting detection sensor, and performs cleaning work in the working region when detecting that a mopping module is mounted on the cleaning robot 100; and stops working when detecting that no mopping module is mounted on the cleaning robot 100, and sends a fault instruction to the user, to avoid causing damage to the working surface itself or the cleaning robot 100 itself. Specifically, the detection sensor includes a Hall sensor, the mopping module 310 is provided with a magnet, the Hall sensor detects existence of the magnet to determine whether a mopping module 310 is mounted onto the cleaning robot 100; if detecting that the magnet exists, it is determined that the mopping module is mounted onto the cleaning robot 100, and the cleaning robot 100 may work; and if the Hall sensor detects that the magnet does not exist, it is determined that no mopping module 310 is mounted on the cleaning robot 100, and the cleaning robot does not perform cleaning work, and sends a fault instruction to the user. Referring to FIG. 5 and FIG. 6, FIG. 5 is a schematic diagram in which the mopping module 310 is not mounted on the cleaning robot 100, and FIG. 6 is a schematic diagram in which the mopping module 310 is mounted on the cleaning robot 100. Specifically, the mopping module mounting detection sensor is located on the cleaning robot 100. More specifically, the detection sensor is located on the connection assembly, the mopping module 310 is mounted onto the cleaning robot 100 through the connection assembly, the connection assembly is provided with a Hall sensor, and the mopping module is provided with a magnetic element. When the Hall sensor is close to the magnetic element, the Hall sensor is capable of detecting changes of a magnetic field, detecting strength of the magnetic field, determining whether a mopping module 310 is mounted on the cleaning robot, and transferring a detection result to the control unit, and the cleaning robot 100 controls its own working logic accordingly. When a specific preset condition is met, the cleaning robot 100 returns to the base station 200 to replace a mopping module. However, there is a possibility of replacement failure during replacement of the mopping module. To enable the cleaning robot 100 to instruct, when replacement of the mopping module fails, the user in time to take a corresponding remedy measure, in this embodiment, Referring to FIG. 38, the base station 200 is provided with a fault detection sensor 350, and when it is detected that the transfer module has a fault, a fault instruction is sent to a user. Specifically, fault detection cases mainly include: The fault detection sensor 350 detects that the mopping module collection unit fails to collect the mopping module 310 separated from the cleaning robot 100 into the first storage unit 211, or detects that the mopping module providing unit fails to transfer the mopping module 310 in the second storage unit 212 to the cleaning robot 100 for mounting, and detects that the transfer module is not normally actuated, and the like. Specifically, in an embodiment, the fault detection sensor 350 includes an infrared sensor, configured to detect whether the mopping module 310 in the first storage unit 211 normally falls. Specifically, the infrared sensor is disposed at the supporting portion of the base station; when no mopping module 310 falls, the infrared sensor has not detected reflected infrared; when a mopping module 310 falls, infrared is reflected and therefore can be detected; after the robot enters the base station, if the infrared sensor has not detected any infrared signal, it is determined that the second storage unit 212 fails to provide a mopping module 310 to the second operating position, and meanwhile, the user receives a reminder about the fault of the base station to perform a corresponding operation.

The cleaning robot 100 performs cleaning work in the working region, and as the work is performed, the mopping module 310 mounted on the cleaning robot 100 becomes dirty gradually, and needs to be replaced. During cleaning work, the cleaning robot 100 continuously detects a working state through the sensor, and when a replacement instruction for instructing the cleaning robot to return to the base station 200 to replace the mopping module 310 is detected/received, the cleaning robot 100 is controlled to move into the base station 200 to replace the mopping module.

Specifically, the cleaning robot 100 includes a mopping module 310 contamination degree sensor (not shown), configured to continuously detect, during working, an extent to which the mopping module 310 mounted on the cleaning robot 100 is contaminated; and when it is detected that a contamination degree reaches a threshold, a replacement instruction is generated, and the control unit controls the cleaning robot 100 to move into the base station 200 to replace the mopping module 310.

Specifically, the user can preset a working area, a working time, a working schedule, and the like for the cleaning robot 100, and when the cleaning robot 100 detects that at least one of the foregoing conditions reaches a preset condition, a replacement instruction is generated, and the cleaning robot 100 is controlled to return to the base station 200.

Specifically, when the cleaning robot 100 moves into the base station 200, the control unit controls the connection assembly 120 to cause the mopping module 310 to be lifted up from the ground to prevent the mopping module 310 that has become dirty when the cleaning robot 100 returns from contaminating the cleaned working surface.

Specifically, when returning to the base station 200, the cleaning robot 100 returns according to a returning path preset by the user.

In this embodiment, the user can set a plurality of working conditions such as a working time, a working area, and a working schedule of the cleaning robot 100 in a plurality of manners. In this embodiment, the cleaning robot 100 includes a control panel, the control panel includes a corresponding setting function, and the user sets working conditions of the cleaning robot 100 by setting the control panel. Specifically, the cleaning robot 100 includes a communication module. The communication module is disposed on a housing of the cleaning robot 100, and the communication module communicates with a control circuit of the cleaning robot 100. Specifically, the user can establish wireless communication with the cleaning robot 100 through an appropriate mobile apparatus, so that the user correspondingly sets the mobile apparatus, to set corresponding working conditions of the cleaning robot 100. In this embodiment, the mobile apparatus is any type of mobile apparatus such as a mobile phone, a smartphone, a PDA, a tablet computer, or a wrist-wearable computing device, and includes one or more processors, a computer-readable medium for storing software applications, input apparatuses (for example, a keyboard, a touch screen, and a microphone, etc), output apparatuses (for example, a display screen and a speaker), a communication interface, and the like. The communication module of the cleaning robot 100 is configured to communicate with one or more mobile apparatuses through an appropriate wireless network (for example, a wireless local area network).

In this embodiment, when detecting the replacement instruction, the cleaning robot 100 returns to the base station 200; and after reaching the base station 200, the cleaning robot 100 determines, by determining its own position, whether a mopping module 310 should be separated or a mopping module 310 should be mounted. Specifically, the cleaning robot 100 includes a position detection sensor; when it is determined that the cleaning robot is currently on the first operating position 251, the control unit controls a mopping module 310 to be separated from the cleaning robot 100; and when it is determined that the cleaning robot is currently on the second operating position 252, the control unit controls the cleaning robot 100 to mount a mopping module 310. Specifically, the position detection sensor includes a photoelectric switch, a transmitter is mounted on the robot, a receiver is mounted on the operating position corresponding to the base station, and the receiver detects a received signal to determine whether the robot reaches a designated position. Specifically, when the photoelectric switch detects that the cleaning robot reaches the first operating position, the cleaning robot separates a mopping module onto the first operating position; and when the photoelectric switch detects that the cleaning robot reaches the second operating position, the cleaning robot mounts a mopping module. Specifically, after the cleaning robot reaches a corresponding operating position, the cleaning robot stops moving to perform a corresponding action, and restores moving when completing the current predetermined action, to perform a next predetermined action. Specifically, the cleaning robot further includes a collision sensor, and the cleaning robot detects collision between the cleaning robot and the base station, and determines, at least partially according to the result, whether the cleaning robot reaches the second operating position. In this embodiment, the cleaning robot 100 includes a ranging sensor, configured to detect a relative distance between the cleaning robot 100 and the base station 200 to determine a current position of the cleaning robot 100. Specifically, the ranging sensor of the cleaning robot 100 includes at least one of an infrared sensor, a laser sensor, an ultrasonic sensor, and the like. Specifically, the base station 200 includes at least one of an infrared transmitter, a laser transmitter, an ultrasonic transmitter, and the like, and a corresponding sensor of the cleaning robot 100 detects a signal sent by the base station 200 to determine a position. Specifically, although in this embodiment, the signal transmitter is disposed on the base station 200 and the corresponding detection sensor is disposed on the cleaning robot 100, this should not be used as a limitation on content of the present disclosure. Specifically, the signal transmitter may be alternatively disposed on the cleaning robot 100 and the corresponding sensor may be alternatively disposed on the base station 200, and even in some cases, the signal transmitter and the corresponding sensor may be both disposed on the cleaning robot 100, to detect a position through a reflection function of the base station 200 or the like.

Figure 19:
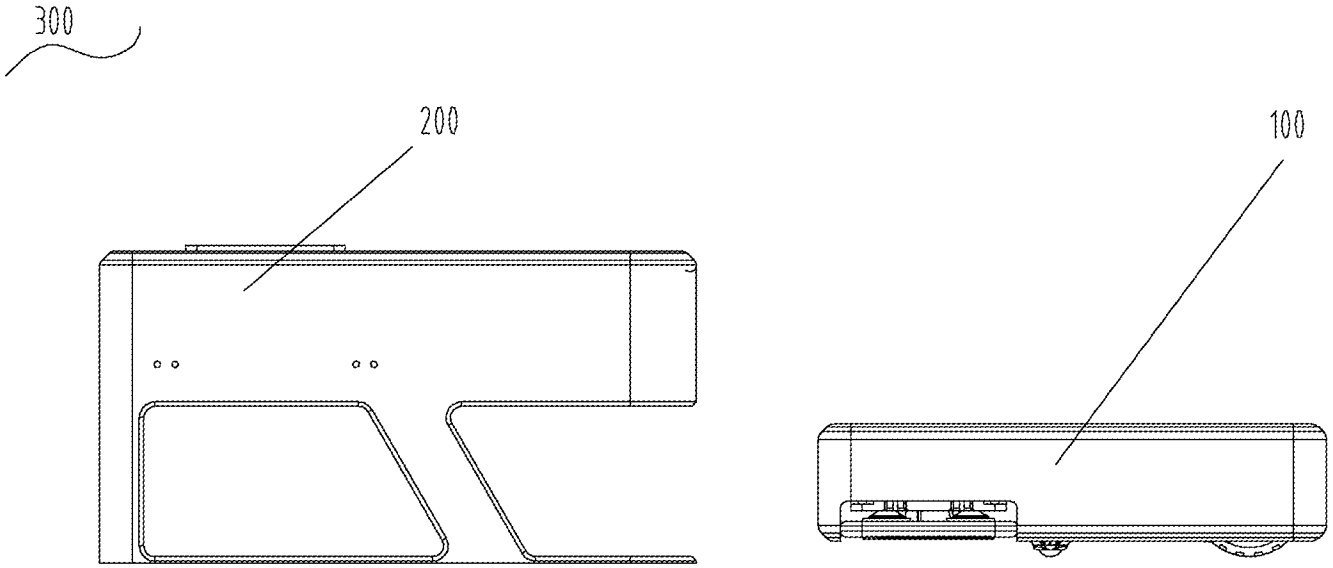
FIG. 19, FIG. 20, and FIG. 21 are schematic diagrams of a process of replacing a mopping module by a robot according to an embodiment of the present disclosure.

In a specific embodiment, referring to FIG. 16, assuming that a direction in which the cleaning robot 100 enters the base station is the length direction and a direction in the horizontal plane perpendicular to the length direction is the width direction, a width of the base station 200 is greater than a width of the cleaning robot. Specifically, referring to FIG. 19 to FIG. 21, because the width of the base station 200 is greater than the width of the cleaning robot 100, the cleaning robot 100 is capable of entering and docking in the base station 200. Specifically, because the width of the base station 200 is greater than the width of the robot, other components such as the sensor may be disposed in redundant space on two sides of the base station. Specifically, because the width of the base station is greater than the width of the robot, when the robot enters the base station 200, the position of the robot may deviate, and cannot precisely dock to the operating position on the base station at which the mopping module is placed. Specifically, the two sides of the base station are further provided with guiding structures, to guide the robot to be accurately aligned with the base station.

Figure 34:
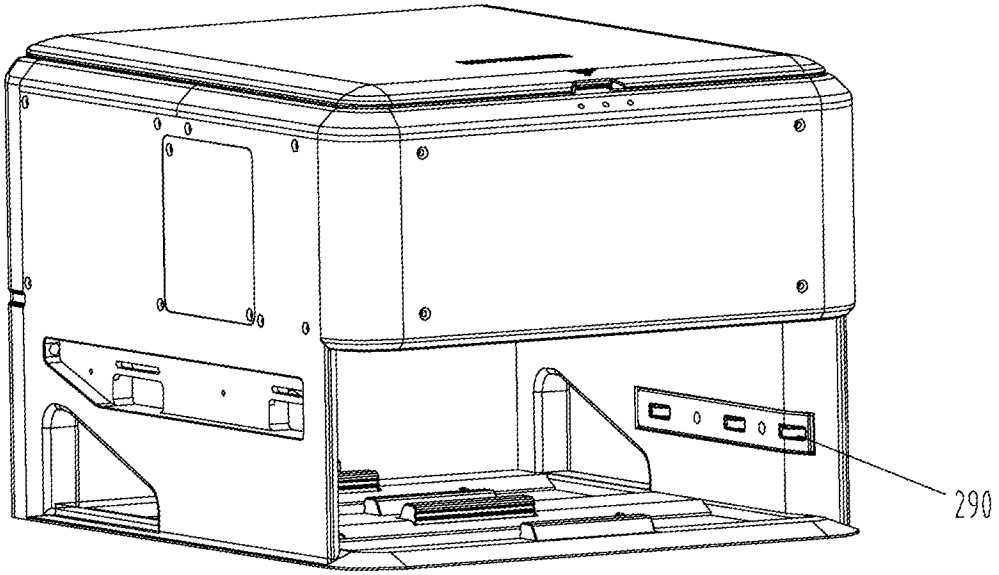
FIG. 34 is a schematic diagram of a base station on which an auxiliary guiding structure is disposed according to an embodiment of the present disclosure.
Figure 35:
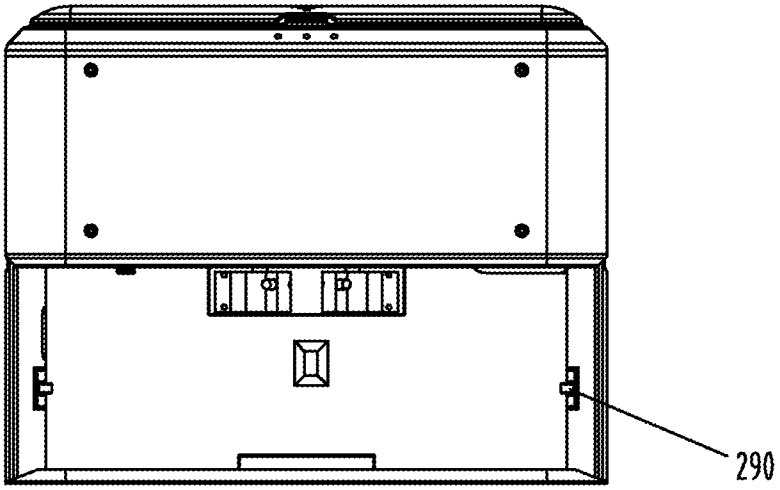
FIG. 35 is a side view of a base station on which an auxiliary guiding structure is disposed according to an embodiment of the present disclosure.

In a specific embodiment, at least one auxiliary guiding structure is disposed on each of the two inner side walls of the base station 200, the auxiliary guiding structure is configured to come into contact with the two side walls of the cleaning robot to guide the cleaning robot to accurately return to the operating position, and the form of the auxiliary guiding structure is not limited, and may be an auxiliary guiding wheel or an auxiliary guiding rail. As shown in FIG. 34 and FIG. 35, for example, a row of parallel auxiliary guiding wheels 290 is disposed on each of the two inner side walls of the base station. When the robot returns to the base station to replace the mopping module, the two side walls of the robot come into contact with the auxiliary guiding wheels 290 on the two inner side walls of the base station, to assist in guiding the robot to accurately return to the operating position, thereby reducing left-right swing of the robot during returning. Under the joint action of the signal transmitter of the base station 200 and the auxiliary guiding wheels 290, the robot smoothly and accurately returns to the operating position, thereby reducing an error of returning to the base station by the robot, and ensuring that an error between the axis of the robot and the axis of the base station ranges from 8 to 15 mm. In a specific embodiment, a height of the auxiliary guiding wheel 290 is equal to ⅓ to ½ of a height of the cleaning robot 100, that is to say, the auxiliary guiding wheel 290 is disposed at a middle or lower middle position of the height of the side wall of the cleaning robot, and the auxiliary guiding structure disposed at the position can assist the robot in moving more stably. Certainly, the auxiliary guiding structure may be disposed at another position of the height of the side wall that is capable of playing a role of stable guiding. The two side walls of the base station are two side walls in the pull-in direction of the cleaning robot.

In another specific embodiment, the auxiliary guiding structures may be alternatively not directly disposed on the side walls, convex board shaped structures may be disposed on two sides of the base plate that are close to the side walls, and guiding wheels or guiding rails facing the robot are disposed on the board shaped structures, and configured to assist in guiding moving of the robot. In each of the foregoing two embodiments, a solution for limiting running of the machine body on two sides of the robot is used. In an additional embodiment, a solution for limiting the moving wheels of the robot may be alternatively used. For example, guiding groove structures are disposed at positions on the base plate of the robot that correspond to the moving wheels, and configured to assist in guiding the moving wheels of the robot to cause the moving wheels to run to accurate operating positions.

In this embodiment, the base station 200 is further provided with an operating portion, and the user can operate the operating portion to control actions of the cleaning robot 100. Specifically, the cleaning robot 100 usually has a control panel, the user may operate the control panel of the robot 100 to control actions of the cleaning robot 100, and the operating panel of the robot is usually disposed on an upper surface of the robot. After the cleaning robot 100 enters the base station 200, and the upper surface of the robot is blocked by the base station 200. In this case, it is quite inconvenient if the operating panel of the cleaning robot 100 needs to be operated. In this case, the cleaning robot needs to leave the base station. Therefore, in this embodiment, the base station 200 is provided with an operating portion, and the operating portion on the base station is operated to control the robot to leave the base station and/or perform a corresponding action. In an embodiment, if the cleaning robot 100 needs to leave the base station 200, a corresponding function key on the operating portion of the base station 200 is pressed, so that the cleaning robot 100 leaves the base station, to perform cleaning work. In an embodiment, a detachable battery pack is mounted on the body of the cleaning robot 100. When the user needs to remove the battery pack, if the cleaning robot 100 is located in the base station 200, the operating portion on the base station is operated, so that the cleaning robot 100 leaves the base station and stops working, to make it convenient for the user to remove the battery pack. In an embodiment, a water tank is mounted on the cleaning robot 100, and is capable of providing moisture to the mopping module 310 to implement wet mopping on the ground. When the water storage amount in the water tank is relatively small, the user needs to add water to the water tank. In this case, if the cleaning robot 100 is located in the base station, the user may operate the operating portion of the base station to cause the cleaning robot to leave the base station 200 and dock outside the base station, making it convenient for the user to remove the water tank and mount the water tank. In an embodiment, referring to FIG. 36, the operating portion of the base station has a first operating element 320 and a second operating element 330. When the cleaning robot 100 needs to leave the base station, if the first operating element 320 on the base station 200 is pressed, the robot 100 leaves the base station and continues to perform cleaning work in the working region; and if the second operating element 330 on the base station 200 is pressed, the cleaning robot 100 leaves the base station 200, and docks outside the base station, making it convenient for the user to remove/mount the battery pack, and remove/mount the water tank and the like.

In an embodiment of the present disclosure, a collision cover is disposed in front of the cleaning robot 100, and the collision cover is internally provided with a collision sensor. When the robot 100 encounters an obstacle during moving, the collision cover first comes into contact with the obstacle, to detect the obstacle encountered by the robot during moving, and meanwhile, can play a role of buffering when the robot collides with the obstacle, to prevent the machine body of the robot 100 from being subject to strong collision and being damaged. In a specific embodiment, when the robot 100 moves in the working region, and the collision cover detects an obstacle, the robot 100 adjusts its own moving direction, to avoid the front obstacle. For example, when the collision cover of the robot 100 detects a front left obstacle, the robot rotates right by 45°, to avoid the front left obstacle. When the robot 100 enters the base station 200, the robot 100 disables the function of the collision cover, that is to say, when the collision cover comes into contact with a side wall in the base station 200, the robot 100 does not frequently adjust its own moving direction, thereby making it convenient for the robot 100 to smoothly dock to the base station 200, to return to the correct operating position.

In another embodiment, the position detector of the cleaning robot 100 further includes a magnetic detection sensor, for example, a Hall sensor, and a relative distance between the cleaning robot and the base station 200 is determined by detecting the magnetic element disposed on the base station 200. Specifically, when the cleaning robot 100 detects the first magnet disposed on the base station 200, it is determined that the cleaning robot 100 reaches the first operating position 251; and when the cleaning robot 100 detects the second magnet disposed on the base station 200, it is determined that the cleaning robot 100 reaches the second operating position 252. Specifically, the position at which the first magnet is disposed is close to the first operating position 251 of the base station 200, and the position at which the second magnet is disposed is close to the second operating position 252 of the base station 200. Specifically, a corresponding quantity of positions of a magnet herein may be set according to needs and is not limited to one.

Specifically, although in this embodiment, the magnet is disposed on the base station 200, and the Hall sensor is disposed on the cleaning robot 100, this is only one implementation of the present disclosure, and this should not be used as a limitation on content of the present disclosure.

In this embodiment, when the position detection sensor determines that the cleaning robot 100 reaches the first operating position 251, the control unit controls the connection assembly 120 to move, so that the mopping module 310 is separated from the main body of the cleaning robot 100, and the mopping module 310 moves under the action of the mopping module collection unit to collect the mopping module 310 into the first storage unit 211; and the mopping module providing unit takes out the mopping module 310 from the second storage unit 212, the mopping module 310 moves under the action of the mopping module providing unit to provide the mopping module 310 to the cleaning robot 100 for mounting, and when the position sensor determines that the cleaning robot 100 reaches the second operating position 252, the control unit controls the connection assembly 120 to move to mount the mopping module 310.

Figure 25:
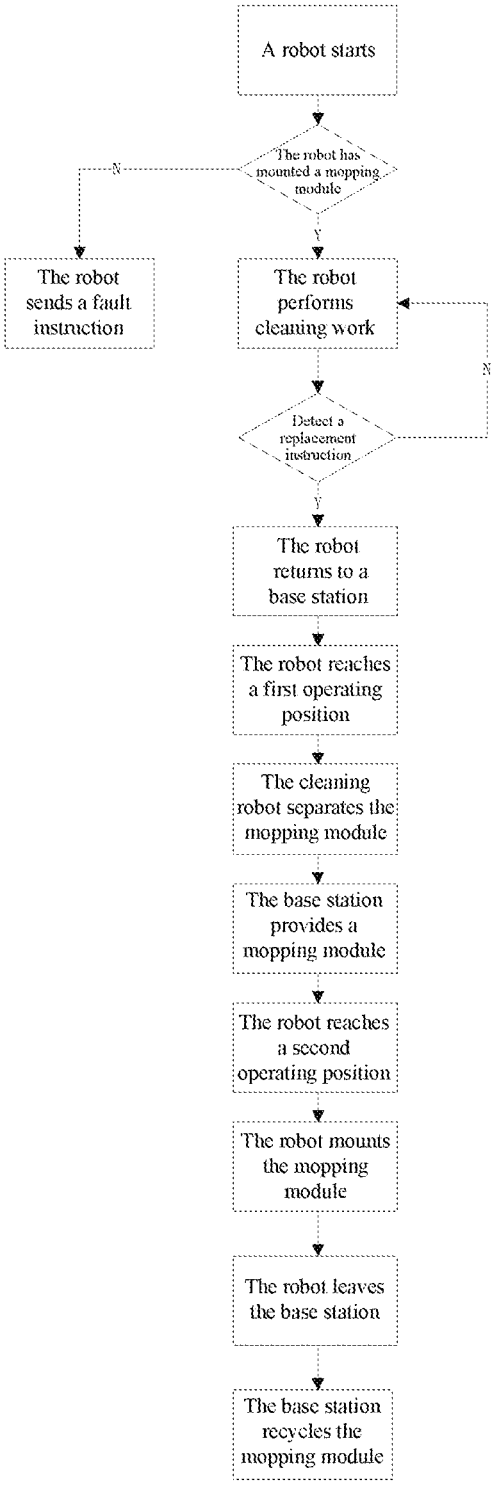
FIG. 25 is a working flowchart of replacing a mopping module by a robot cleaning system according to the present disclosure.

In this embodiment, the method for replacing a mopping module by the cleaning robot 100 includes: Referring to FIG. 25, FIG. 25 is a schematic flowchart of replacing a mopping module by the cleaning robot according to this embodiment. Before the cleaning robot 100 performs cleaning work, the mopping module mounting detection sensor determines whether a mopping module 310 is currently mounted on the cleaning robot 100, and the cleaning robot 100 sends a fault instruction to the user when a determination result is that no mopping module 310 is mounted; and when a determination result is that a mopping module 310 is mounted, the control unit of the cleaning robot 100 controls the connection assembly 120 to adjust a height of the mopping module 310 to the ground, so that the mopping module 310 comes into contact with the ground to perform cleaning work.

In this embodiment, before the cleaning robot reaches the base station, the base station needs to make preparations to greet arrival of the robot. Specifically, a communication module is disposed on each of the cleaning robot and the base station, and the cleaning robot and the base station can communicate with each other through the communication modules. Specifically, before returning to the base station, the cleaning robot can inform the base station that the cleaning robot is to be charged or is to replace a mopping module. Specifically, when the cleaning robot is to replace a mopping module, the base station needs to make preparations to replace the mopping module; and before the cleaning robot enters the base station, the mopping module collection unit prepares to collect a dirty mopping module, and the mopping module providing unit provides a clean mopping module to the second operating position for the cleaning robot to replace. Specifically, the cleaning robot and the base station communicate with each other through infrared.

The cleaning robot 100 moves in the working region according to a preset path, to efficiently clean the working region, and a severely contaminated region and a stubborn stain region detected during cleaning are emphatically processed. Moreover, during cleaning, if a cliff, an obstacle, or the like is detected, a policy such as avoidance is taken.

After the cleaning robot 100 performs a part of sweeping work in the working region, the current mopping module 310 gradually becomes dirty. If the dirty mopping module 310 continues to be used for cleaning the working surface, the cleaning effect may be greatly degraded, and meanwhile, the dirty mopping module 310 may further contaminate the cleaned ground. When working in the working region and receiving a replacement instruction for instructing the cleaning robot 100 to return to the base station 200, the cleaning robot 100 returns to the base station 200 to replace the mopping module 310, referring to FIG. 19. The cleaning robot 100 includes a mopping module state detection sensor, configured to detect a contamination extent the mopping module 310 mounted on the cleaning robot 100, and when it is detected that the contamination extent of the currently mounted mopping module 310 reaches a threshold, the control unit generates a replacement instruction, to control the cleaning robot 100 to return to the base station 200. In an embodiment, the cleaning robot 100 includes a communication module capable of communicating with a mobile apparatus (for example, a smartphone or an iPad) through an appropriate wireless network, the user may remotely set a working time, a working area, a working schedule, and the like of the cleaning robot 100 through the mobile apparatus, and the user may alternatively perform related setting through a control panel on the cleaning robot 100. When the mopping module 310 currently used by the cleaning robot 100 reaches a working time, a working area, or a working schedule preset by the user, the control unit generates a replacement instruction and controls the cleaning robot 100 to return to the base station 200 to replace the mopping module.

Figure 20:
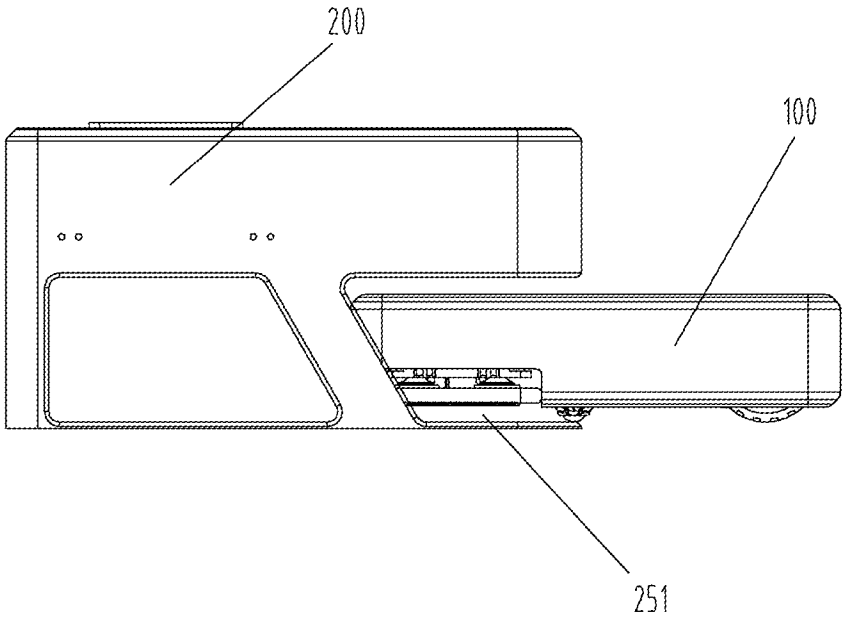

The cleaning robot 100 returns to the base station 200 to replace the mopping module 310, including the cleaning robot 100 returns to the base station 200 to separate the mopping module 310. The cleaning robot 100 returns to base station 200 to separate the mopping module including: The cleaning robot 100 includes a position detection sensor, configured to determine whether the cleaning robot 100 currently reaches the first operating position 251 on the base plate of the base station. Specifically, the position detection sensor includes a ranging sensor, configured to measure a relative distance between the cleaning robot 100 and the base station 200 to determine whether the cleaning robot 100 reaches the first operating position 251. Specifically, the position detection sensor includes a Hall detection sensor, configured to detect whether a magnet exists on the base station 200 to determine whether the cleaning robot 100 reaches the first operating position 251. The cleaning robot 100 determines that the cleaning robot itself reaches the first operating position 251 of the base station 200. Referring to FIG. 20, the control unit controls the mopping module 310 to be separated from the body of the cleaning robot 100, and the mopping module 310 falls onto the first operating position 251 on the base plate of the base station.

The returning, by the cleaning robot 100, to the base station 200 to replace the mopping module 310 includes collecting, by the base station 200, the mopping module 310. The collecting, by the base station 200, of the mopping module 310 includes: moving, by the mopping module collection unit 231, in the vertical direction to pick up the mopping module 310. Specifically, the lifting mechanism 232 of the mopping module collection unit 231 vertically moves downward to approach the mopping module 310, the adsorption assembly 233 of the mopping module collection unit 231 is connected to the mopping module 310, and the mopping module collection unit 231 drives the mopping module 310 to vertically move upward to collect the mopping module 310 into the first storage unit 211.

The returning, by the cleaning robot 100, to the base station 200 to replace the mopping module 310 includes providing, by the base station 200, the mopping module 310. The providing, by the base station 200, of the mopping module 310 includes: moving, by the slider of the mopping module providing unit, in a set direction to fix or release the mopping module 310 in the second storage unit 212. Specifically, the motor drives the transfer assembly to move in the set direction to drive the slider 242 to move from the first position to the second position. When the slider 242 is at the first position, the mopping module providing unit fixes the mopping module 310, and when the slider 242 is at the second position, the mopping module providing unit releases the mopping module 310. Through the mopping module providing unit, the mopping module 310 in the second storage unit 212 is transferred to the base plate of the base station for the cleaning robot 100 to mount.

Figure 21:
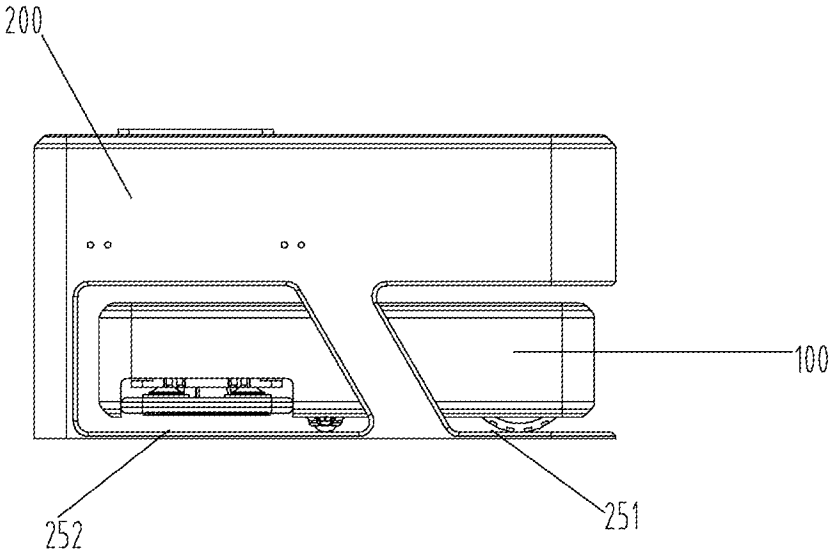

The returning, by the cleaning robot 100, to the base station 200 to replace the mopping module 310 includes returning, by the cleaning robot 100, to the base station 200 to mount the mopping module 310. Referring to FIG. 21, the returning, by the cleaning robot 100, to the base station 200 to mount the mopping module 310 includes: As described above, the cleaning robot 100 includes a ranging sensor or Hall detection sensor, the cleaning robot 100 determines that the cleaning robot itself reaches the second operating position 252 of the base station 200, and the control unit controls the connection assembly 120 to mount the mopping module 310.

In this embodiment, when the cleaning robot 100 determines that the cleaning robot itself reaches the first operating position, the mopping module is separated from the main body, the cleaning robot continues to travel, to reach the second operating position, the cleaning robot mounts, at the second operating position, the mopping module taken out by the mopping module providing unit from the second storage unit, the robot leaves the base station after the mopping module is mounted completely, and the mopping module collection unit of the base station collects the mopping module separated from the main body of the robot. Alternatively, when reaching the first operating position, the cleaning robot separates the mopping module, the cleaning robot leaves the base station, the mopping module collection unit collects the mopping module separated from the main body of the robot, the robot again enters the base station, the robot mounts, when reaching the second operating position, the mopping module taken out by the mopping module providing unit from the second storage unit, and the robot leaves the base station after the mounting is completed.

In this embodiment, the second storage unit 212 is disposed in front of the first storage unit 211 relative to the pull-in direction of the robot, and when entering the base station 200 to replace the mopping module, the cleaning robot 100 first approaches the first storage unit, and continues to travel, to approach the second storage unit. In another embodiment, the first storage unit may be disposed in front of the second storage unit, and when entering the base station to replace the mopping module, the cleaning robot first approaches the second storage unit, and continues to travel, to approach the first storage unit. In this embodiment, the second operating position is disposed in front of the first operating position relative to the direction in which the robot enters the base station, and when entering the base station, the cleaning robot first reaches the first operating position, and continues to travel, to reach the second operating position. In another embodiment, the first operating position is disposed in front of the second operating position relative to the direction in which the cleaning robot enters the base station, and when entering the base station, the cleaning robot first reaches the second operating position, and continues to travel, to reach the first operating position. In this embodiment, the second operating position and the second storage unit are correspondingly disposed up and down in the vertical direction, and the first operating position and the first storage unit are correspondingly disposed up and down in the vertical direction. After the cleaning robot reaches the first operating position, the cleaning robot separates the mopping module from the main body, and the mopping module is caused through the transfer module to move in the vertical direction to transfer the mopping module to the first storage unit. After the robot reaches the second operating position, the mopping module in the second storage unit is released under the action of the transfer module and caused to move in the vertical direction, to transfer the mopping module to the cleaning robot for mounting. In another embodiment, the storage module and the operating position may be alternatively not correspondingly disposed in the vertical direction, and the mopping module partially pivots in the vertical direction under the action of the transfer module, to transfer the mopping module.

Beneficial effects of the foregoing embodiment are: the cleaning robot 100 automatically separates/mounts the mopping module 310, the base station 200 causes, under the action of the mopping module collection unit, the mopping module 310 to move in the vertical direction, thereby automatically collecting the dirty mopping module 310 into the first storage unit 211 of the base station 200, and the base station 200 transfers, through the mopping module providing unit, the mopping module 310 in the second storage unit 212 to the cleaning robot 100 for mounting. Through the design of the mopping module providing unit and the mopping module collection unit, the process of providing and collecting the mopping module 310 is convenient and simple. Moreover, through the design of the relationship between the operating position of the cleaning robot 100 and the position of the storage module 210, the base station is structurally compact. Additionally, by integrally designing the charging module in the base station 200, the base station of the cleaning robot 100 not only may be configured to replace the mopping module 310, but also may serve as a charging station, so that the functions are reusable, the structure is simple, and the costs are reduced.

Figure 23:
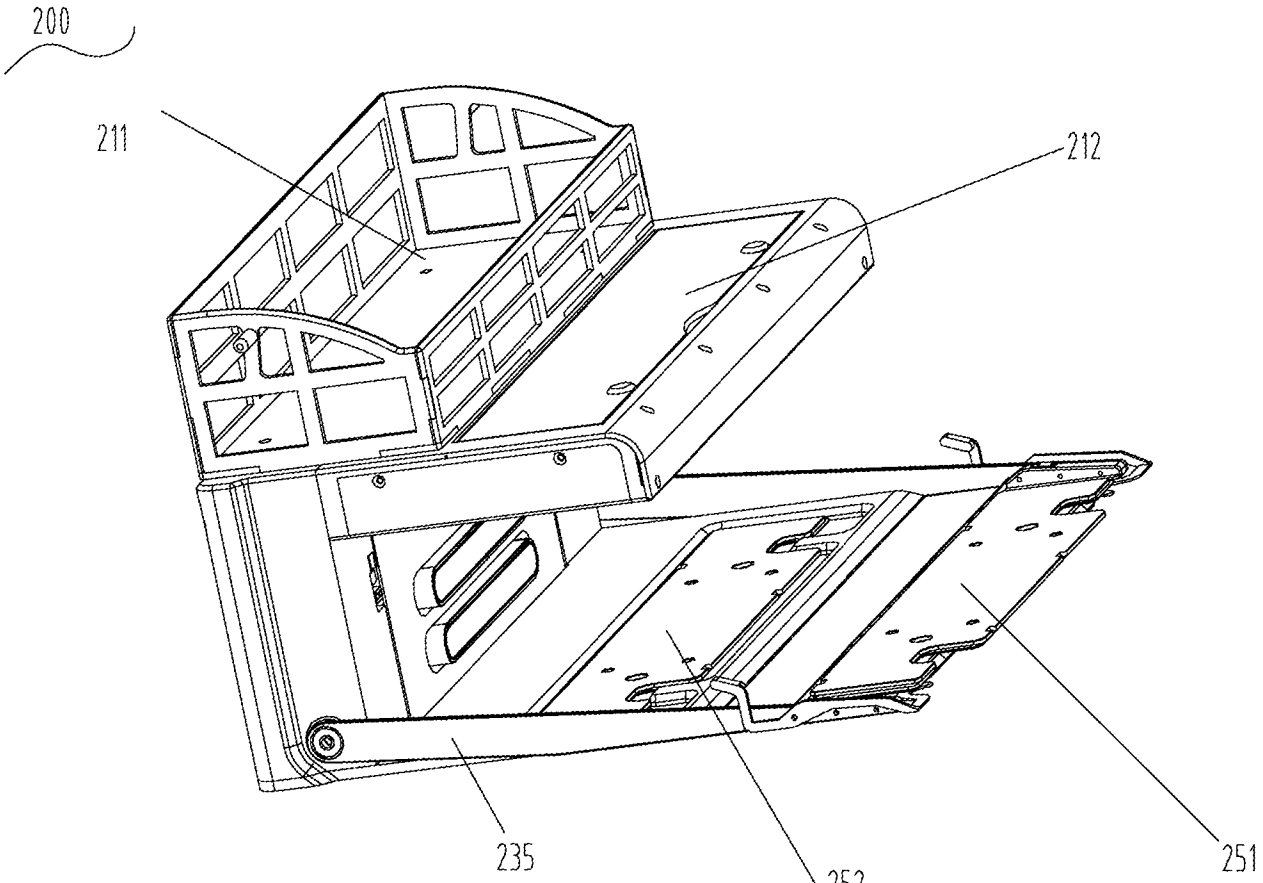
FIG. 23 is a schematic diagram of a base station at a first position according to another embodiment of the present disclosure.

FIG. 23 is still another embodiment of the design of the base station 200 according to the present disclosure. In this embodiment, the base station 200 includes a storage module 210 configured to store a mopping module 310, where the storage module 210 includes a first storage unit 211 and a second storage unit 212, where the first storage unit 211 is configured to store a dirty mopping module 310 separated from the cleaning robot 100, the second storage unit 212 is configured to store a clean mopping module 310 provided to the cleaning robot 100 for replacement, and the first storage unit 211 and the second storage unit 212 are abreast disposed on the base station 200. Specifically, the bottom of the first storage unit 211 and that of the second storage unit 212 are approximately disposed in the same plane. In this embodiment, the first storage unit 211 is located in front of the second storage unit 212 relative to the pull-in direction of the cleaning robot 100, that is to say, when the cleaning robot 100 returns to the base station 200, the cleaning robot 100 first approaches the second storage unit 212, and the cleaning robot 100 continues to travel along the pull-in direction, and then approaches the first storage unit 211. In this embodiment, the base station 200 includes a transfer module, configured to transfer a mopping module 310. Specifically, the transfer module includes a mopping module collection unit, configured to automatically transfer the mopping module 310 separated from the cleaning robot 100 to the first storage unit 211 to take in the mopping module 310, and the transfer module includes a mopping module providing unit, configured to automatically transfer the mopping module 310 in the second storage unit 212 to the cleaning robot 100 for mounting. In another embodiment, the first storage unit 211 and the second storage unit 212 may be alternatively distributed on the base station 200 in the vertical direction. Specifically, the first storage unit 211 and the second storage unit 212 are distributed up and down in the vertical direction. In an embodiment, the first storage unit 211 and the second storage unit 212 are located in the same storage bin. Optionally, the first storage unit 211 is located below the storage bin, and the second storage unit 212 is located above the storage bin. Optionally, a stop compartment is disposed between the first storage unit 211 and the second storage unit 212, to separate the first storage unit 211 from the second storage unit 212, thereby preventing a dirty mopping module 310 from contaminating a clean mopping module 310. An advantage of such design lies in that, the space utilization of the base station 200 can be improved.

In this embodiment, the base station 200 includes an operating position provided for the cleaning robot 100 to dock. Specifically, the operating position includes a first operating position 251, the cleaning robot 100 enters the base station 200 to reach the first operating position 251, the control unit controls the connection assembly 120 to separate the mopping module 310 connected to the main body of the cleaning robot 100 from the main body of the cleaning robot 100; and the operating position includes a second operating position 252, and the cleaning robot 100 mounts, at the second operating position 252, the mopping module 310 provided by the base station 200. Specifically, the second operating position 252 is disposed in front of the first operating position relative to the pull-in direction of the cleaning robot 100. The second storage unit 212 is located in the vertical direction of the second operating position 252. Specifically, the second storage unit 212 is located above the second operating position 252, the mopping module 310 in the second storage unit 212 in moves in a vertical plane under the action of the mopping module providing unit to transfer the mopping module 310 to the second operating position 252 for the cleaning robot 100 to mount.

Figure 24:
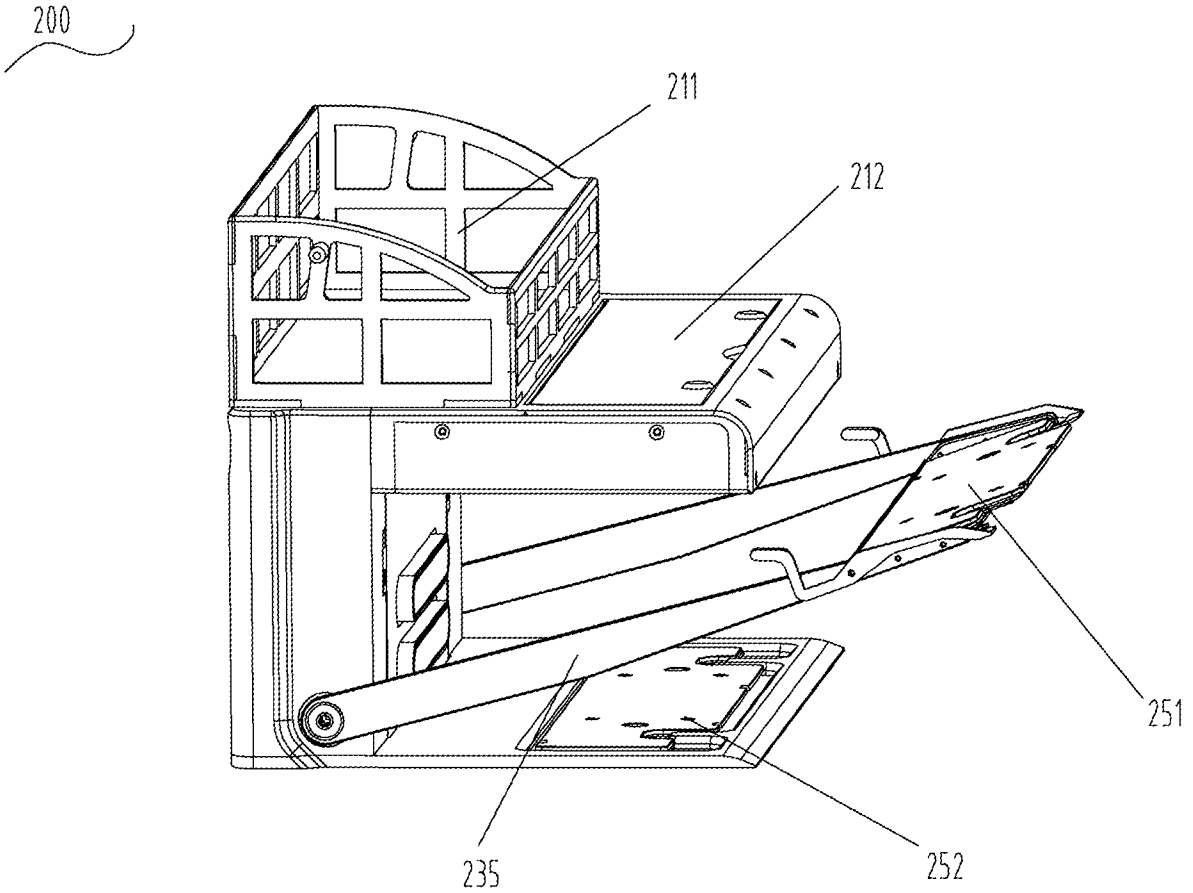
FIG. 24 is a schematic diagram of a base station at a second position according to another embodiment of the present disclosure.

In this embodiment, the base station includes a mopping module collection unit 231. Specifically, referring to FIG. 23 and FIG. 24, the mopping module collection unit 231 includes an overturning structure 235, the bottom end of the supporting portion of the base station serves as a rotation shaft, and the overturning structure is capable of pivoting in the vertical direction along the supporting shaft, to collect the mopping module into the mopping module collection unit. The mopping module collection unit 231 includes a connecting rod and a holding portion, the connecting rod is connected to the holding portion, the mopping module collection unit is connected to the supporting portion of the base station through the connecting rod, and the holding portion of the mopping module collection unit is configured to place the mopping module 310. When the mopping module collection unit is at an initial position, the mopping module collection unit is disposed parallel to the horizontal plane, the cleaning robot reaches the first operating position of the base station, and separates the mopping module from the main body of the cleaning robot into the holding portion of the mopping module collection unit, the mopping module collection unit counterclockwise rotates around the supporting shaft in the vertical direction through the connecting rod, and the mopping module placed in the holding portion counterclockwise rotates in the vertical plane with the connecting rod to place the mopping module in the holding portion into the first storage unit. FIG. 24 shows a case that the connecting rod of the mopping module collection unit drives the holding portion to counterclockwise rotate in the vertical plane. After the mopping module is placed in the first storage unit, the mopping module collection unit clockwise rotates in the vertical direction, so that the mopping module collection unit returns to the initial position.

In another embodiment of the present disclosure, as shown in FIG. 1, the present disclosure provides a robot cleaning system 300, including a cleaning robot 100 configured to perform cleaning work on an indoor working surface and a base station 200 for the cleaning robot 100. The base station 200 is a docking station for the cleaning robot, and may be configured to perform a preset operation for the cleaning robot 100, for example, charge the cleaning robot 100, replace or wash a mopping module, replace or add a part, or perform another preset operation for the cleaning robot 100.

As shown in FIG. 2 and FIG. 3, the cleaning robot 100 includes a main body, a mobile module configured to drive the main body to move on the working surface, a cleaning mechanism configured to perform cleaning work on the working surface, a power mechanism configured to provide power to the cleaning robot 100, an energy module configured to provide energy, and a control unit configured to control the cleaning robot 100 to autonomously work on the working surface. The mobile module includes a moving wheel 110, and in another embodiment, the mobile module may alternatively include a track structure or move in another regular manner. In this embodiment, the cleaning robot 100 is a mopping robot, and the cleaning mechanism is a mopping module 310 configured to perform mopping work on the working surface. In another embodiment, the cleaning robot 100 may be alternatively a sweeping robot, a scrubbing robot, or the like, and correspondingly, the cleaning mechanism thereof may include a roller brush, a side brush, and the like. The power mechanism includes a motor and a transmission mechanism connected to the motor, the transmission mechanism is connected to the mobile module, the motor drives the transmission mechanism to work, and a transmission effect of the transmission mechanism enables the mobile module to move. The transmission mechanism may be a worm gear and worm mechanism, a bevel gear mechanism, or the like.

The base station 200 is a charging station configured to charge the cleaning robot 100 or a docking station configured to perform a preset operation for the cleaning robot. In this embodiment, the base station 200 not only may charge the cleaning robot 100, but also may perform another preset operation, a function of charging and a function of performing another operation are integrated in the same base station 200, to reduce the costs, and docking sites are reduced, to make it convenient for the user to operate or observe the cleaning robot 100.

In this embodiment, the base station 200 is a mopping module replacement station configured to replace a mopping module of the cleaning robot 100. In another embodiment, the base station 200 may be alternatively an optional module adding/removing station configured to add/remove an optional module (for example, an air purification module) to/from the cleaning robot 100. In another embodiment, the base station 200 may be alternatively a cleaning station configured to wash a mopping module, or the like. Moreover, a charging function is further integrated into the base station 200, and when the power level of the cleaning robot 100 is insufficient, the cleaning robot 100 may automatically return to the base station 200 for charging, to replenish electric energy.

The base station 200 includes a base 253, a functional module disposed above the base 253 and configured to perform a preset function, an accommodation cavity 258 enclosed by the functional module and the base 253 to accommodate the cleaning robot, and a charging module configured to charge the cleaning robot. The functional module is located above the accommodation cavity 258. The charging module includes charging terminals configured to dock to and charge the cleaning robot 100. The base station 200 includes a base plate 2531 and a supporting portion configured to connect the base plate and the functional module. The preset function performed by the functional module corresponds to the preset operation predefined by the base station 200. In this embodiment, the base station 200 is a mopping module replacement station configured to automatically replace a mopping module, and correspondingly, the functional module is a structure or substance required during mopping module replacement.

In this embodiment, the functional module is configured to at least perform a storage function, and the functional module includes a storage module 215 configured to accommodate a storage substance. The storage substance is a substance required when the base station 200 performs the preset operation. For example, in this embodiment, the base station 200 is a mopping module replacement station configured to automatically replace a mopping module. When mopping module replacement is performed, a new (clean) mopping module is required, and a dirty mopping module is generated. In this case, the storage module configured to accommodate these mopping modules is required. Therefore, the functional module is a storage module 210 configured to accommodate the mopping modules. In another embodiment, the functional module may be alternatively a storage module configured to store another substance, for example, configured to store an air purification module, water, or another washing medium. In another embodiment, the functional module may be alternatively configured to perform another function, for example, dust proofing, washing, or charging.

Figure 53:
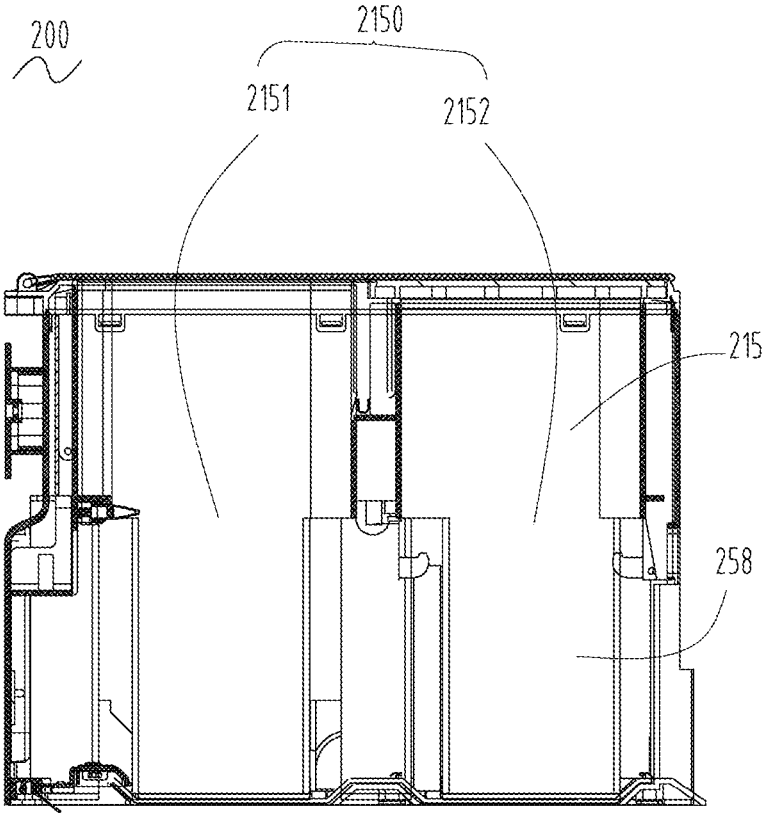
FIG. 53 is a schematic diagram of an opened communicating mouth on a base station according to an embodiment of the present disclosure.
Figure 54:
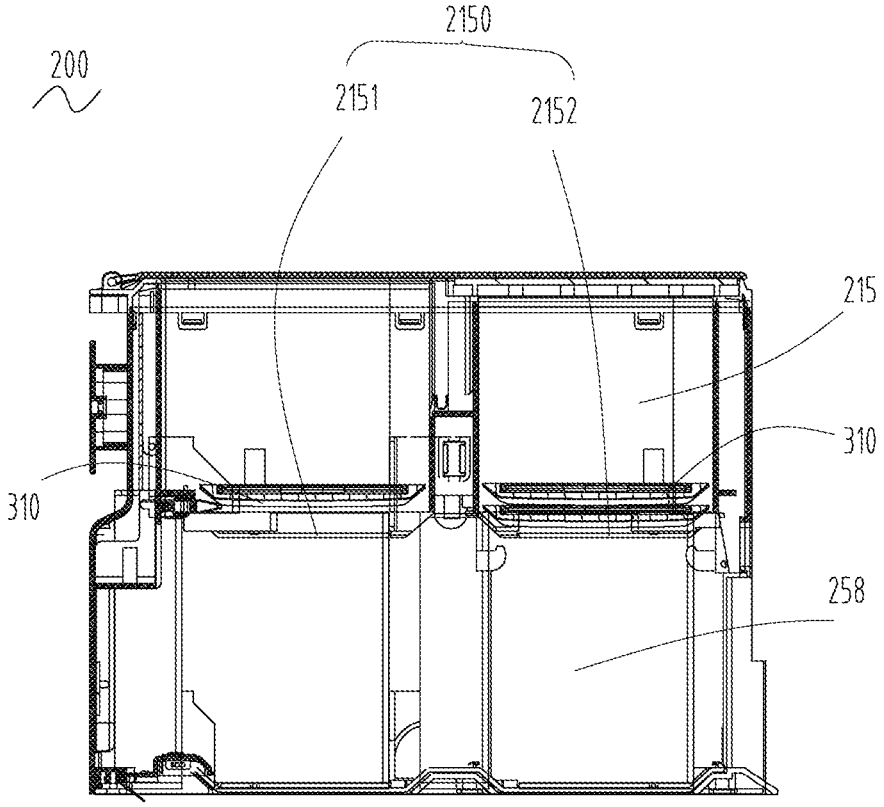
FIG. 54 is a schematic diagram of a closed communicating mouth on the base station shown in FIG. 53.

As shown in FIG. 53 and FIG. 54, the storage module 215 is located above the accommodation cavity 258, and the functional module includes a communicating mouth 2150 that may be opened and closed. When the communicating mouth 2150 is in an opened state, the storage module 215 is in communication with the accommodation cavity 258 up and down; and when the communicating mouth 2150 is in a closed state, the storage module 215 is not in communication with the accommodation cavity 258 up and down. The storage substance may be directly transferred up and down between the storage module 215 and the accommodation cavity 258 through the communicating mouth, to automatically mount the substance stored in the base station 200 onto the cleaning robot, or automatically store the substance detached from the cleaning robot 100 into the storage module 215 in the base station 200. The base plate 2531 includes an accommodation groove configured to accommodate the storage substance, so that when the storage substance is transferred from the storage module 215 to the accommodation cavity 258, the storage substance is accommodated, to avoid or reduce protrusion of the storage substance from a surface of the base plate 2531.

In this embodiment, the cleaning robot 100 has a function of returning to the base station 200 to automatically replace a mopping module 310. In this case, the storage module 215 is configured to store mopping modules 310, the storage module 215 includes a first storage unit 2153 configured to store a dirty mopping module and a second storage unit 2154 configured to store a clean mopping module, and the communicating mouth 2150 includes a first communicating mouth 2151 and a second communicating mouth 2152 that are respectively located below the first storage unit 2153 and the second storage unit 2154 and that may be opened and closed. The first storage unit 2151 and the second storage unit 2152 are located abreast above the accommodation cavity 258 in the horizontal direction. The corresponding base plate 2531 has an accommodation groove configured to accommodate the dirty mopping module and an accommodation groove configured to accommodate the clean mopping module. In an aspect, the mopping modules may be limited, and in another aspect, the mopping modules may be prevented from excessively protruding from the base plate 2531, to hinder the cleaning robot 100 from moving.

The cleaning robot 100 usually has a control panel, the user may operate the control panel of the cleaning robot 100 to control actions of the cleaning robot 100, and the operating panel of the cleaning robot 100 is usually disposed on an upper surface of the cleaning robot 100. Because a function other than charging is integrated in the base station 200, the functional module is disposed above the base station and located above the accommodation cavity 258, to reduce the occupied area. However, when the functional module is disposed above the accommodation cavity 258, and when the cleaning robot 100 returns to the base station 200, the cleaning robot 100 is accommodated in the accommodation cavity 258, an upper surface of the cleaning robot 100 is blocked by the functional module, and the user cannot directly operate the operating panel on the cleaning robot 100. In this case, if the user intends to operate the operating panel on the cleaning robot 100 to cause the cleaning robot to execute a corresponding instruction, or intends to directly perform some other operations on the cleaning robot 100, the user can only manually forcibly pull out the cleaning robot 100. Such an operation dirties the hands of the user and reduces satisfaction of the user experience, and the forcible action may further cause the structure of the cleaning robot 100 to be damaged or cause the program to be disordered.

In this embodiment, the base station 200 further includes a signal transmitter 259 configured to at least send, to the cleaning robot 100, a leaving instruction signal of leaving the accommodation cavity 258, and an operating portion 340 electrically connected to the signal transmitter 259 and configured to at least control the signal transmitter to send the leaving instruction signal. When the cleaning robot 100 enters the accommodation cavity 258 of the base station 200, the operating portion 340 may be directly operated to cause the cleaning robot to leave the base station and then perform a related operation.

In an embodiment, a detachable battery pack is mounted on the body of the cleaning robot 100. When the user needs to remove the battery pack, if the cleaning robot 100 is located in the base station 200, the operating portion 340 on the base station is operated, so that the cleaning robot 100 leaves the base station and stops working, to make it convenient for the user to remove the battery pack. In an embodiment, a water tank is mounted on the cleaning robot 100, and is capable of providing moisture to the mopping module 310 to implement wet mopping on the ground. When the water storage amount in the water tank is relatively small, the user needs to add water to the water tank. In this case, if the cleaning robot 100 is located in the base station, the user may operate the operating portion 340 of the base station to cause the cleaning robot to leave the base station 200 and dock outside the base station, making it convenient for the user to remove the water tank and mount the water tank.

Certainly, another function may be further integrated in the signal transmitter 259 and the operating portion 340, so that the user can operate the operating portion 340 on the base station 200 to control the cleaning robot 100 to perform another instruction. For example, the signal transmitter 259 may not be merely limited to sending a leaving instruction signal, the signal transmitter 259 may be further configured to send an entering instruction signal of entering the accommodation cavity 258. Correspondingly, the operating portion 340 is electrically connected to the signal transmitter 259, and may control the signal transmitter 259 to send the entering instruction signal, thereby operating the operating portion 340 to control the cleaning robot 100 to execute an instruction for entering the accommodation cavity 258. Certainly, the signal transmitter 259 may be further configured to send a guiding signal of guiding the cleaning robot 100 to return or send another signal. Correspondingly, the operating portion 340 is electrically connected to the signal transmitter 259, and may control the signal transmitter 259 to send the corresponding guiding signal or another signal, to control the cleaning robot 100 to execute another instruction.

The operating portion 340 may be provided for the user to operate, to control the signal transmitter 259 to transmit a corresponding signal, thereby controlling the cleaning robot 100 to execute a corresponding instruction. For example, the user may operate the operating portion 340, to control the signal transmitter 259 to transmit a leaving signal instruction, thereby controlling the cleaning robot 100 to execute an instruction for leaving the accommodation cavity, so that when the cleaning robot 100 is accommodated in the accommodation cavity 258, the user may directly operate the operating portion 340 to control the cleaning robot 100 to leave the accommodation cavity 258, to avoid forcibly manually interfering with the cleaning robot 100, thereby effectively improving user experience. Similarly, when the signal transmitter 259 is further integrated to send the entering instruction, and when the cleaning robot 100 is located outside the base station 200, the user may alternatively operate the operating portion 340, to quickly recall (for example, one-key recall) the cleaning robot 100, to avoid looking for the cleaning robot 100 everywhere.

Figure 36:
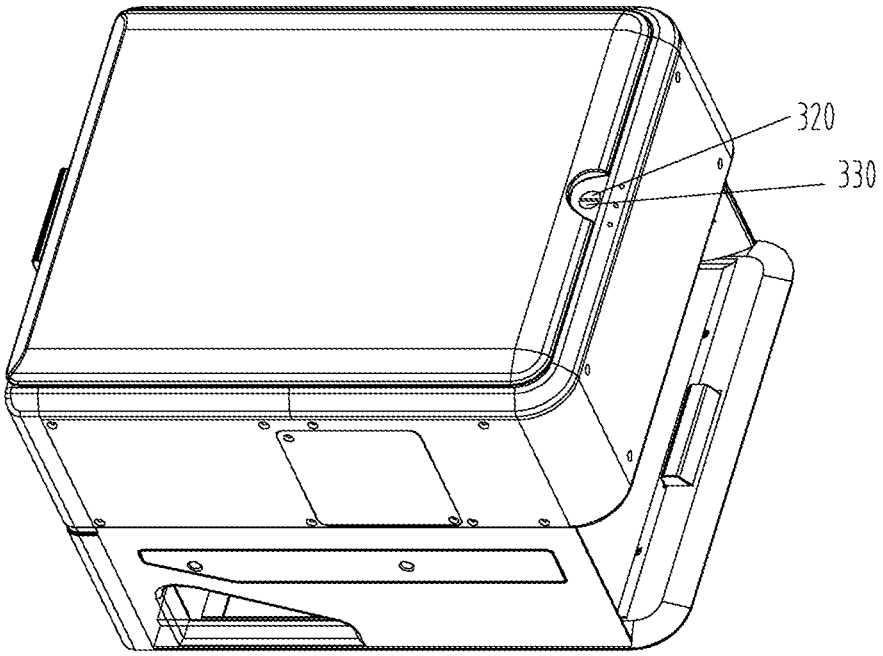
FIG. 36 is a schematic diagram of an operating portion on a base station according to an embodiment of the present disclosure.

The operating portion 340 may be a physical operating element, a virtual operating element on a screen, or the like, and the operating element may be a button, a foot stepping pedal, or the like. When the signal transmitter 259 may send different signals, the operating portion 340 may be as what is shown in FIG. 1, and has only one operating element, configured to control, through different operating methods such as an operating duration or a quantity of operating times, the signal transmitter 259 to send different signals; and may be alternatively provided with a plurality of operating elements, and all of the operating elements correspond to different signals. For example, the operating portion 340 includes an entering operating element configured to control the signal transmitter 259 to send the entering instruction signal and a leaving operating element configured to control the signal transmitter 259 to send the leaving instruction signal and that are disposed independently of each other. Alternatively, as shown in FIG. 36, two leaving operating elements are disposed on the base station 200. Specifically, the operating portion 340 of the base station 200 includes a first operating element 320 and a second operating element 330. When the cleaning robot 100 needs to leave the base station, if the first operating element 320 on the base station 200 is pressed, the cleaning robot 100 leaves the base station and continues to perform cleaning work in the working region; and if the second operating element 330 on the base station 200 is pressed, the cleaning robot 100 leaves the base station 200, and docks outside the base station, making it convenient for the user to remove/mount the battery pack, and remove/mount the water tank and the like.

The operating portion 340 is disposed on an outer surface of the base station 200, to make it convenient for the user to operate. As shown in FIG. 1, the operating portion 340 may be a key disposed on an upper surface of the base station 200, to make it convenient for the user to press. Certainly, the operating portion 340 may be alternatively a foot stepping key disposed beside the base station 200, to make it convenient for the user to operate. In another embodiment, the operating portion 340 may be alternatively disposed on another outer surface of the base station 200, for example, a front or rear surface, provided that it is convenient for the user to operate.

The cleaning robot 100 includes a signal receiver configured to receive a signal transmitted by the signal transmitter 259. The signal transmitter 259 may be an infrared signal transmitter, a Bluetooth signal transmitter, a Wi-Fi signal transmitter, or the like. In this embodiment, an example in which the signal transmitter 259 is an infrared signal transmitter is used. The signal transmitter 259 is disposed in the accommodation cavity 258, the accommodation cavity 258 has an opening 255 in communication with the outside provided for the cleaning robot 100 to leave and/or enter, and a supporting portion 2532 is disposed on a side of the base station 200 opposite to the opening 255, so that when the cleaning robot 100 docks, projections of the cleaning robot 100 and the functional module in the horizontal plane approximately coincide. Therefore, the structure of the base station 200 in the horizontal direction is more compact, thereby reducing the occupied area of the entire robot cleaning system 300. The signal transmitter 259 is disposed on the supporting portion 2532, and configured to transmit a signal toward the opening 255. When the cleaning robot 100 docks to the base station 200, the cleaning robot 100 is located on a side of the supporting portion 2532 facing the opening 255. Therefore, transmission of the signal transmitter 259 toward the opening 255 is to transmit a signal just directly facing the cleaning robot 100, making it convenient to receive the signal on the cleaning robot 100. However, when the cleaning robot 100 does not dock to the base station 200, the signal transmitter 259 transmits a signal to the outside of the base station 200 through the opening 255, to prevent the signal from being blocked by another component on the base station 200, making it convenient for the cleaning robot 100 to receive the signal. The signal receiver is located in front of the movement direction of the cleaning robot 100, so that it is easier to receive the signal transmitted by the signal transmitter 259.

The signal transmitter 259 may be further configured to transmit a guiding signal of guiding the cleaning robot 100 to move toward the base station 200. After detecting that its own power level is less than a threshold, the cleaning robot 100 moves toward the base station 200 according to a preset path, continuously detects, during moving, a signal sent by the charging module, and determines a position of the base station 200 according to the signal and completes charging and docking. In this embodiment, the charging terminals are located on the supporting portion 2532 or the base plate 2531. Certainly, in some embodiments, the charging terminals may be alternatively located at a position such as the bottom of the storage module 210, so that the top of the cleaning robot 100 is in contact with the charging terminals to perform charging. After entering the base station 200 to complete docking, the cleaning robot 100 starts charging, and the cleaning robot 100 leaves the base station 200 after the charging ends. In another embodiment, a manner in which the cleaning robot 100 returns for charging further includes wireless charging, the charging module includes a transmitting coil, and the cleaning robot 100 includes a receiving coil, to charge the cleaning robot 100 through electromagnetic induction between the transmitting coil and the receiving coil. The charging module is disposed on the base station 200, whose beneficial effect lies in that functions of the base station 200 are integrated, so that the base station 200 is reusable in function and compact in structure.

In still another embodiment of the present disclosure, as shown in FIG. 1, a robot cleaning system 300 is provided, including a cleaning robot 100 configured to perform cleaning work on an indoor working surface and a base station 200 for the cleaning robot 100. The base station 200 is a docking station for the cleaning robot, and may be configured to perform a preset operation for the cleaning robot 100, for example, charge the cleaning robot 100, replace or wash a mopping module, replace or add a part, or perform another preset operation for the cleaning robot 100.

As shown in FIG. 2 and FIG. 3, the cleaning robot 100 includes a main body, a mobile module configured to drive the main body to move on the working surface, a cleaning mechanism configured to perform cleaning work on the working surface, a power mechanism configured to provide power to the cleaning robot 100, an energy module configured to provide energy, and a control unit configured to control the cleaning robot 100 to autonomously work on the working surface. The mobile module includes a moving wheel 110, and in another embodiment, the mobile module may alternatively include a track structure or move in another regular manner. In this embodiment, the cleaning robot 100 is a mopping robot, and the cleaning mechanism is a mopping module 310 configured to perform mopping work on the working surface. In another embodiment, the cleaning robot 100 may be alternatively a sweeping robot, a scrubbing robot, or the like, and correspondingly, the cleaning mechanism thereof may include a roller brush, a side brush, and the like. The power mechanism includes a motor and a transmission mechanism connected to the motor, the transmission mechanism is connected to the mobile module, the motor drives the transmission mechanism to work, and a transmission effect of the transmission mechanism enables the mobile module to move. The transmission mechanism may be a worm gear and worm mechanism, a bevel gear mechanism, or the like.

In this embodiment, the base station 200 is a mopping module replacement station configured to automatically replace a mopping module of the cleaning robot 100, and is also a charging station configured to charge the cleaning robot 100. When the power level of the cleaning robot 100 is insufficient, the cleaning robot 100 may automatically return to the base station 200 for charging, to replenish electric energy. Functions of charging and replacing a mopping module are integrated in the same base station 200, to reduce the costs, and docking sites are reduced, to make it convenient for the user to operate or observe the cleaning robot 100. Certainly, in another embodiment, the base station 200 may be alternatively only a mopping module replacement station.

The base station 200 includes a base 253, a charging module disposed on the base 253 and configured to charge the cleaning robot 100, a storage module 210 is configured to store mopping modules of the cleaning robot 100, a transfer module configured to drive a mopping module 310 to move, and a control unit configured to control the transfer module to autonomously drive the mopping module 310 to move to automatically replace a mopping module 310.

In this embodiment, the storage module 210 is disposed above the base 253, and the storage module 210 and the base 253 enclose an accommodation cavity 258 configured to accommodate the cleaning robot, where the storage module 210 is located above the accommodation cavity 258. In another embodiment, the storage module 210 may be alternatively disposed at another position on the base 253, for example, behind or beside the base station 200. The charging module includes charging terminals configured to dock to and charge the cleaning robot 100. The base station 200 includes a base plate 2531 and a supporting portion configured to connect the base plate and the storage module 210.

The storage module 210 includes a storage module 215 configured to accommodate a mopping module 310. In this embodiment, the base station 200 is a mopping module replacement station configured to automatically replace a mopping module. When mopping module replacement is performed, a new (clean) mopping module is required, and a dirty mopping module is generated. In this case, the storage module configured to accommodate these mopping modules is required. Therefore, the storage module is disposed to accommodate the mopping modules, to automatically replace a mopping module.

In this embodiment, the cleaning robot 100 may automatically return to the base station 200, and automatically replace a mopping module, the dirty mopping module is automatically accommodated in the storage module 210, a clean mopping module 310 is automatically accommodated in the storage module, and the entire process is automatic without any manual operation. However, when the storage module 210 is fully loaded with dirty mopping modules 310, or clean mopping modules 310 are used up, it is very difficult for the user to find this case in time. If the case is not found in time, because the storage module is fully loaded with dirty mopping modules or clean mopping modules are in short supply, the robot cleaning system 300 cannot automatically replace a mopping module, and cannot continue to perform automatic mopping work.

In this embodiment, the base station 200 further includes a storage state detection module configured to detect whether a storage state in the storage module 215 is a preset state and a reminding module configured to send reminding information indicating that the storage state in the storage module 215 is the preset state, and the control unit controls, according to a detection result of the storage state detection module, the reminding module to send the reminding information to the outside. The storage state in the storage module 215 is a state such as whether there is a mopping module in the storage module 215 and/or whether a storage quantity of mopping modules exceeds a preset value. The preset state is a pre-delivery or user-defined threshold state. For example, a state that there is a mopping module in the storage module 215 may be defined as the threshold state, and when the storage state detection module detects that there is a mopping module in the storage module, the control unit controls the reminding module to send the reminding information; or a state that there is no mopping module in the storage module 215 may be defined as the threshold state, and when the storage state detection module detects that there is no mopping module in the storage module, the control unit controls the reminding module to send the reminding information; or a state that the quantity of mopping modules in the storage module 215 reaches the preset value may be defined as the threshold state, and when the storage state detection module detects that the quantity of mopping modules in the storage module reaches the preset value, the control unit controls the reminding module to send the reminding information.

The reminding module may be a light warning apparatus, a sound warning apparatus, a wireless sending module that is configured to send the reminding information to the outside, or the like. For example, the reminding module may emit corresponding light, flashlight, or the like through the light warning apparatus, may alternatively send a warning sound through the sound warning apparatus, and may alternatively send reminding information to a mobile phone app, a computer, or another mobile device of the user through the wireless sending module.

As shown in FIG. 53 and FIG. 54, the storage module 215 is located above the accommodation cavity 258, and the storage module 215 includes a communicating mouth 2150 that may be opened and closed. When the communicating mouth 2150 is in an opened state, the storage module 215 is in communication with the accommodation cavity 258 up and down; and when the communicating mouth 2150 is in a closed state, the storage module 215 is not in communication with the accommodation cavity 258 up and down. The mopping module 310 may be directly transferred up and down between the storage module 215 and the accommodation cavity 258 through the communicating mouth, to automatically mount the clean mopping module 310 on the base station 200 onto the cleaning robot, or automatically store the dirty mopping module 310 detached from the cleaning robot 100 into the storage module 215 in the base station 200. The base plate 2531 includes an accommodation groove configured to accommodate the mopping module 310, so that when the mopping module 310 is transferred from the storage module 215 to the accommodation cavity 258, the mopping module 310 is accommodated, to avoid or reduce protrusion of the mopping module 310 from a surface of the base plate 2531.

The storage module 210 includes a first storage unit 211 and a second storage unit 212 respectively configured to store a dirty mopping module 310 and store a clean mopping module 310, and correspondingly, the storage module 215 includes a first storage unit 2153 configured to store a dirty mopping module and a second storage unit 2154 configured to store a clean mopping module. The communicating mouth 2150 includes a first communicating mouth 2151 and a second communicating mouth 2152 that are respectively located below the first storage unit 2153 and the second storage unit 2154 and that may be opened and closed. The first storage unit 2153 and the second storage unit 2154 are located abreast above the accommodation cavity 258 in the horizontal direction. The corresponding base plate 2531 has an accommodation groove configured to accommodate the dirty mopping module and an accommodation groove configured to accommodate the clean mopping module. In an aspect, the mopping modules may be limited, and in another aspect, the mopping modules may be prevented from excessively protruding from the base plate 2531, to hinder the cleaning robot 100 from moving.

The accommodation cavity 258 has an opening 255 in communication with the outside provided for the cleaning robot 100 to leave and/or enter, and a supporting portion 2532 is disposed on a side of the base station 200 opposite to the opening 255, so that when the cleaning robot 100 docks, projections of the cleaning robot 100 and the storage module 210 in the horizontal plane approximately coincide. Therefore, the structure of the base station 200 in the horizontal direction is more compact, thereby reducing the occupied area of the entire robot cleaning system 300. The charging terminals are located on the supporting portion 2532 or the base plate 2531. Certainly, in some embodiments, the charging terminals may be alternatively located at a position such as the bottom of the storage module 210, so that the top of the cleaning robot 100 is in contact with the charging terminals to perform charging. After entering the base station 200 to complete docking, the cleaning robot 100 starts charging, and the cleaning robot 100 leaves the base station 200 after the charging ends. In another embodiment, a manner in which the cleaning robot 100 returns for charging further includes wireless charging, the charging module includes a transmitting coil, and the cleaning robot 100 includes a receiving coil, to charge the cleaning robot 100 through electromagnetic induction between the transmitting coil and the receiving coil. The charging module is disposed on the base station 200, whose beneficial effect lies in that functions of the base station 200 are integrated, so that the base station 200 is reusable in function and compact in structure.

Figure 55:
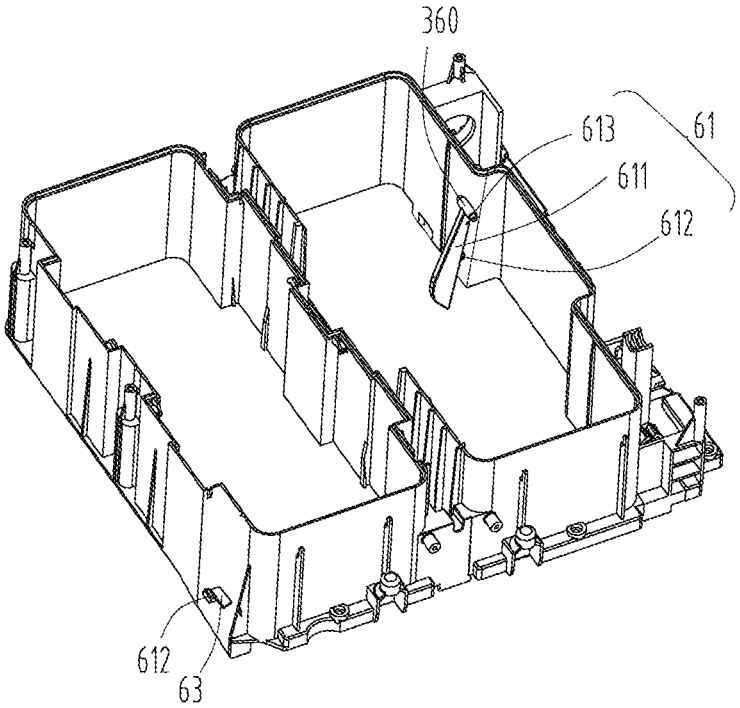
FIG. 55 is a schematic diagram of a movable member not triggered by a mopping module according to an embodiment of the present disclosure.
Figure 56:
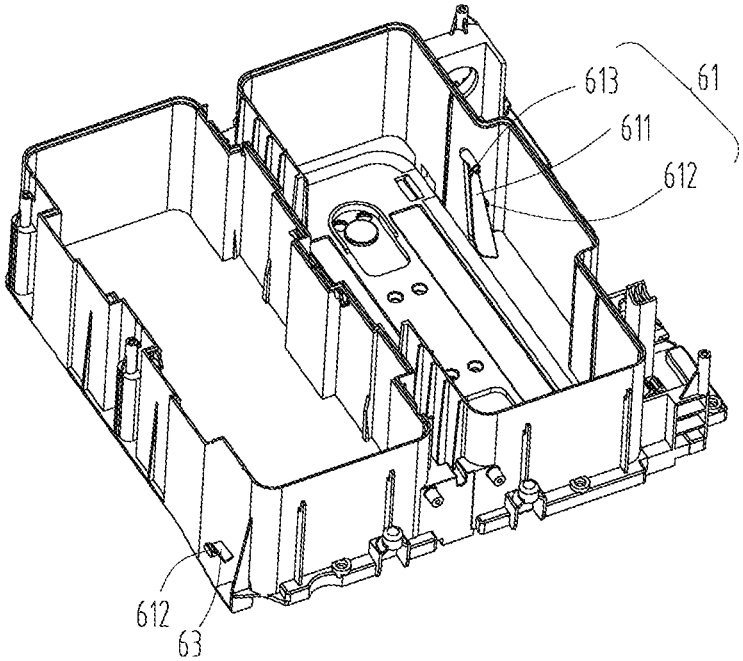
FIG. 56 is a schematic diagram of the movable member shown in FIG. 55 triggered by a mopping module.

The storage state detection module 360 may be a mechanical detection structure, a detection sensor, or the like. As shown in FIG. 55 and FIG. 56, using the mechanical detection structure as an example, the storage state detection module 360 includes a detection element 63, and a movable member 61 at least partially movably disposed in the storage module 215 to trigger the detection element 63. The movable member 61 includes a triggering portion 612 configured to trigger the detection element 63, a contact portion 611 configured to come into contact with a mopping module, and an elastic member 613 configured to provide a restoring force to the movable member. When a mopping module 310 in the storage module 215 applies a pressure to the contact portion 611, the contact portion 611 drives the triggering portion 612 to move, to trigger state switching of the detection element 63; or, when the quantity of mopping modules 310 in the storage module 215 becomes zero, the triggering portion 612 is driven under the action of the restoring force of the elastic member to move, to trigger state switching of the detection element 63. According to a specific case, the control unit may control, when the detection element 63 is switched from a non-triggering state to a triggering state, the reminding module to send reminding information, and may alternatively control, when the detection element 63 is switched from the triggering state to the non-triggering state, the reminding module to send reminding information. The movable member 61 is disposed on an inner wall in the storage module 215, so that when being accommodated in the storage module 215, the mopping module 310 may apply a pressure to the contact portion 611, to touch the movable member 61, and then trigger the detection element 63. The foregoing detection element 63 may be a photoelectric switch, a micro-switch, or the like. In this embodiment, the mechanical detection structure detects the storage state in the storage module, to avoid being subject to interference from dust, the external environment, or another structure, so that the detection structure is accurate and the costs are low.

When the storage module 310 includes a first storage unit 211 and a second storage unit 212 respectively configured to store a dirty mopping module 310 and store a clean mopping module 310, each of the first storage unit 211 and the second storage unit 212 includes a storage state detection module 360. As shown in FIG. 55 and FIG. 56, the first storage unit 2153 and the first storage unit 2154 are each internally provided with a movable member 61, and two detection elements 63 corresponding to movable members 61 are disposed on the base station.

Specifically, the second storage unit 212 of the base station 200 includes a storage state detection module 360, capable of detecting a current state of the mopping module 310 in the second storage unit 212 and sending reminding information to the user. For example, when it is detected that the second storage unit has no mopping module 310, the user is reminded to add a mopping module in time, to avoid affecting working stability of the base station 200. Similarly, the first storage unit 211 also includes a storage state detection module 360, configured to send reminding information for processing mopping modules 310 to the user when it is detected that the quantity of mopping modules 310 placed in the first storage unit 211 reaches a preset value, or detected that a storage time of mopping modules in the first storage unit 211 reaches a preset value. For example, when the quantity of mopping modules 310 is greater than or equal to a preset value, reminding information for processing the mopping modules 310 is sent to the user. The foregoing preset value may be set before pre-delivery, and may be alternatively set autonomously according to a requirement of the user.

A manner in which the base station sends reminding information includes: the base station communicates with a mobile device (for example, a mobile phone, a computer, or an IPAD), to send reminding information to the user, to remind the user to clear the base station in time, or remind the user to add a mopping module. In another embodiment, the base station includes an indicator, and is capable of reminding, through light or sound of the indicator or in another manner, the user to perform a corresponding operation on the base station.

In another embodiment, as shown in FIG. 39, the storage state detection module 360 may be a photoelectric sensor, the photoelectric sensor includes a transmit end and a receive end, and a connecting line between the transmit end and the receive end passes through the storage module 215, to detect the storage state in the storage module 215. The photoelectric sensor may be configured to detect the quantity (including zero) of mopping modules 310 in the storage unit 210, be configured to determine whether the first storage unit 2153 has been fully loaded with mopping modules 310, and be configured to determine whether the first storage unit 2154 has no mopping module 310. The mopping module 310 separated from the main body of the cleaning robot 100 is placed in the first storage unit 2153, the mopping module 310 provided for the cleaning robot 100 to mount is placed in the first storage unit 2154, and when the first storage unit 2153 has been fully loaded with mopping modules 310, or the first storage unit 2154 has no mopping module 310 that may be provided for the cleaning robot 100 to mount, the base station sends a corresponding prompt instruction.

The transmit end may be disposed on a side of the storage module, the receive end is disposed at a corresponding position on another side of the storage module, and when a signal transmitted by the transmit end can be received by the receive end, it indicates that there is no obstacle between the transmit end and the receive end. If whether the first storage unit 2153 is fully loaded with mopping modules 310 needs to be detected, the transmitter of the photoelectric sensor is mounted on a side of the top of the first storage unit 2153, and the receiver of the photoelectric sensor is mounted at another side; and if the first storage unit 2153 is fully loaded with mopping modules 310, when the transmitter transmits a signal, because the signal is blocked by the mopping module 310 at the top of the first storage unit 2153, the receiver cannot receive the signal, and it is determined accordingly that the first storage unit 2153 has been fully loaded with mopping modules 310. Moreover, if whether the first storage unit 2154 further has a mopping module 310 with which the cleaning robot 100 may perform replacement needs to be detected, the transmit end of the photoelectric sensor is mounted on a side of the bottom of the first storage unit 2154, and the receive end is mounted at a corresponding position on another side; and if the first storage unit 2154 has no mopping module 310 to be mounted, after the transmit end of the photoelectric sensor transmits a signal, because the signal is not blocked by any intermediate mopping module, the receive end can receive the signal, and it is determined accordingly that the first storage unit 2154 has no mopping module 310 that may be provided for the cleaning robot 100 to mount. In another embodiment, the photoelectric sensor may be mounted on another position. For example, if it is determined that the quantity of mopping modules 310 in the storage module 215 is less than 2, the photoelectric sensor may be mounted at a position where a second mopping module is stacked in the storage module 210; and if the receive end has not detected any signal, it indicates that the quantity of mopping modules 310 in the storage module is greater than or equal to 2; otherwise, it indicates that the quantity of mopping modules 310 in the storage module is less than 2.

Certainly, in another embodiment, the storage state detection module may be further a Hall sensor, an infrared sensor, a reed switch, or the like.

Technical features of the foregoing embodiments may be randomly combined. To make description concise, not all possible combinations of the technical features in the foregoing embodiments are described. However, the combinations of these technical features shall be considered as falling within the scope recorded by this specification provided that no conflict exists.

The foregoing embodiments only describe several implementations of the present disclosure, and their description is specific and detailed, but cannot be understood as a limitation to the patent scope of the present disclosure. It should be noted that a person of ordinary skill in the art may further make several variations and improvements without departing from the concept of the present disclosure, and these variations and improvements all fall within the protection scope of the present disclosure. Therefore, the protection scope of the patent of the present disclosure shall be subject to the appended claims.

What is claimed is:

1. A base station comprising:

an operating position for a cleaning robot to dock to replace a first mopping module of the cleaning robot or mount a second mopping module of the cleaning robot;

a storage module configured to store at least one of the first mopping module or the second mopping module, wherein the storage module is located above the operating position at least when the first mopping module is separated from the cleaning robot, when the second mopping module is mounted to the cleaning robot, or when the first mopping module is separate from the cleaning robot and the second mopping module is mounted to the cleaning robot; and a transfer module configured to transfer at least one of the first mopping module or the second mopping module between the storage module and the operating position.

2. The base station according to claim 1, wherein:

the base station further comprises a base including a base plate;

the operating position is formed on the base plate, and there is an accommodation cavity enclosed by the base and the storage module to accommodate the cleaning robot.

3. The base station according to claim 2, wherein:

the storage module comprises a first storage unit and a second storage unit, the first storage unit is configured to store the first mopping module separated from the cleaning robot, and the second storage unit is configured to store the second mopping module provided to the cleaning robot for mounting.

4. The base station according to claim 3, wherein:

the operating position comprises a first operating position at which the cleaning robot is separated from the first mopping module, and a second operating position at which the cleaning robot mounts the second mopping module, the first storage unit is located above the first operating position, and the second storage unit is located above the second operating position.

5. The base station according to claim 4, wherein the transfer module is configured to cause the first mopping module or the second mopping module to at least partially move in a vertical direction.

6. The base station according to claim 4, wherein:

the transfer module comprises a driving member and a loading member; and the loading member is connected to the first mopping module or the second mopping module and causes the first mopping module or the second mopping module to move under an action of the driving member.

7. The base station according to claim 6, wherein the loading member comprises:

a mopping module collection unit configured to move the first mopping module at the first operating position separated from the cleaning robot to the first storage unit; and a mopping module providing unit configured to obtain the second mopping module from the second storage unit and move the second mopping module to the second operating position, for the cleaning robot to mount.

8. The base station according to claim 7, wherein the loading member comprises a supporting assembly that comprises:

a first supporting assembly configured to support the first mopping module in the first storage unit to prevent the first mopping module from falling; and a second supporting assembly configured to support the second mopping module in the second storage unit to prevent the second mopping module from falling.

9. The base station according to claim 8, wherein the mopping module collection unit comprises a first mopping module lifting frame configured to be driven by the driving member to ascend, to carry and drive the first mopping module to move from the first operating position to the first storage unit.

10. The base station according to claim 8, wherein the mopping module providing unit is operable to be in a first state of fixing the second mopping module and a second state of releasing the second mopping module, and transfers the second mopping module in the second storage unit to the second operating position when the second mopping module is released.

11. The base station according to claim 1, wherein the operating position is provided with a stop structure, configured to stop the first mopping module separated from the cleaning robot and/or the second mopping module provided for the cleaning robot to mount.

12. The base station according to claim 1, wherein the storage module is detachably disposed relative to the base station.

13. The base station according to claim 3, wherein the first mopping module and the second mopping module are a same type.

14. The base station according to claim 7, wherein the mopping module providing unit comprises a second mopping module lifting frame configured to be driven by the driving member to descend, to carry the second mopping module to move from the second storage unit to the second operating position.

15. The base station according to claim 1, wherein at least part of a bottom of the storage module is located above a top of the operating position.

16. The base station according to claim 1, wherein at least part of the storage module is located on top of the operating position.

* * * * *